US005671287A

United States Patent [19]

Gerzon

[11] Patent Number: 5,671,287

[45] Date of Patent: Sep. 23, 1997

[54] STEREOPHONIC SIGNAL PROCESSOR

[75] Inventor: Michael Anthony Gerzon, Oxford, United Kingdom

[73] Assignee: Trifield Productions Limited, United Kingdom

[21] Appl. No.: 347,399

[22] PCT Filed: May 28, 1993

[86] PCT No.: PCT/GB93/01131

§ 371 Date: Feb. 21, 1995

§ 102(e) Date: Feb. 21, 1995

[87] PCT Pub. No.: WO93/25055

PCT Pub. Date: Dec. 9, 1993

[30] Foreign Application Priority Data

Jun. 3, 1992 [GB] United Kingdom ..... 9211756

[51] Int. Cl.[6] ..... H04R 5/00

[52] U.S. Cl. ..... 381/17; 381/18; 381/20; 381/1; 381/97; 381/22

[58] Field of Search ..... 381/17, 18, 24, 381/20, 21, 22, 1, 97

[56] References Cited

U.S. PATENT DOCUMENTS

| | | | |
|---|---|---|---|
| 3,670,106 | 6/1972 | Orban | 381/17 |
| 4,653,096 | 3/1987 | Yokoyama . | |
| 5,208,860 | 5/1993 | Lowe et al. | 381/17 |

FOREIGN PATENT DOCUMENTS

| | | |
|---|---|---|
| 1168972 | 4/1964 | Germany . |
| 1917895 | 10/1970 | Germany . |
| 3640414 | 5/1987 | Germany . |

*Primary Examiner*—Curtis Kuntz
*Assistant Examiner*—Duc Nguyen
*Attorney, Agent, or Firm*—Baker & Daniels

[57] ABSTRACT

A frequency-dependent linear audio signal processor takes source signals S in input signals and provide directionally spread directionally encoded output signals. The processor directionally encodes with constant gain magnitude frequency components of the source signal S to-and-fro across a predetermined directional stage P" as frequency increases such that at least three predetermined positions within the stage P", the directional encoding has substantially zero perceived phasiness. The processor may be a frequency-dependent rotation matrix for stereo input signal and may be a unitary network using a feedback path around parallel identical all-pass networks in series with a rotation matrix and a feedforward path bypassing the all-pass networks. Successive frequencies of positioning of source signal S at a predetermined position P within the stage P" are preferably spaced approximately uniformly on a logarithmic or Bark Frequency scale. Several sources S may have individually adjustable spreads while sharing common processor.

47 Claims, 18 Drawing Sheets

STEREOPHONIC SIGNAL PROCESSOR

BACKGROUND TO THE INVENTION

This invention relates to directional sound production and reproduction systems wherein it is desired to provide sound source signals with a desired directional dispersion or angular spread of signal components.

In many applications, it is undesirable that the reproduced image of a sound source in a directional reproduction system should be absolutely sharp. Actual sounds subtend a finite angular width at a listener, and it is often desired to simulate such a natural angular size. Additionally, it is often desired to take monophonic material, such as historical monophonic recordings or the monophonic "surround" channel of a film surround soundtrack and to provide reproduction having a wide angular spread.

Methods of providing such angular spread or dispersion for individual sound source signals are often termed "pseudostereo" methods. Pseudostereo methods are well known in the prior art. For example, see R. Orban "A Rational Technique for Synthesizing Pseudo-Stereo from Monophonic Sources", Journal of the Audio Engineering Society, vol. 18 no. 2 pages 157 to (February 1970), and M. R. Schroeder "An Artificial Stereophonic Effect Obtained from a Single Audio Signal" Journal of the Audio Engineering Society, vol. 6 no. 2 pages 74 to 79 (April 1958).

However, prior art pseudostereo methods have numerous defects. Most prior art pseudostereo methods work by providing a dual filter arrangement whereby a monophonic source signal is fed to a left and a right stereo channel with complementary filter characteristics, whereby frequency components that are cut on one channel are boosted on the other. However, prior art filter arrangements such as those described by Orban in the cited reference generally cause unpleasant phase differences between the two speaker signals, producing an unpleasant subjective sensation often termed "phasiness". While in the cited reference Schroeder describes a dual filter arrangement that avoids phasiness, the arrangement suggested has a total reproduced energy response, measured as a function of frequency, that is not flat, but which has variations of 3 dB. Such variations in the reproduced total energy response are undesirable, as they can cause audible colouration effects.

Phasiness and unflat reproduced energy response are not the only problems with prior art pseudostereo methods. It is not difficult to degrade the sharp localisation quality of stereophonic images by introducing irregular amplitude and/or phase differences between the stereo channels, and/or adding delayed simulated early reflections. However, in the desired applications of pseudostereo, it is desired to avoid unnatural side effects that cause listening fatigue. Such side effects can arise from different auditory localization cues giving mutually contradictory results. For example, the ears tend to localise transient and continuous sounds by different mechanisms, and methods of pseudostereo relying on the use of time delays, especially those in excess of about 1 or 2 milliseconds, tend to provide contradictory cues by these two mechanisms, resulting in an audible splitting of the directionality of transient and continuous sound components.

Another cause of audible splitting of the directional effect caused by dual filter arrangements is when different frequency components of a single sound are heard as being sharply localised in different directions. Sometimes such frequency splitting is found to be desirable, as in the case where the different frequency components correspond to different sound sources within a monophonic mix, in which case the splitting can be used to provide different stereo directions for different sound sources, but in other cases such splitting is undesirable, such as when the different frequency components should have the same localisation quality.

Besides these problems, prior art pseudostereo methods are also only applicable to separate monophonic source signals, whereas it is often desired to be able to take a pre-mixed stereo sound source with sharp sound images, and to be able to provide directional dispersion or spread on each and every sound source within the stereo mix.

SUMMARY OF THE INVENTION

Preferred aspects of the invention provide a pseudostereo or directional dispersion effect with both low phasiness and a substantially flat reproduced total energy response. Also the invention provides a pseudostereo effect with minimal unpleasant and undesirable subjective side effects. It can also provide a pseudostereo effect for each and every sound source within a premixed stereo signal, and provide simple methods of controlling the various parameters of a pseudostereo effect such as the size of angular spread of sound sources.

According to the invention in a first aspect, audio signal processing means responsive to an input sound source signal S provide a pseudo stereo effect in a plurality of output signals directionally encoded for a predetermined directional encoding system, said means comprising frequency-dependent directional panning means arranged to vary encoded direction to-and-fro across a predetermined directional sound stage as the input source signal frequency is varied, such that the total reproduced energy gain is substantially constant with frequency, said means being further such as to make reproduced phasiness effects caused by psychoacoustically undesirable reproduced phase differences substantially zero at at least three positions within said predetermined directional sound stage.

According to the invention in a second aspect, audio signal processing means responsive to an input sound source signal S provide a pseudo stereo effect in a plurality of output signals directionally encoded for a predetermined directional encoding system, said means comprising frequency-dependent directional panning means arranged to vary encoded direction to-and-fro across a predetermined directional sound stage as the input source signal frequency is varied, such that the gain magnitude with which S is directionally encoded is substantially independent of frequency and such that at all frequencies, the signal S is encoded into a direction P' within said predetermined stage substantially according to the directional encoding law of said predetermined directional encoding system.

According to the invention in a third aspect, audio signal processing means responsive to a plurality of input signal channels conveying signals directionally encoded for a second predetermined directional sound encoding system provide a pseudo stereo effect in a plurality of output signals directionally encoded for a predetermined directional encoding system, said means providing for each input source signal S encoded at each direction P in said input signal channels output signals encoded with gain magnitudes substantially independent of frequency substantially according to the directional encoding law of said predetermined directional encoding system into directions P' which vary with frequency to-and-fro across a predetermined directional sound stage P" that is dependent on the direction P of said source signal.

In preferred implementations of the invention in its first, second or third aspects, the phasiness of reproduced sounds remains small for all frequencies and reproduced directions within said predetermined directional sound stage.

Also in preferred implementations of the invention in its first, second or third aspects, said audio signal processing means is a linear frequency-dependent network or filter means.

In preferred implementations of the invention in its first, second or third aspects, any delay means used in said audio signal processing means is preferably short, typically under 2 milliseconds in length and preferably under 1 millisecond and even more preferably under ½ millisecond in length, in order to avoid different localisations of transient and continuous sound components in said source signal S.

It is also preferred, in implementations of the invention according to the above mentioned aspects, that the frequencies of successive swings to-and-fro across said predetermined sound stage more closely approximate to being spaced uniformly on a logarithmic or psychoacoustic Bark frequency scale than to being spaced uniformly on a linear frequency scale, at least across a middle audio frequency range from 200 Hz to 6 kHz.

The said predetermined directional encoding system, and where relevant, the said second predetermined directional sound encoding system, may, by way of example, be conventional two-channel two-speaker stereo encoded using a sine/cosine panning law, or may be B-format azimuthal directional encoding in which sounds are directionally encoded into three signals W, X, Y at a directional azimuth θ (measured anticlockwise from due front) with respective gains 1, $2^{1/2}\cos\theta$ and $2^{1/2}\sin\theta$. Other directional encoding systems that may be used with the invention include binaural or transaural encoding systems in which sounds are encoded into two channels in a frequency-dependent manner with gains and phases dependent on direction so as to reproduce at the two ears of a listener the natural interaural phase and amplitude cues associated with natural sounds in that direction.

Other examples of directional encoding systems suitable for use with the invention include the UHJ azimuthal encoding system described by M. A. Gerzon in "Ambisonics in Multichannel Broadcasting and Video", Journal of the Audio Engineering Society, vol. 33 no. 11 pp. 859–871 (1985 November), the UMX azimuthal encoding systems described in D. H. Cooper and T. Shiga "Discrete-Matrix Multichannel Stereo", Journal of the Audio Engineering Society, vol. 20 no. 6 pp. 346–369 (1972 June), periphonic (i.e. full-sphere with height) systems such as described in M. A. Gerzon, "Periphony: With-Height Sound Reproduction", Journal of the Audio Engineering Society, vol. 21 no. 1 pp. 2–10 (1973 January/February), and n-speaker stereo systems in which sounds are directionally encoded by a panpot law, such as described in M. A. Gerzon "Panpot Laws for Multispeaker Stereo", preprint 3309 of the 92nd Audio Engineering Society Convention, Vienna (1992 Mar. 24–27).

In a highly preferred implementation of the invention in the above aspects, said variation of the reproduced output direction of S with frequency is implemented by frequency-dependent rotation matrix means. In preferred implementations of the invention in its third aspect, said audio signal processing means is itself a frequency-dependent rotation matrix means. Preferably in this preferred implementation, the rotation angle varies to-and-fro with frequency across a predetermined range of rotation angles.

In a preferred version of the invention in the third aspect, said audio signal processing means is a unitary signal processing means comprising parallel identical all-pass networks and rotation matrices with a feedback path with gain less than unity around the all-pass networks and at least some of the rotation matrices, and a feedforward path bypassing the all-pass networks also with gain less than unity. In this version of the invention, all rotation matrices may be chosen to be commuting matrices.

In the invention in its third aspect, the second directional sound encoding system and the predetermined directional encoding system need not be identical, and in such a case it is preferred that said predetermined directional encoding system signals be derivable from said second directional sound encoding system by means of an encoding matrix means. By way of example, 2-channel UHJ may be encoded by matrix means from B-format, as described in the above cited 1985 Gerzon reference.

Other aspects, embodiments, objects and advantages of the invention will be apparent from the description and claims.

DESCRIPTION OF DRAWINGS

Embodiments of the invention will now be described by way of example with reference to the accompanying drawings in which:

FIG. 4*a* shows the case with a monophonic input and FIGS. 4*b* and 4*c* show alternative equivalent methods for the case with a stereo input.

DETAILED DESCRIPTION OF EXAMPLES

Figure 1A:
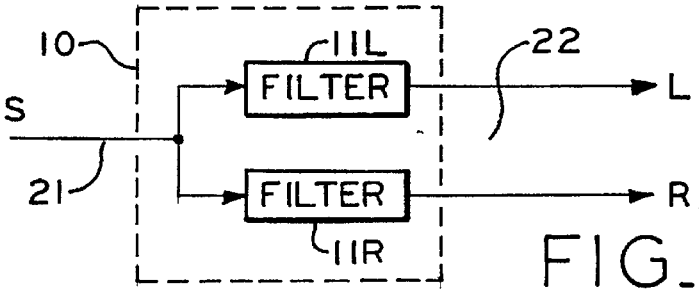
FIGS. 1*a* and 1*b* show dual filter means of creating pseudostereo from a mono source signal S.

FIG. 1*a* shows a generic method of creating pseudostereo via a 2-channel stereo signal L and R from a mono input source signal S. The source signal 21 is fed into a dual filter means comprising a left filter means 11L and a right filter means 11R, whose respective outputs L and R form an output stereo signal 22. In the prior art, it is well-known that the filter means 11L and 11R may be a pair of equalisers of the graphic or parametric type, arranged so that at frequencies at which one has a gain cut, the other has a compensating gain boost so as to maintain an approximately flat total energy response with frequency. At frequencies at which say the left filter means is cut, the sound would be disposed towards the right speaker signal R and conversely, thereby creating a pseudostereo effect.

Figure 1B:
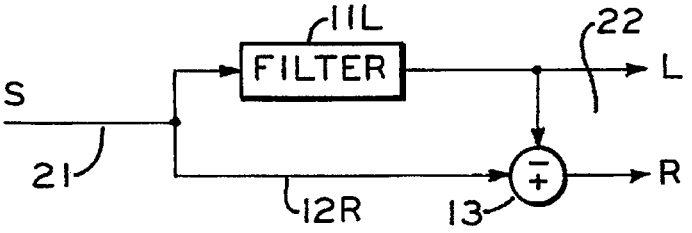

More generally in the prior art, the filter means 11L and 11R have typically been minimum phase filters, but such complementary minimum phase filters have phase shifts accompanying any variation in amplitude response with frequency, causing interchannel phase differences between the output signals L and R, and consequent undesired phasiness effects. One particular means of implementing FIG. 1*a* that has been proposed in the prior art is shown in FIG. 1*b*, where the right filter means is achieved by using a subtraction means 13 to subtract the output of a left filter means 11L from a direct signal 12R taken from the input 21. This achieves a mono signal L+R formed from the sum of the stereo output signals 22 that equals the input signal S.

Figure 2:
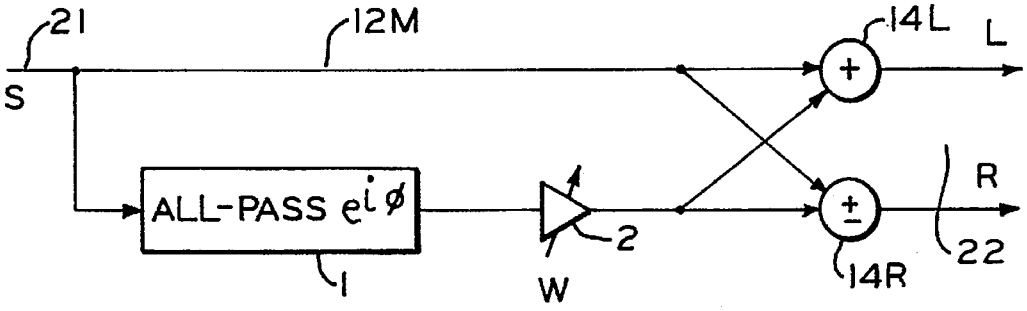
FIG. 2 shows the Orban method for creating pseudostereo.

Another method of ensuring that the mono output L+R is proportional to the input signal is to use the pseudostereo method illustrated in FIG. 2. This method, termed the "Orban method" and described by Orban in the above-cited reference, splits the mono input signal 21 into a direct-path mono signal 12M and an indirect signal which is passed through an all-pass network 1 with unity amplitude gain, having a complex gain as a function of frequency $e^{i\phi}$ where $i=\sqrt{-1}$ and $\phi$ is the phase response in radians, and then through a gain means 2 with adjustable gain w, the output of which is then respectively added to by means 14L and subtracted from by means 14R the direct mono signal 12M to form left L and right R output pseudostereo signals 22.

The Orban method effectively forms a sum and difference signal for the pseudostereo output signal that differ in a frequency-dependent manner in phase, but which both have flat amplitude responses. By this means, the Orban method gives both a mono signal L+R that has a flat frequency response and a pseudostereo signal 22 that has a total energy response $|L|^2+|R|^2$ that also is flat. The width of the pseudostereo image can be adjusted by adjusting the gain w of the gain means 2. Providing that the width gain w has magnitude not greater than 1 and that the all-pass network 1 is a causal network, the left and right filter means 11L and 11R in the representation of the Orban method of FIG. 1*a* are both minimum phase filters, and thereby exhibit phasiness effects.

Although it is an aim of the present invention to reduce such phasiness effects, many of the preferred implementations of the present invention are similarly based on the use of all-pass networks with complex gain $e^{i\phi}$, so that an understanding of the prior-art Orban method provides a basis for understanding the more complicated networks to be described in the following.

The convention is adopted of using letters such as L and R not only to represent signals, but also to represent the complex gains at a given frequency of these signals.

Then the output signals L and R of the Orban method of FIG. 2 have respective gains:

$$L=1+we^{i\phi} \tag{1a}$$

$$R=1-we^{i\phi}. \tag{1b}$$

The respective left and right energy gains of these two signals are $$|L|^2=(1+w^2)+2w\cos\phi \tag{2a}$$

$$|R|^2=(1+w^2)-2w\cos\phi. \tag{2b}$$

For any complex gains L and R of 2-speaker left and right stereo signals, it can be shown that the stereo position of the resulting stereo image is approximately described by a "position parameter" P given by $$P=Re[(L-R)/(L+R)] \tag{3a}$$

and the subjective "phasiness" is approximatelely described by the magnitude of the "phasiness parameter"

$$Q=Im[(L-R)/(L+R)], \tag{3b}$$

where Re means "the real part of" a complex number, and Im means "the real coefficient of the imaginary part of" a complex number. The psychoacoustic significance of P and Q are discussed further in Appendix II of M. A. Gerzon, "A Geometric Model for Two-Channel Four-Speaker Matrix Stereo Systems", Journal of the Audio Engineering Society, vol. 23 no. 3 pp. 98–106 (1975 March).

Generally, P describes apparent stereo position, being equal to +1 for sounds from the left speaker direction, 0 from the centre direction and −1 for sounds from the right speaker direction, with intermediate values in intermediate directions. Q describes the magnitude of the phasiness sensation, and is found to be generally unacceptable if of magnitude greater than one, disturbing if of magnitude greater than 0.4, and still significantly audible if of magnitude greater than around 0.2, although sensitivity to phasiness effects varies from listener to listener.

A computation from equation (1) shows that for the Orban method:

$$P=w\cos\phi \tag{4a}$$

$$Q=w\sin\phi, \tag{4b}$$

so that the position P varies with frequency to-and-fro between −w and w, while the phasiness magnitude has maximum value w (corresponding to an interspeaker phase difference $2\tan^{-1}w$).

Figure 3:
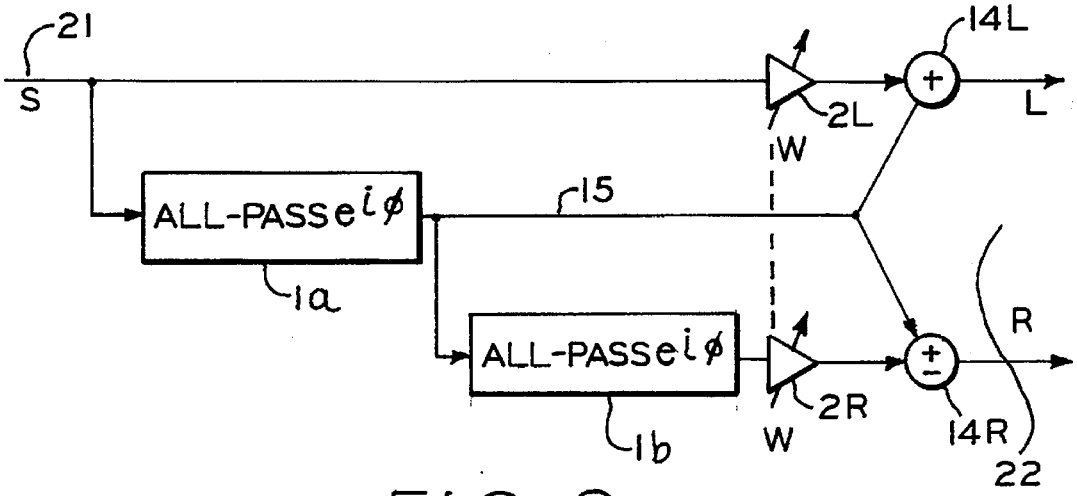
FIG. 3 shows a method for achieving pseudostereo with a reduced phasiness.

FIG. 3 shows a method according to the invention of achieving pseudostereo with less phasiness than the Orban method. This new technique uses two identical all-pass means 1*a* and 1*b* each with complex gain $e^{i\phi}$, where the input source S signal 21 is fed to the input of the first all-pass means 1*a* and its output is fed to the input of the second identical all-pass means 1*b*. The output 15 of the first all-pass means 1*a* is fed equally to the left L and right R output signals. The left output signal L is formed by taking the input signal 21 and feeding it via a gain means 2L with gain w and combining it with adding means 14L with the output 15 of the first all-pass means 1*a*. The right output signal R is formed by taking the output of the second all-pass means 1*b* and feeding it via a gain means 2R also with the same gain w, and subtracting it using subtraction means 14R from the output 15 of the first all-pass means 1*a*.

The reduced-phasiness pseudostereo means shown in FIG. 3 has respective left and right complex gains:

$$L=e^{i\phi}(1+we^{-i\phi}) \tag{5a}$$

$$R=e^{i\phi}(1-we^{i\phi}) \tag{5b}$$

These have precisely the same energy gains (2) as does the Orban method (1), but the interchannel phase is different. In particular, the total energy gain is still constant at $2+2w^2$ at all frequencies, but the position and phasiness parameters for FIG. 3 are given by:

$$P=(w\cos\phi)/(1+w^2\sin^2\phi) \tag{6a}$$

$$Q=(\tfrac{1}{2}w^2\sin 2\phi)/(1+w^2\sin^2\phi). \tag{6b}$$

In particular, as in the Orban case when $\phi=0°$ or $180°$, P equals ±w and Q=0. However, unlike the Orban case, when $\phi=\pm 90°$, Q=0 also, so that the central P=0 images also have zero phasiness.

For intermediate values of $\phi$, the phasiness Q is no longer zero, but is still generally smaller than in the Orban method. For example, for w=1, the maximum phasiness Q equals $8^{-1/2}=0.3536$ at $\phi=35.26°$, and for w=0.7, the maximum phasiness is Q=0.2007 at $\phi=39.33°$, and at w=0.5, the maximum phasiness is Q=0.1118 at $\phi=41.81°$. Thus, although the reduced phasiness technique of FIG. 3 has less phasiness than the Orban method, phasiness is still significant until the width w falls below around 0.5 or thereabouts.

Also, the reduced phasiness method of FIG. 3 has a significantly reduced value of the magnitude of P for phase shift angles $\phi$ other than 0° or 180° by equ. (6a) as compared to the Orban value (4a), thereby resulting in a subjectively narrower pseudostereo spread for any given value of w. Additionally, the technique of FIG. 3 also only applies to sounds spread around a central stereo position, whereas in many applications, one wishes to spread sounds about an arbitrary predetermined stereo position.

One may move the centre of the spread image to any other stereo position by following any of the networks shown in FIGS. 1 to 3 by a rotation matrix means $R_\theta$, which rotates stereo images by an angle $\theta$ between left and right channels, i.e. one that gives outputs L' and R' where $$L'=(\cos\theta)L-(\sin\theta)R \tag{7a}$$

$$R'=(\sin\theta)L+(\cos\theta)R \tag{7b}$$

or in matrix notation $$\begin{pmatrix} L' \\ R' \end{pmatrix}=\begin{pmatrix} \cos\theta & -\sin\theta \\ \sin\theta & \cos\theta \end{pmatrix}\begin{pmatrix} L \\ R \end{pmatrix}. \tag{7c}$$

Figure 4A:
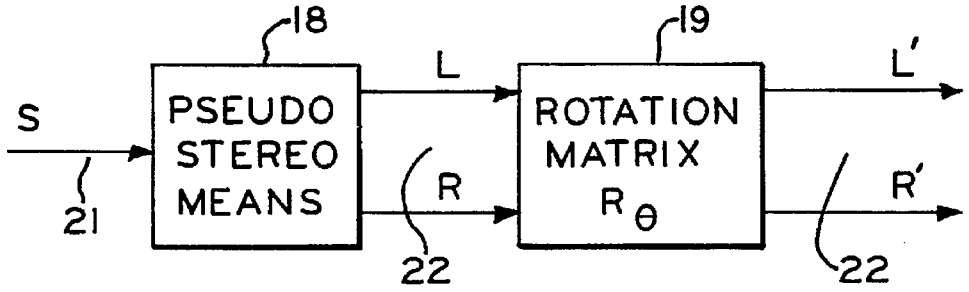
FIGS. 4*a* to 4*c* show methods of providing an altered central stereo position with known pseudostereo means.

However, referring to FIG. 4*a*, even with the use of a rotation matrix $R_\theta$ means 19 following the pseudostereo algorithm 18, the pseudostereo algorithms so far described only handle single monophonic inputs, and do not spread all images in a premixed stereo input.

The various limitations of phasiness, poor spread and inability to process premixed stereo inputs may all be overcome without a significant increase in complexity above that in the algorithm of FIG. 3, by algorithms using just two all-pass networks with complex gains $e^{i\phi}$, as will be described in the following.

In conventional 2-channel stereo, sounds are commonly panned to different stereo positions using a constant-power or sine/cosine amplitude panning law, whereby the left and right channel gains are given by $$L=\cos\theta' \tag{8a}$$

$$R=\sin\theta', \tag{8b}$$

where $\theta'$ is a predetermined angle that determines the stereo position. For example, for $\theta'=0°$, sounds are positioned at the left of the stereo stage, for $\theta'=45°$, Sounds are positioned at the centre, and for $\theta'=90°$, sounds are positioned at the right of the stereo stage. Intermediate values of $\theta'$ give intermediate stereo positions, and values of $\theta'$ between −45° and 0° or between 90° and 135° give "antiphase" stereo positions for which the polarity of the two speaker feeds is opposite.

An ideal pseudostereo device for 2-speaker stereo according to the invention provides frequency-dependent left and right channel gains using left and right filter means 11L and 11R as shown in FIG. 1*a* of the form $$L=ke^{i\phi'}\cos\theta' \tag{9a}$$

$$R=ke^{i\phi'}\sin\theta', \tag{9b}$$

where k is a frequency-independent gain factor, $\phi'$ is a phase shift that is frequency-dependent, and $\theta'$ is a stereo position angle that is also frequency dependent and preferably swings to-and-fro between two extreme values $\theta_-$ and $\theta_+$ determining the spread-image width and mean position.

Providing that the filters with the frequency responses of equations (9a) and (9b) are causal, then any known method of designing filters to achieve these left and right complex frequency responses may be used, such as transversal FIR (finite impulse response) filters with tap gains equal to the values of the impulse responses of the two filters obtained by taking the inverse Fourier transform of the complex frequency responses of equs. (9).

While such pairs of filters 11L and 11R as shown in FIG. 1*a* will be according to the invention, in general, filters arrived at by such a design procedure will be computationally complex if implemented by digital signal processing (DSP) means, and in general will be of unacceptable complexity if implemented using analogue electronic means.

Filters having complex frequency responses of the form of equs. (9) will in general be free of phasiness, since $$P=\tan(45°-\theta') \tag{10a}$$

$$Q=0, \tag{10b}$$

and the phase angle $\phi'$ produces a phase distortion of the input signal but does not affect stereo positioning. In the case of phase linear filters, $e^{i\phi'}$ will be a pure time delay, and in other cases, it is desirable to choose the phase distortion $e^{i\phi'}$ to be such that the phase distortion does not have undesirable perceptual effects.

The monophonic pseudostereo method of FIG. 1*a* and equs. (9) can be extended to a stereo-in/stereo-out algorithm of the kind shown in FIG. 4*b*. In this algorithm, a stereo input 21 signal L and R is passed into an MS matrix 35 having the effect $$M=2^{-1/2}(L+R) \tag{11a}$$

$$D=2^{-1/2}(L-R) \tag{11b}$$

to create respective so-called "sum" and "difference" signals M and D. The M signal is fed into a pseudostereo means 18M and the difference signal D into a second identical pseudostereo means 18D, and the stereo outputs of the two pseudostereo means are mixed by an adder 24L that mixes the left output of the sum pseudostereo means 18M and the right output of the difference pseudostereo means 18D to form a left output signal L' and by a subtractor means 24R that subtracts the left output of the difference pseudostereo means 18D from the right output of the sum pseudostereo means 18M to form the right output signal R' of the stereo output signal 22.

Figure 4B:
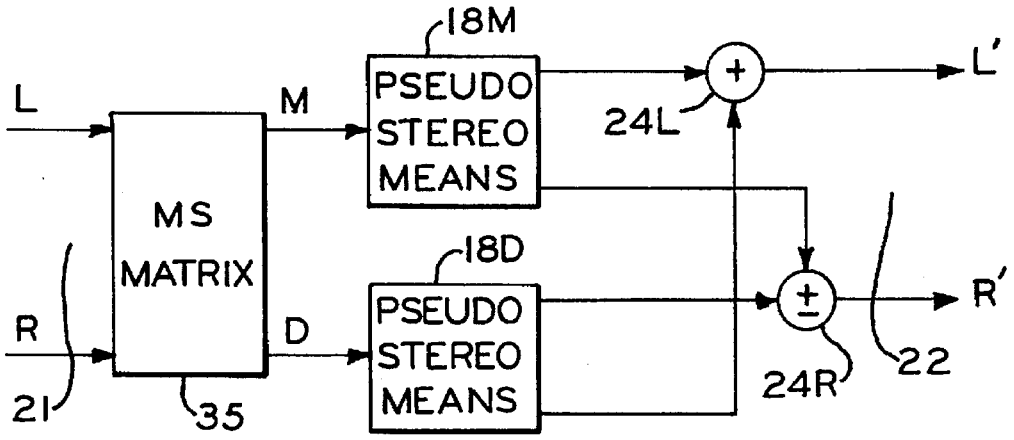

It is easily seen that for a central mono input L=R, the network of FIG. 4*b* has identical effect to FIG. 1*a* fed with the same mono input signal S, since the D signal is then zero, and also that if the pseudostereo means is "trivial" (i.e. feeds both its outputs with $2^{-1/2}$S for input S), then L'=L and R'=R. Moreover, it can be shown that if a rotation matrix $R_\theta$ is applied to the input signals L, R, then the effect is precisely the same as if instead the same rotation matrix $R_\theta$ were to be applied to the output signals L', R' of FIG. 4*b*, i.e. FIG. 4*b* commutes with rotation matrices. Thus for a panned stereo input signal S, FIG. 4*b* has the same effect as FIG. 4*a* for a rotation matrix $R_\theta$ centering the output on the stereo position of the input signal S.

Figure 4C:
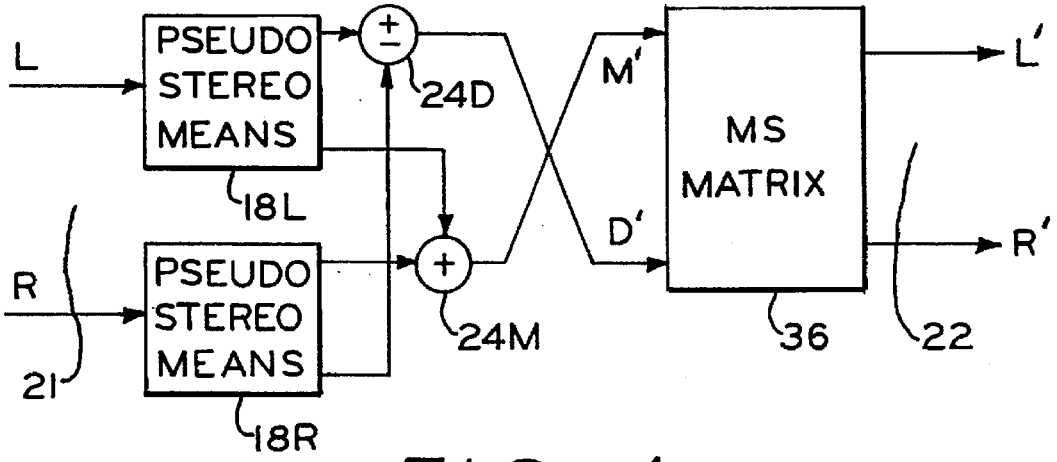

FIG. 4*c* shows an alternative means having identical effect to FIG. 4*b* on stereo input signals L, R using two identical pseudostereo means 18L and 18R on the left and right input signals L and R, where the addition and subtraction means 24M and 24R now precede an MS matrix 36 rather than follow it. Other rearrangements of the pseudostereo and matrixing means achieving similar results to FIGS. 4*b* or 4*c* will be evident to one skilled in the art, and these two examples are by way of example only.

The methods of FIGS. 4*b* or 4*c* allow any known linear pseudostereo method having mono input and 2-channel stereo output to be applied to a 2-channel stereo input L, R, so as to spread each input source signal S at each stereo position separately about its own original stereo position. FIGS. 1 to 3 show some possible pseudostereo methods that can be used within the methods of FIGS. 4*b* and 4*c*. However, in general, this doubles the complexity of the resulting algorithm, by for example doubling the number of all-pass networks $e^{i\phi}$ used, due to the fact that two pseudostereo means (18M and 18D or 18L and 18R) are used.

The stereo-in/stereo-out version of the ideal pseudostereo method described in connection with equs. (9) above will produce stereo output signals L', R' from stereo input signal L, R by the matrix equations:

$$L'=ke^{i\phi'}[(\cos\theta')L-(\sin\theta')R] \tag{12a}$$

$$R'=ke^{i\phi'}[(\sin\theta')L+(\cos\theta')R], \tag{12b}$$

which will be seen to be a frequency-dependent rotation by an angle $\theta'$, apart from a fixed gain k and overall phase shift $e^{i\phi'}$ that is frequency-dependent, as discussed earlier. A direct implementation, for example using FIR filter means in FIGS. 1, 4*b* and 4*c*, would require the use of four FIR filters whose typical length may be of the order of ten or twenty milliseconds, and so would be very complicated.

However, there is a relatively simple implementation of an ideal stereo-in/stereo-out pseudostereo means of the kind described in equations (12) which is based on the use of just two all-pass networks with complex gain $e^{i\phi}$. Although the resulting implementation is relatively simple, further theory is required to understand the implementation.

Figure 5A:
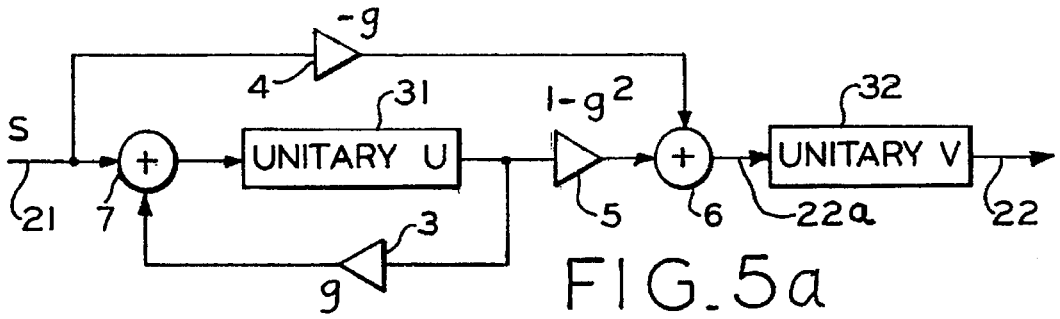
FIGS. 5*a* to 5*c* show various equivalent methods of creating a new all-pass or unitary network by feedback and feedforward around a simpler all-pass or unitary network U.
Figure 5B:
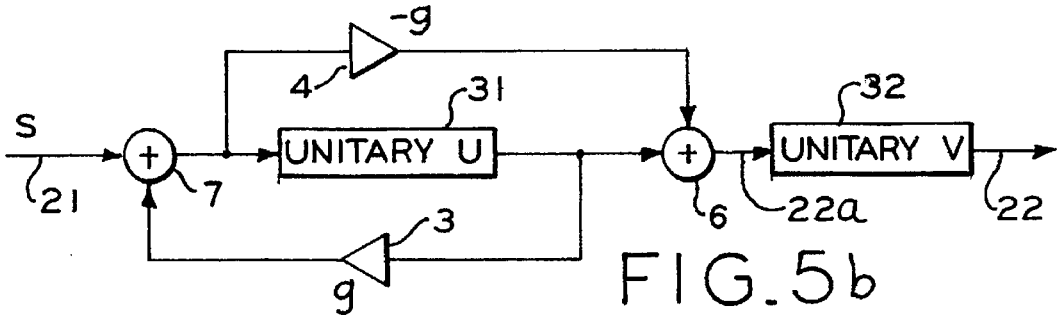
Figure 5C:
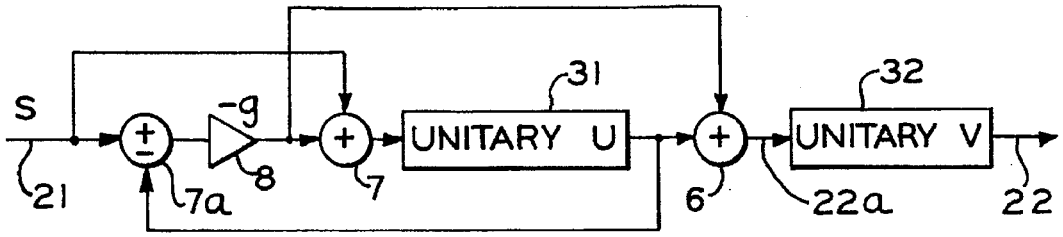

Recall that a linear network is said to be unitary if the total energy of its output signals equals the total energy of its input signals, and if the number of signal channels at its inputs and outputs are identical. A familiar example of a unitary network is an all-pass network with unity gain magnitude, e.g. one having a complex gain $e^{i\phi}$, and another example is an n×n rotation matrix; moreover, the result of cascading unitary networks is clearly also a unitary network. In FIGS. 5*a* to 5*c* are shown three networks that, for time-invarient unitary networks U, can be shown to have identical effect. All three networks accept an input signal S in input signal channel or channels 21, pass it via summing means 7 into a unitary network U 31 which is placed in a feedback loop with gain g 3 (implemented using a gain −g 8 in FIG. 5*c*). The output of the unitary network is combined using an adding means 6 with a feedforward signal that has been passed through a gain means 4 with gain −g to form an intermediate output signal 22*a*, which is then passed through a second unitary network V 32 to form an output signal 22.

In the network of FIG. 5*a*, the feedforward path is fed direct from the input 21, and the output of the unitary network U 31 is fed to the summing means 6 via a gain means 5 with gain $1-g^2$. It was shown in M. A. Gerzon "Unitary (Energy Preserving) Multichannel Networks with Feedback", Electronics Letters vol. 12 pp. 278–279 (1976 May 27) that provided that (i) g is a time-invarient gain of magnitude less than 1, and (ii) U is a time-invarient unitary network, then the network of FIG. 5*a* is also unitary. The signal paths illustrated may be n-channel for any integer n, provided that all gains and summing means are applied equally to all n channels.

In the monophonic case, it is easy to show that the networks shown in FIGS. 5*b* or 5*c* are equivalent to that in FIG. 5*a* for U and V all-pass networks with unity gain magnitude, and such equivalence carries over to the n-channel case when U is unitary time-invariant, using the methods of the cited 1976 Gerzon reference. The equivalence (i.e. identical overall effect on input signals) in the monophonic case is well known in the prior art on all-pass networks formed using feedback around delay lines, as is widely used in the design of all-pass artificial reverberation algorithms, and other similar equivalent networks are also known. For example, the gain 5 of $1-g^2$ after the feedback loop may alternatively be placed before it, or be split into two factors (e.g. 1−g and 1+g or $(1-g^2)^{1/2}$ and $(1-g^2)^{1/2}$) one of which is placed before the feedback loop and one after.

The network of FIG. 5*c* is especially simple in that it only uses one gain arranged via the extra subtraction means 7*a* to effectively place a gain 1−g before the unitary network and 1+g after it. The same topology as in FIG. 5*c* may also be used with alternative choices of addition and subtraction means 7*a*, 7, 6 and with the gain means 8 having gain −g or +g to achieve equivalent results. Many other equivalent networks to those of FIGS. 5*a* to 5*c* will be evident to those skilled in the art.

In the case that the signal paths are 2-channel stereo paths in FIGS. 5*a* to 5*c*, FIG. 6 shows a possible unitary network U 31 that can be used, comprising two identical all-pass networks 1L, 1R with complex gains $e^{i\phi}$ as used previously in the networks of FIGS. 2 and 3, followed by a 2×2 rotation matrix $R_\theta$ 9. This network 31 is clearly unitary since all component networks 1L, 1R, 9 preserve signal energy. In FIGS. 5*a* to 5*c*, one may also make the second unitary network 32 an inverse rotation matrix $R_{-\theta}$.

Figure 6:
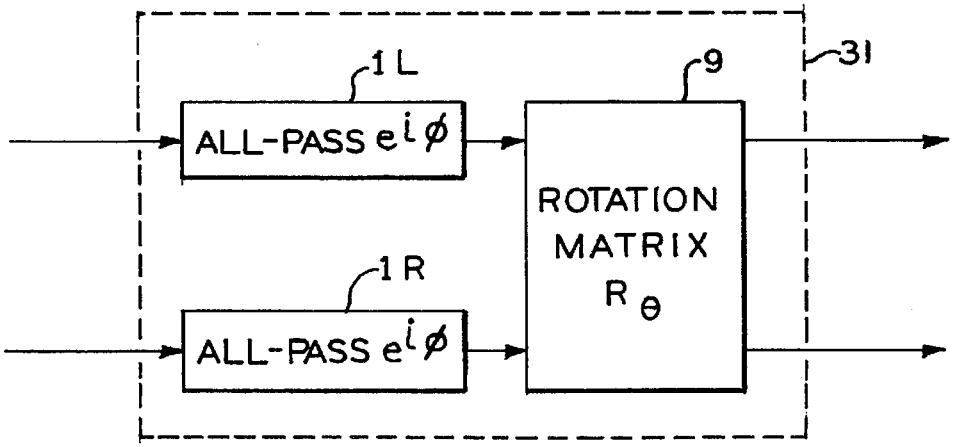
FIG. 6 shows a possible unitary network U for use in FIGS. 5*a* to 5*c* comprising parallel all-pass networks in series with a rotation matrix.
Figure 7A:
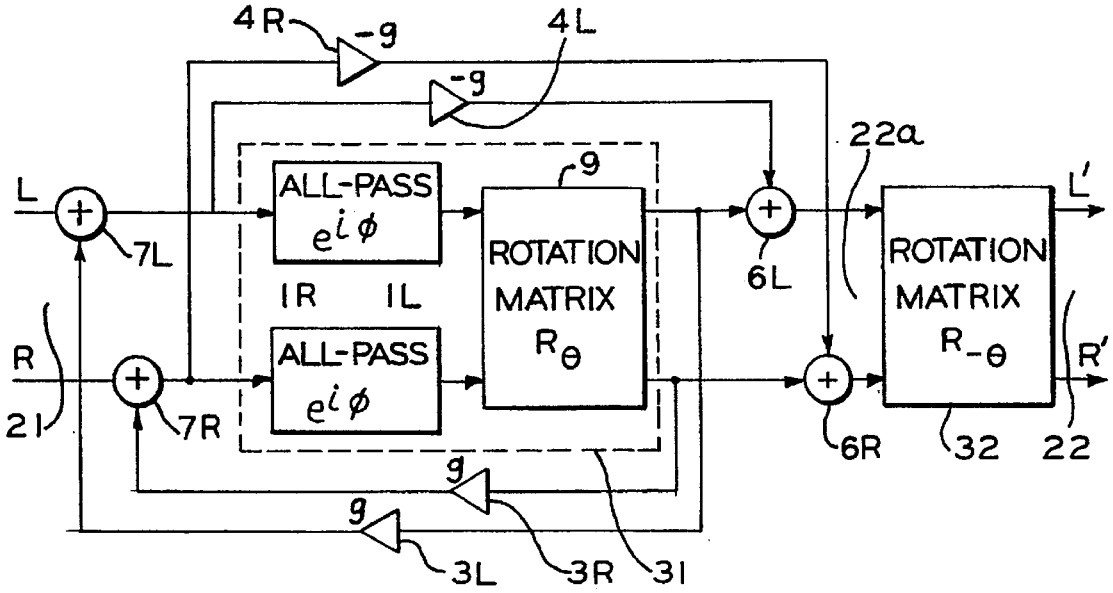
FIGS. 7*a* and 7*b* show equivalent alternative 2-channel pseudostereo algorithms based on FIGS. 5*b* and 6.

The result of substituting FIG. 6 for U and $R_{-\theta}$ for V in FIG. 5*b* is shown in FIG. 7*a*. In this figure, the respective summing means 6 and 7 and gain means 3 and 4 become one means for each of the two channels (denoted respectively by 6L, 6R, 7L, 7R, 3L, 3R, 4L and 4R where the letters L and R indicate respective left and right channels).

The network of FIG. 7 is, by the above-quoted results, a stereo-in/stereo-out unitary network, i.e. preserves the energy of all input signals, and so has a flat total energy response with frequency. Moreover, by regarding the pairs of real signals in the signal paths as being a monophonic complex-valued signal (formed by adding $J=\sqrt{-1}$ times the right channel to the left channel signal), the rotation matrix $R_\theta$ is seen simply to be multiplication by $e^{J\theta}$, so that the whole network of FIG. 7*a* is simply a complex-valued all-pass network, with unity gain magnitude, and so has the effect of multiplying input signals by a gain $e^{i\phi'}e^{J\theta'}$ where $\phi'$ is a frequency-dependent phase shift and $\theta'$ is a frequency-dependent rotation angle. Care should be taken not to confuse i, which represents 90° phase shifts, with J, which is the 90° rotation matrix $$J=\begin{pmatrix}0 & -1\\ 1 & 0\end{pmatrix}, \tag{13}$$

even though both have a square equal to −1.

Figure 7B:
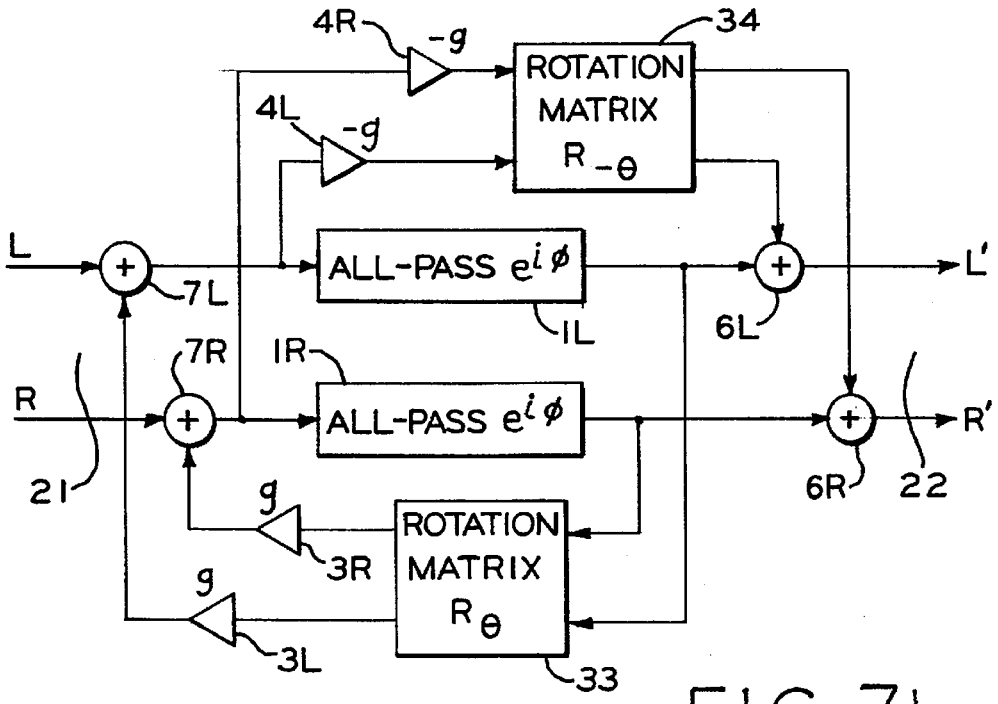

As a result, it will be seen that the network of FIG. 7*a* has the ideal behaviour described in connection with equs. (12) for a stereo-in/stereo-out pseudostereo network, causing a frequency-dependent rotation without any effect on amplitude gain. Moreover, this is done using only two identical all-pass networks $e^{i\phi}$, i.e. the same number as for the mono-in/stereo-out network of FIG. 3. FIG. 7*b* shows a rearrangement of the network of FIG. 7*a*, in which the rotation matrix $R_\theta$ 33 has been placed in the feedback path and the inverse rotation matrix $R_{-\theta}$ 34 has been placed in the feedforward path. This rearrangement does not affect the performance of the network, but reveals a direct signal path from the input signals 21 to the output signals 22 via the all-pass networks 1L and 1R, with the pseudostereo effect being achieved entirely by virtue of the feedback and feedforward path passing through the gains 3L, 3R, 4L, 4R of ±g. If g is small, it is to be expected that the resulting pseudostereo spread around the original stereo positions at the input will be correspondingly small.

While the invention has been illustrated by the substitution of FIG. 6 and $R_{-\theta}$ into FIG. 5*b*, a similar substitution into FIGS. 5*a* or 5*c* or other equivalent networks will achieve identical results, and in those cases too, the rotation matrices can be rearranged to lie within the feedback and feedforward paths only. Which implementation is used is entirely a matter of design convenience.

While a pseudostereo effect is obtained for any values of the rotation angle θ other than 0° or 180°, it is found that generally the effect is preferred if θ takes the values +90° or −90°, since this results in a to-and-fro rotation of the stereo image about its mean input position that is symmetrical to the left and right. Since such ±90° rotations have matrix forms $$\begin{pmatrix}0 & -1\\ 1 & 0\end{pmatrix} \text{ or } \begin{pmatrix}0 & 1\\ -1 & 0\end{pmatrix}, \tag{14}$$

they are simply equivalent to swapping the two stereo channels and inverting the phase of one. From now on, we consider only the cases θ=±90°, although other values of θ can be used with the invention.

Figure 8A:
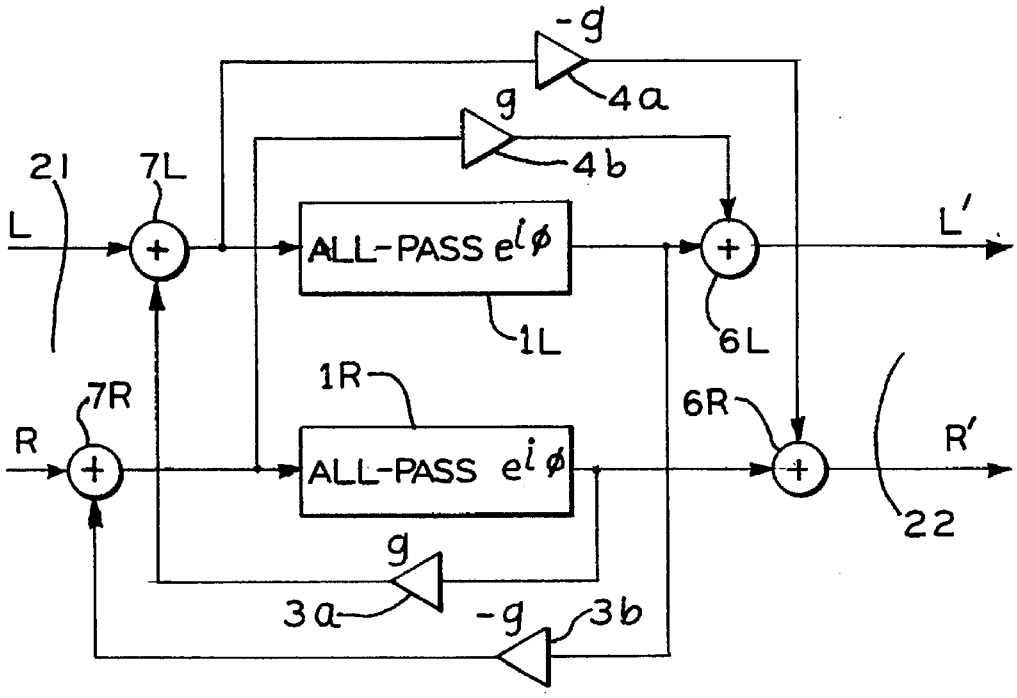
FIGS. 8*a* and 8*b* show equivalent 2-channel stereo pseudostereo algorithms based respectively on FIGS. 5*b* and 5*c*, and on FIGS. 6 and 7.
Figure 8B:
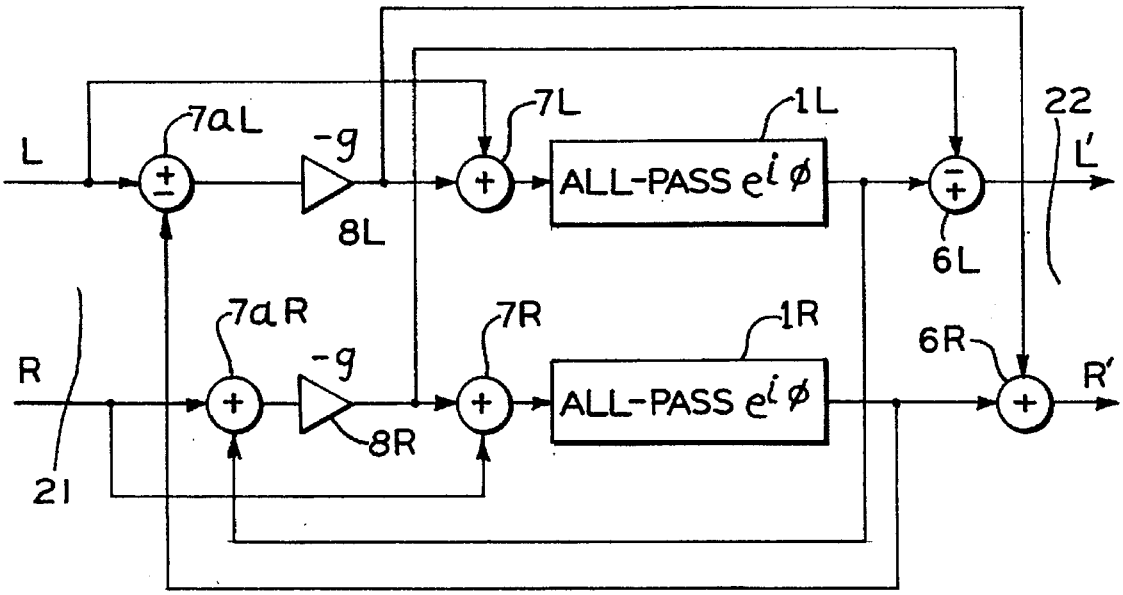

FIG. 8*a* shows the case with a 90° rotation matrix based on FIG. 5*b* and FIGS. 7*a* or 7*b*, where both the feedforward and feedback paths are now fed from the "other" channel, and the gain of one of the paths is inverted in polarity so as to incorporate the effect of a 90° rotation matrix. Thus one each of the feedforward gains 4*a*, 4*b* has values +g and −g as shown in FIG. 8*a*, and the same is true for the feedback gains 3*a*, 3*b*. FIG. 8*b* shows a form of the network based on FIG. 5*c* equivalent in results to the network of FIG. 8*a*. Other equivalent networks, for example based on FIG. 5*a*, are also possible, and all involve swapping the channels in the feeds of the feedback and feedforward paths and an inverted polarity in one of the two channels in each path.

Since the networks of FIGS. 8*a* and 8*b* are, apart from an overall phase factor $e^{i\phi'}$, frequency-dependent rotation matrices, their performance for any input stereo position can be predicted from their performance for a source signal S fed to the central stereo position, since any other position θ" arises by rotation from the centre by an angle θ"−45°.

A calculation based on the network of FIG. 8*a* shows that for L=R=1 gains, $$\begin{pmatrix}L'\\ R'\end{pmatrix}=\left(I-ge^{i\phi}\begin{pmatrix}0 & 1\\ -1 & 0\end{pmatrix}\right)^{-1}\left\{e^{i\phi}I+\begin{pmatrix}0 & g\\ -g & 0\end{pmatrix}\right\}\begin{pmatrix}1\\ 1\end{pmatrix}$$

$$=(1+g^2e^{2i\phi})^{-1}\begin{pmatrix}1 & ge^{i\phi}\\ -ge^{i\phi} & 1\end{pmatrix}\begin{pmatrix}e^{i\phi}+g\\ e^{i\phi}-g\end{pmatrix},$$

so that $$L'=[e^{i\phi}/(1+g^2e^{2i\phi})][1+2g\cos\phi-g^2] \tag{15a}$$

$$R'=[e^{i\phi}/(1+g^2e^{2i\phi})][1-2g\cos\phi-g^2] \tag{15b}$$

for input gains L=R=1 for a central source signal S. This gives a computed position and phasiness $$P=(2g/(1-g^2))\cos\phi=w\cos\phi \tag{16a}$$

$$Q=0, \tag{16b}$$

where the width parameter w is given in terms of the gain g by the equation $$w=2g/(1-g^2). \tag{17}$$

It will be seen that the position parameter P of this algorithm (16a) is identical to that of the Orban method (4a), but that the phasiness has been reduced to zero. It will be noted that as the all-pass phase shift $\phi$ rotates around the circle, that P moves symmetrically to the left and right thanks to equ. (16a).

The extreme values of the rotation angle of the input stereo position is, from equ. (16a), an angle $$\theta_{\pm}'=\pm\tan^{-1}w=\pm 2\tan^{-1}g \tag{18}$$

so that the angular width of the pseudostereo images (expressed in terms of the position parameter angle $\theta'$ of equs. (8)) is $$2\theta_{+}'=2\tan^{-1}w=4\tan^{-1}g. \tag{19}$$

For a value $\phi$ of the phase shift of the all-pass networks 1L, 1R in FIGS. 8*a* or 8*b*, the networks produce an overall rotation angle $$\theta'=\tan^{-1}(w\cos\phi)=\tan^{-1}((2g\cos\phi)/(1-g^2)), \tag{20}$$

and the overall phase response $\phi'$ through the network of FIG. 8*a* or 8*b* is given from equs. (15) by $$e^{i\phi'}=e^{i\phi}[(1+g^2e^{-2i\phi})/(1+g^2e^{+2i\phi})]^{1/2}, \tag{21}$$

which approximately equals the phase shift $e^{i\phi}$ of the all-pass networks when $g^2$ is small, as would be expected. It is noted that even if the all-pass networks $e^{i\phi}$ are causal, $e^{i\phi'}$ given by equ. (21) is generally not a causal all-pass response; this is because $e^{i\phi'}$ never occurs on its own as an isolated all-pass factor, but always accompanied by frequency-dependent gains as in equs. (15) that make the result causal.

If it is assumed that the phase shift $\phi$ of the all-pass networks varies rapidly with frequency and spends a roughly equal time at all angles, then we may compute for a central mono input signal the ratio of the energy in the difference channel L'−R' to the energy in the sum channel L'+R' at the output, which is a measure of the degree of correlation or coherence of the two stereo channels. It can be shown from equs. (15) that $$(1/2\pi)\int|1/2L'-R'|^2d\phi=2g^2/(1+g^2) \tag{22a}$$

$$(1/2\pi)\int|1/2L'+R'|^2d\phi=(1-g^2)/(1+g^2), \tag{22b}$$

where the limits of integration are 0 and $2\pi$, and $\phi$ is in radians. Thus the ratio of difference to sum energies is $$2g^2/(1-g^2)=(1+w^2)^{1/2}-1, \tag{23}$$

which equals 1 (i.e. lack of correlation between channels) for $g=3^{-1/2}=0.577$, equals 0.414 for the case $g=2^{-1/2}-1=0.4142$ (which corresponds to a pseudostereo image occupying the full width of the stereo stage from left to right, since w=1), and 0.155 for w=tan30°.

The above formulas allow the degree of spread or the degree of correlation of stereo channels to be selected in the pseudostereo algorithms of FIGS. 8*a* or 8*b* by an appropriate choice of the feedback/feedforward gain g. Alteration of the degree of spread or angular dispersion with these algorithms is particularly easy, since only two gains (in FIG. 8*b*) or 4 gains (in FIG. 8*a*) need be altered to obtain a changed spread, while still guaranteeing the desired features of the invention, namely:

(i) flat total-energy response for all inputs (ii) zero phasiness for all inputs, and (iii) a spread effect for all input stereo positions.

The simplicity of adjusting just two or four gains of these implementations may be contrasted with the complexity of having to recompute all FIR tap gains of four long FIR filters in a direct FIR realisation having the same features (i) to (iii).

The actual central positions of the output images may be altered by using a rotation matrix at the output as in FIG. 4*a*, or by using a rotation matrix, balance control or width control (or any combination thereof) on the input stereo signal before its passage through the algorithms of FIGS. 8*a* or 8*b*.

Stereo-in/stereo-out algorithms for pseudostereo such as those shown in FIGS. 7 or 8 may, of course, also be used as mono-in/stereo-out algorithms by feeding a mono input to both input channels L and R.

All-pass psychoacoustics

Although the invention works reasonably well for a wide choice of all-pass networks $e^{i\phi}$ in the above, some choices are found to be preferable to others. The preferred choices may best be understood from the psychoacoustics of auditory perception.

The ears approximate an analyser of signal energy in both time and frequency. For continuous or steady-state sounds, the ears have a coarse time resolution but a fine frequency resolution, but for transient sounds, the time resolution is improved (to the order of 2 milliseconds), at the expense of a coarser frequency resolution. The theories of sound localisation that use the above calculated quantities P for position and Q for phasiness are appropriate for steady-state or continuous sounds, but transients are localised according to the well-known Haas or precedence effect whereby the first sound arrival disproportionately influences the perceived direction, dominating if the time delay of subsequent arrivals is between about 3 and 50 ms, and if the later arrivals do not exceed the first arrival in level by more than typically 6 or 8 dB.

If it is desired to minimise conflicting localisation cues for transient and continuous components of sounds, then relative time delays between different parallel signal paths in a pseudostereo network should thus be minimised, preferably being less than 2 ms, and ideally being less than 1 ms or ½ ms, and ideally being as small as possible, say less than 0.1 ms. A second reason for why relative delays should be short is that if one is simulating a sound source of a given physical size, ideally no time delays longer than the time it takes for a sound to travel between the different parts of a source of that size should occur, for they would not occur in actual sound sources of that size.

The above considerations mean in particular that it is preferred that the all-pass networks $e^{i\phi}$ in the methods described in connection with FIGS. 2, 3, 7 and 8 should include no long delay component, and that any delay component should ideally be as short as possible, preferably under 2 or 1 or ½ or 0.1 ms. Although in the cited Schroeder reference, the use of time delay networks was proposed for the Orban method shown in FIG. 2, we have found that such time delay networks for the all-pass network 1 in FIG. 2 do not give a natural sense of size with low subjective colouration unless the time delay is very short—typically 0.9 ms.

The use of time delays for the all-pass networks in FIGS. 2, 3, 7 and 8 gives a linear spacing of those frequencies for which the phase shift $\phi$ attains any predetermined angular value, so that the to-and-fro sweeps of the pseudostereo image are linearly spaced in frequency. This results in an audible colouration having a distinctive pitch, due to comb filter effects, and also means that whereas the successive frequencies of a given stereo position are spaced rather coarsely in octave terms at low frequencies, they are spaced very closely together in octave terms at high frequencies.

Perceptually, it is preferred that the all-pass networks $e^{i\phi}$ in FIGS. 2, 3, 7 and 8 be such that the frequencies for which the phase shift $\phi$ attains any predetermined angular value be spaced approximately uniformly on a logarithmic or psychoacoustic Bark scale, so that a similar number of sweeps to-and-fro occurs within each of the ear's critical bands. For the best sense of spread without specific localisation of individual frequencies, the number of sweeps to-and-fro per Bark should ideally be one or more. (At middle audio frequencies, 1 Bark equals approximately one fifth of an octave). However, it is found in practice that a smaller number of sweeps to-and-fro of the pseudostereo image per octave still can work well subjectively, with relatively little image splitting or perceived colouration.

In practice, the desired behaviour of the all-pass network $e^{i\phi}$ is easily achieved by cascading a number N of first order all-pass pole-zeros, where N may typically be between 4 and 50. We term the number N of first order pole-zeros used to implement the all-pass network $e^{i\phi}$ the "order" of a pseudostereo algorithm such as those of FIGS. 2, 3, 7 or 8.

The precise frequencies of the pole-zeros of the all-pass networks are generally found to be uncritical, but for the best sense of spread, an order N above 15 is preferred, with lower orders such as 6 tending to cause audible splitting of the positions of different frequency components of the pseudostereo image. Typically, the pole-zero frequencies may be uniformly spaced on a logarithmic or Bark frequency scale, although in digital filter implementations, it is sometimes preferred to space the higher frequency pole-zero frequencies somewhat closer together on a Bark scale than the lower frequency pole-zeros.

A useful economy in implementation in digital or discrete-time implementations is now described. In a digital or discrete time system, denote the unit time delay by one sample by $z^{-1}$. Then an all-pass network that is a cascade of N first-order poles has the form $$\prod_{k=1}^{N} \{(-h_k + z^{-1})/(1 - h_k z^{-1})\}, \tag{24}$$

where $-1<h_k<1$ for all k. In recursive feedback implementations such as those of FIGS. 7 or 8, at least one of the N factors of equ. (24) must have $h_k=0$, so that there is a one sample time delay $z^{-1}$ in the feedback loop. Apart from this computationally trivial $z^{-1}$ delay factor, the implementation of the digital or discrete-time filter of equ. (24) requires the implementation of N−1 first order filters or ½(N−1) biquad sections. For the fairly large values of N that are psychoacoustically desirable (say between 15 and 50), this can result in quite a computationally complex algorithm to implement the pseudostereo methods shown in FIGS. 7 or 8.

However, the complexity can be reduced somewhat by noting that if the pole-zeros with $h_k \neq 0$ are present in pairs with $h_k' = -h_k$, then $$[(-h_k+z^{-1})/(1-h_k z^{-1})][(h_k+z^{-1})/(1+h_k z^{-1})]=(-h_k^2+z^{-2})/(1-h_k^2 z-2), \tag{25}$$

so that the pair of pole-zeros is no more difficult to implement than a single pole-zero, except that $z^{-2}$ is used in implementing the all-pass factor rather than $z^{-1}$. Thus an all-pass network of order 2N+1 can be implemented as $$z^{-1} \prod_{k=1}^{N} \{(-h_k^2 + z^{-2})/(1 - h_k^2 z^{-2})\}, \tag{26}$$

with the same computational complexity as an N-pole all-pass network. Such an implementation cannot space all pole-zero frequencies uniformly on a logarithmic scale, since the higher pole frequencies are equal to the maximum Nyquist-Shannon frequency of the discrete-time representation of signals minus the corresponding lower pole frequency. However, the lower pole-zero frequencies can be spaced approximately uniformly on a logarithmic or Bark frequency scale.

If the order N of the all-pass network becomes large, the signal passing through the pseudostereo networks of FIGS. 3, 7 or 8 is subjected to large amounts of phase distortion. While the phase distortion produced by a first-order all-pass network is found to be quite benign in quality, the use of a very large number of such networks in cascade may start having increasingly deleterious effects. Also, the large group delays caused by a high order N may cause the Haas effect on transient signal localisation to start causing "splitting" between the localisation of continuous and transient sounds.

An important benefit of pseudostereo reproduction of signals that has not been evident in the prior art, but which becomes evident with low-phasiness pseudostereo, is that many details of reproduced sounds become more easily audible, with lower listening fatigue. This is because the spreading of sound information in direction results in directional unmasking of information that is monophonically masked.

According to conventional monophonic masking theory, quiet frequency components of a signal can be masked in the ear/brain system by the presence of louder sounds in nearby frequency bands. This auditory masking effect is quite well understood, being the basis for example for the design of low bit-rate perceptual coding systems for audio. However, such masking is reduced if the low-level frequency component is reproduced from a direction different from that of the high-level frequency component. The resulting audibility of what monophonically were masked components is called directional unmasking, and can result in between 6 dB and 25 dB less masking.

Thus, provided that the pseudostereo effect is substantially free of undesirable phasiness, image splitting or other contradictory or unnatural cues, it is found that the reproduction reveals more detail in sounds and has lower listening fatigue and a more natural quality than monophonic reproduction. However, if too many poles are used in the all-pass networks, individual frequency components can be spread across the whole of the spread image stage, thereby preventing directional unmasking from being as effective as when a smaller number of pole-zeros is used.

Variations on the Invention

The basic invention as described has many variant forms. For example, it may be desired to make the width parameter w variable with frequency. It is found that the sense of spaciousness of a pseudostereo effect is generally increased if the width of the dispersed sound stage is greater at low frequencies below say 600 Hz or 1 kHz than at higher frequencies.

Figure 9A:
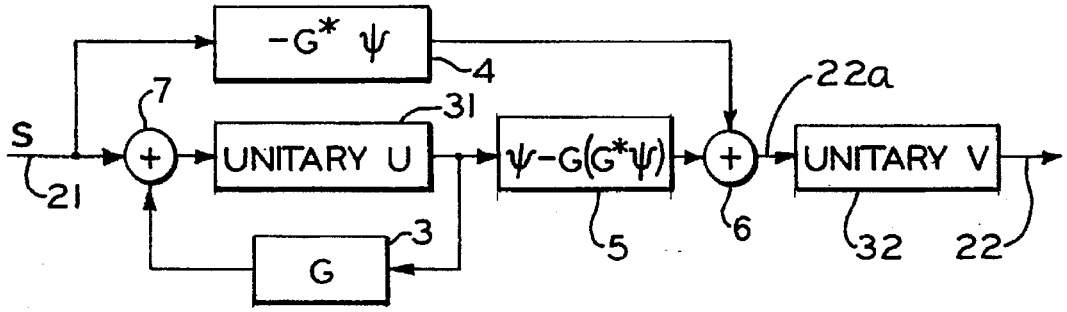
FIGS. 9*a* and 9*b* show two equivalent methods of creating a new unitary network by frequency-dependent feedback with a filter G and feedforward around a simpler unitary network U.
Figure 9B:
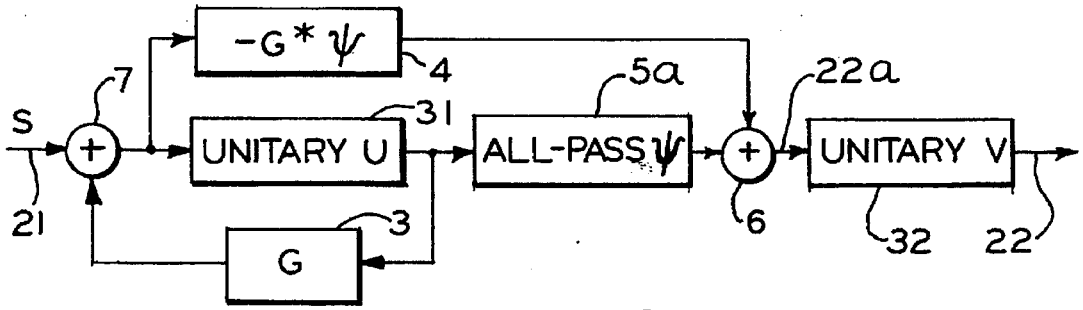

FIGS. 9*a* and 9*b* show modifications of the unitary algorithms shown in FIGS. 5*a* and 5*b* respectively in the case when the feedback gain g is changed to a feedback filter G with gain magnitude less than 1 at all frequencies. Any such causal filter G may be used in the feedback loop, but in the cited 1976 Gerzon reference, it was shown that the feedforward filter for unitary results is of the form G*, i.e.

that filter whose complex frequency response is the complex conjugate of G, i.e. that filter whose impulse response is the time-reverse of that of G. G* is not causal, so that in order to render it causal, one needs to multiply it by a unity gain magnitude all-pass filter ψ such that G*ψ is causal.

The networks of FIGS. 9*a* and 9*b* for time-invarient unitary U and V are equivalent unitary networks whenever G is a causal filter of gain magnitude less than 1 at all frequencies and where the unity-gain all-pass ψ is such that the filter G*ψ is also causal, as is shown in the cited 1976 Gerzon reference. While any suitable "causalisation" all-pass filter ψ can be chosen, the following "minimal" choice is generally preferred.

In the analogue signal processing case, suppose that G has a rational complex frequency response as a function of iω, where ω is angular frequency, i.e. is a ratio of two polynomials in iω with no common divisor. Then the minimal "causalisation" all-pass is that ψ whose complex frequency response is the complex conjugate of the denominator of G divided by the denominator of G.

In the digital or discrete-time signal processing case, suppose that the response of G is a rational function of the unit-sample delay $z^{-1}$, i.e. a ratio of two polynomials in $z^{-1}$ with no common divisor. Then in this case, the minimal "causalisation" all-pass is that ψ whose impulse response as a function of $z^{-1}$ equals $$z^{-M}f(z)/f(z^{-1}),$$

where $f(z^{-1})$ is the polynomial denominator of G and M is the order of G.

By analogy with the earlier cases discussed in connection with FIGS. 5*a* or 5*b*, the FIGS. 9*a* or 9*b* yield unitary results if the feedback filter 3 is G as discussed above, the feedforward filter is –G*ψ, and if the filter connecting the output of the unitary U means 31 to the output summing means 6 is a filter 5 equal to ψ–G(G*ψ) in FIG. 9*a* or an all-pass filter 5*a* equal to ψ in FIG. 9*b*. Note that in the case that G is a constant gain g (as in FIG. 5*b*) and that ψ is the minimal "causalisation" filter, then ψ=1, so that the all-pass filter 5*a* of FIG. 9*b* can then be omitted.

By way of example, G may be a first order shelf filter with gain $g_L$ at low frequencies and gain $g_H$ at high frequencies with a fixed linear denominator in iω or $z^{-1}$. Then a fixed all-pass ψ may be used in FIG. 9*b*, while the values of $g_L$ and $g_H$ may be independently varied so long as both have magnitude less than 1. By making U of the form shown in FIG. 6 and V a rotation matrix $R_{-\theta}$, as before, one thus has a zero-phasiness stereo-in/stereo-out pseudostereo device where the angular size of the swings to-and-fro are now frequency-dependent, thereby obtaining a degree of pseudostereo spread that is frequency-dependent, with low and high frequency spread independently adjustable.

Figure 10:
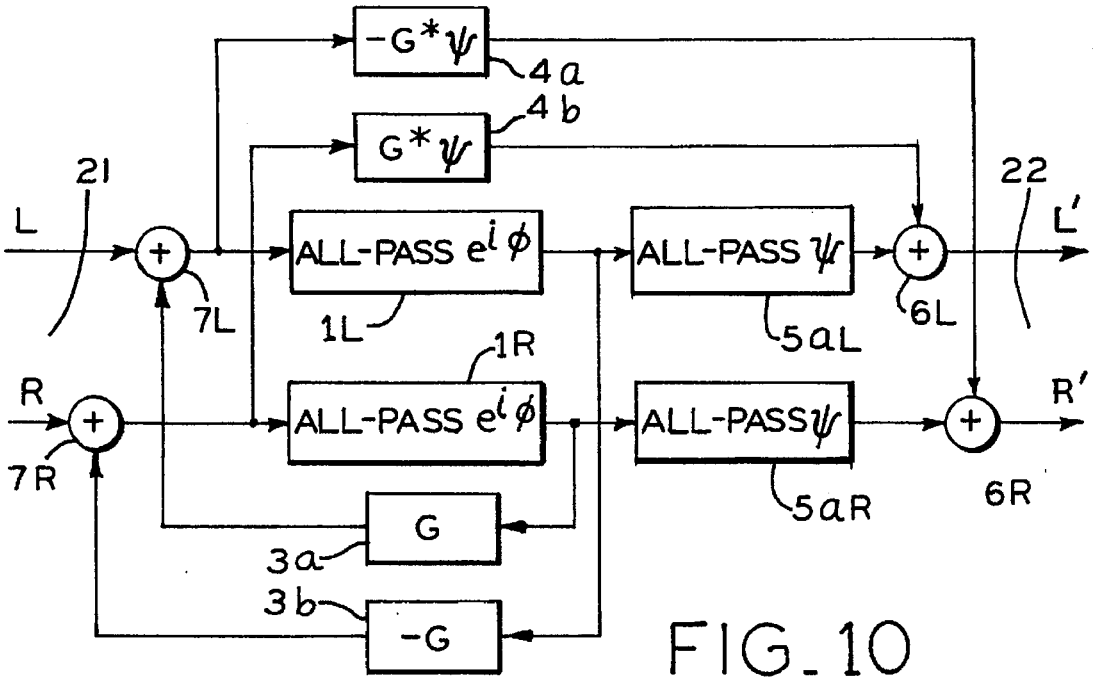
FIG. 10 shows a stereo-in/stereo-out pseudostereo algorithm with frequency-dependent angular spread width based on FIG. 9*b* and FIG. 6.

FIG. 10 shows an example of the invention analogous to FIG. 8*a*, but based on FIG. 9*b* with a filter G in the feedback loop, using a 90° rotation matrix $R_\theta$. In the realisation of FIG. 10, the filters 3*a* and 3*b* in the feedback loop around the all-passes $e^{i\Phi}$ are respectively G and –G, and the feedforward filters 4*a* and 4*b* are respectivey –G*ψ and G*ψ. The causalisation all-pass ψ is inserted 5*a*L and 5*a*R between the outputs of the respective all-pass $e^{i\Phi}$ means 1L and 1R and the respective output summing means 6L and 6R in the left and right signal paths.

The use of an additional causalisation all-pass ψ (5*a*L and 5*a*R) has the effect of subjecting signals passing through the network of FIG. 10 to an additional phase distortion ψ. However, in the case described above where G is a first order shelf filter with low frequency gain $g_L$ and high frequency gain $g_H$, formulas such as equations (17) to (20) and (23) may still be applied to determine the angular spread and ratio of difference to sum energy at low and high frequencies.

The use of a filter G in the feedback loop still retains the desirable properties of the invention, namely a flat total energy response, zero phasiness, and the implementation as a frequency-dependent rotation matrix. The effect of varying the gain of G with frequency is that the predetermined stage across which the output stereo position is swept to-and-fro now has a frequency-dependent width.

All stereo-in/stereo-out implementations discussed in connection with FIGS. 4, 6, 7, 8 and 10 commute with rotation matrices (i.e. the effect of a rotation by an angle θ at the input is to cause a rotation θ of the output), and the implementations discussed in connnection with FIGS. 5 to 10 are themselves frequency-dependent rotation matrices. Thus new stereo-in/stereo-out pseudo-stereo methods can be obtained by cascading more than one of the algorithms, or by following any mono-in (or stereo in)/stereo-out algorithm with any of the frequency-dependent stereo-in/stereo-out rotation algorithms so far described. This has the effect of causing a rotation angle at each frequency that is the sum of the separate rotation angles of the individual subalgorithms at each frequency.

In particular, if the number of sweeps to-and-fro of the rotation angle per octave is different for each of several cascaded algorithms, the sweeps to-and-fro of the cascaded algorithms are much more irregular, which may sometimes be desired. Also as g increases, the resonant 'Q' of the networks of FIGS. 8 or 10 can increase above 0.6, which can sometimes cause a subjective colouration of the processed sound. Such high 'Q' can be avoided by instead cascading two identical algorithms with a smaller value of g (and hence a smaller 'Q') to achieve a similar to-and-fro sweep of rotation angle.

It is also possible to cascade two stereo-in/stereo-out algorithms with very different characteristics. For example, one may position most frequencies in one direction, and only a predetermined band of frequencies at another direction, whereas the other may provide a rapid to-and-fro sweep across a small rotational angle stage in order to provide a further diffusion of images around the positions produced by the first algorithm.

A disadvantage of using cascaded stereo-in/stereo-out algorithms is that, although they have a flat total energy response and low phasiness, they subject signals passing through to additional phase distortion.

In digital or discrete-time implementations of the invention, the implementations so far discussed have the disadvantage that the feedback paths described in FIGS. 5, 7, 8, 9 and 10 can only be directly realised as recursive networks if there is a time delay of at least one sample duration within the feedback loop, which means either that the all-pass $e^{i\Phi}$ must incorporate a $z^{-1}$ factor or that G must in the case that G is a filter. In the case that the order of the network is large, this is generally no disadvantage, but especially in the case of low-order pseudostereo algorithms used cascaded with other algorithms, the use of such a $z^{-1}$ factor prevents the desired choice of pole-zero frequencies.

In cases where a $z^{-1}$ factor does not occur in $e^{i\Phi}$ or G, the feedback network can be rearranged to be of a recursive form, by computing the behaviour of the network as a function of the one-sample delay $z^{-1}$ and implementing this rational function of $z^{-1}$ as a recursive network by methods well-known to those skilled in the art. In general, this yields rather more complicated recursive networks than those illustrated so far.

By way of example, suppose that it is desired to implement the network of FIG. 8*a* in the case that the all-pass $e^{i\phi}$ is the first-order all-pass $$(-h+z^{-1})/(1-hz^{-1})=-h+(1-h^2)z^{-1}/(1-hz^{-1}) \tag{27}$$

for a predetermined h with $-1<h<1$, corresponding to a pole-zero frequency equal to $$F=[\tfrac{1}{2}-(2/\pi)\tan^{-1}h]F_{max}, \tag{28a}$$

where $F_{max}$ is the highest (Nyquist-Shannon) frequency, equal to half the sampling frequency, represented at the chosen sampling rate. Equivalently, h may be determined from the pole-zero frequency F by $$h=\tan[(\pi/4)-(\pi/2)(F/F_{max})], \tag{28b}$$

where in equs. (28*a*) and (28*b*), angles are in radians.

The performance of the network of FIGS. 8*a* or 8*b* can be shown to be given by $$\begin{pmatrix} L' \\ R' \end{pmatrix} = \left\{ I - ge^{i\phi}\begin{pmatrix} 0 & 1 \\ -1 & 0 \end{pmatrix} \right\}^{-1} \begin{pmatrix} e^{i\phi} & g \\ -g & e^{i\phi} \end{pmatrix} \times \begin{pmatrix} L \\ R \end{pmatrix}. \tag{29}$$

Substituting $$-h+z^{-1}f(z^{-1})(1-h^2) \tag{30}$$

for example as in equ. (27) with $f(z^{-1})=1/(1-hz^{-1})$, for $e^{i\phi}$ in the matrix equ. (29) yields:

$$\begin{pmatrix} L' \\ R' \end{pmatrix} = \frac{1}{1+(gh)^2}\begin{pmatrix} 1 & gh \\ -gh & 1 \end{pmatrix}\left\{ I - z^{-1}f(z^{-1})\frac{g(1-h^2)}{1+(gh)^2}\begin{pmatrix} -gh & 1 \\ -1 & gh \end{pmatrix} \right\}^{-1} \times \left\{ \begin{pmatrix} -h & g \\ -g & -h \end{pmatrix} + z^{-1}f(z^{-1})(1-h^2)I \right\}\begin{pmatrix} L \\ R \end{pmatrix}. \tag{31}$$

Figure 11:
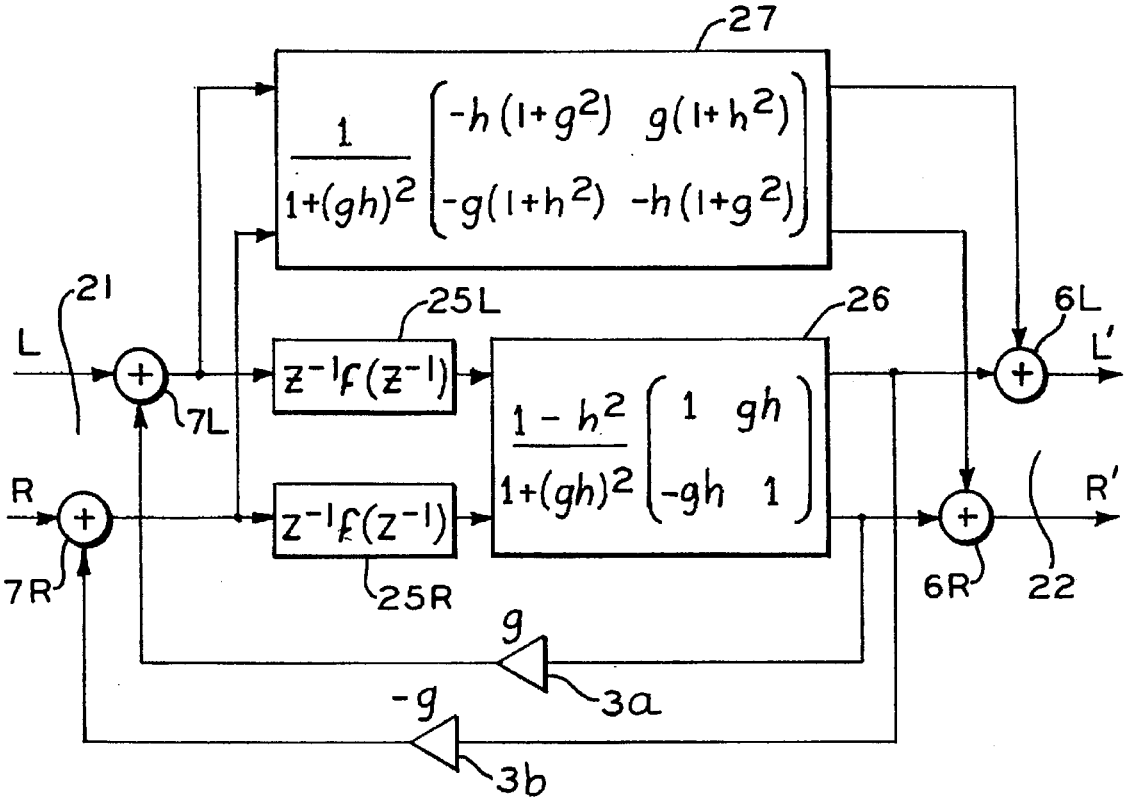
FIG. 11 shows a recursive modification of FIG. 8*a* when the all-pass of FIG. 8*a* has no time-delay factor.

Rearranging the network implementing equ. (31) yields the recursive network shown in FIG. 11, in which filters $z^{-1}f(z^{-1})$ 25L and 25R are followed by a matrix network 26, with feedback gains 3*a* and 3*b* respectively equal to g and −g (as in FIG. 8*a*), and the feedforward path contains a matrix 27. The topology of FIG. 11 is similar to that of FIG. 8*a*, except that the all-pass filters 1L and 1R are replaced by the filters 25L and 25R obtained by subtracting the constant term h from the all-passes so that they factor by $z^{-1}$, and in the presence of the two matrices 26 and 27 that incorporate the effect of the missing constant term. Many other alternative arrangements that recursively implement the feedback network of FIG. 8*a* recursively are also possible, as will be evident to those skilled in the art.

Feedback implementations of the invention so far described are based on the unitary feedback algorithms of FIGS. 5 or 9, which implement the networks $$V(-g+U)(I-gU)^{-1}=VU(I-gU^{-1})(I-gU)^{-1} \tag{32}$$

for FIGS. 5 and $$V\psi(-G^*+U)(I-G^*U)^{-1}=(V\psi U)(I-G^*U^{-1})(I-GU)^{-1} \tag{33}$$

for FIGS. 9, where VU is arranged to be all-pass in the realisations of the invention, by V incorporating a rotation matrix inverse to that in U in FIG. 6.

Figure 25:
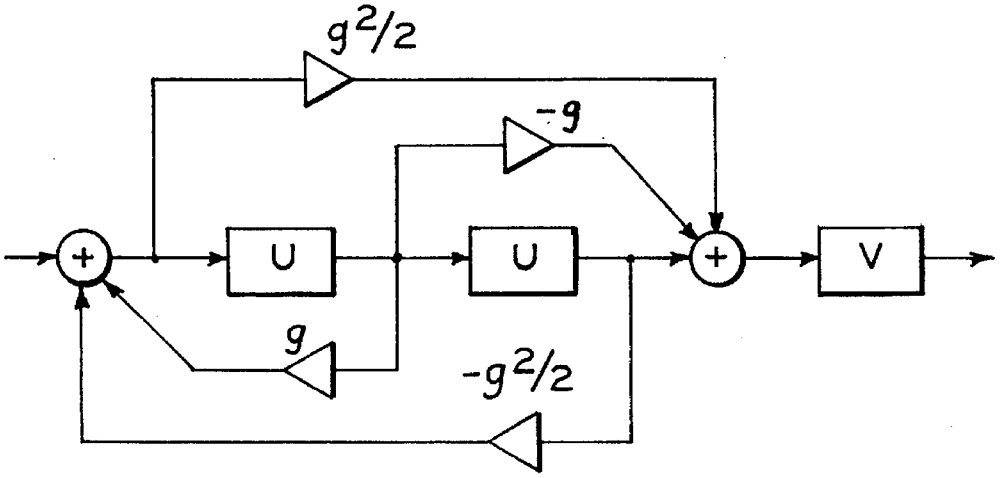
FIG. 25 shows an implementation of a unitary network using feedback around two copies of a unitary U.

However, it is also possible to use more complicated arrangements which are also unitary based on feedback around copies of unitary networks U. For example, one could implement a network $$V(\tfrac{1}{2}g^2I-gU+U^2)(I-gU+\tfrac{1}{2}g^2U^2)^{-1}=(VU^2)(I-gU^{-1}+\tfrac{1}{2}g^2U^{-2})(I-gU+\tfrac{1}{2}g^2U^2)^{-1} \tag{34}$$

which is unitary whenever U and V are by using the methods of the cited 1976 Gerzon reference, and where U is of the form shown in FIG. 6 and where V is the rotation matrix $R_{-2\theta}$, so that $VU^2$ is all-pass with phase response $e^{2i\phi}$. Such a network provides another stereo-in/stereo-out pseudostereo algorithm that has the form of a frequency dependent rotation matrix as in equs. (12). A network of the form of equ. (34) can be implemented as in FIG. 25 by feedback and feedforward around two copies of the unitary U followed by V. Although more complicated than the networks of FIG. 5, and involving twice the phase distortion, such a network has the advantage in some applications that its phase response component $e^{i\phi'}$ more accurately approximates to $e^{2i\phi}$ than in the case when separate networks of the form of equ. (32) are used.

Similarly, in the frequency-dependent feedback case, a feedback network based on two copies of U can be used of the form:

$$V(\tfrac{1}{2}\psi^2G^{*2}I-\psi^2G^*U+\psi^2U^2)(I-GU+\tfrac{1}{2}G^2U^2)^{-1}=(V\psi^2U^2)(I-G^*U^{-1}+\tfrac{1}{2}G^{*2}U^{-2})(I-GU+\tfrac{1}{2}G^2U^2)^{-1}, \tag{35}$$

which is also a unitary network implementing for the U of FIG. 6 and $V=R_{-2\theta}$ a frequency-dependent rotation matrix whose width of angular sweep is now frequency-independent.

More generally, for an N'th degree real polynomial p(x) with a constant term, a unitary U and V can yield a unitary network using N copies of U of the form $$V(U^Np(gU^{-1}))/p(gU) \tag{36}$$

for a real gain g, or a unitary network $$V(\psi^NU^Np(G^*U^{-1}))/p(GU) \tag{37}$$

for G a causal filter and ψ a causal all-pass network such that $G^*\psi$ is causal. If U is chosen to be as in FIG. 6 and V is of the form $R_{-N\theta}$, then this forms a frequency-dependent rotation matrix pseudostereo means according to the invention with width of sweep depending on the gain g or the gain of the filter G. In preferred implementations, the polynomial p(x) is the first N+1 terms of the power series expansion $$1-x+\tfrac{1}{2}x^2+\ldots\ldots+(1/N!)(-x)^N \tag{38}$$

of $e^{-x}$. In this case, the rotation angle θ' of the pseudostereo means (36) for θ=90° approximates to $\theta'=2g\cos\phi$ in radians and the overall phase distortion $e^{i\phi'}$ approximates to $e^{Ni\phi}$. One advantage of the choice (38) is that it allows large values of g to be implemented, and other advantages of this choice will become apparent in later descriptions of pseudostereo for azimuthal directional encoding systems, arising from the fact that the choice (38) means that to a high degree of approximation, the phase shift φ' through the network does not vary as g is varied, and the rotation angle θ' is roughly proportional to the value of g up to a maximum value of g that is increasingly large as N is increased.

The benefits of the choice (38) of p(x) can be understood using the functional calculus of normal matrices described in the cited 1976 Gerzon reference. The networks of equs. (36) or (37) approximate to an all-pass times $\exp(-gU^{-1})/\exp(-gU)=\exp(-g[U^*-U])$, where $U^*=U^{-1}$ is the Hermitian adjoint of the unitary matrix U. But if U is of the form shown in FIG. 6, $U=e^{i\phi}J$, where J is as in equ. (13), so that $\exp(-g[U^*-U])=\exp(2gJ\cos\phi)=\cos(2g\cos\phi)I+\sin(2g\cos\phi)J$, using the fact that J is a square root of −I. Thus the network $\exp(-gU^{-1})/\exp(-gU)$ to which equs. (35) or (36) approximate when p(x) is given by equ. (37) approximate to an all-pass $e^{Ni\phi}$ or $\psi^N e^{Ni\phi}$ times a frequency-dependent rotation matrix $R_{\theta'}$ with the rotation angle $$\theta'=2g\cos\theta. \tag{38b}$$

The approximation is good to order $g^N$, since p(gU) equals exp(−gU) to this order.

Other Directional Systems

Examples of the invention described so far have been for 2-channel 2-speaker stereo, but the invention may be implemented for many other systems of encoding direction within a plurality of audio signal channels, i.e. for "stereo" in its broadest sense.

The invention may be applied to any form of directional sound encoding system in which rotation matrices are applicable, and to directional encoding systems which may be derived from such "rotation matrix" systems by a further matrix encoding stage. Such applications of the invention are now described by way of example.

Figure 12:
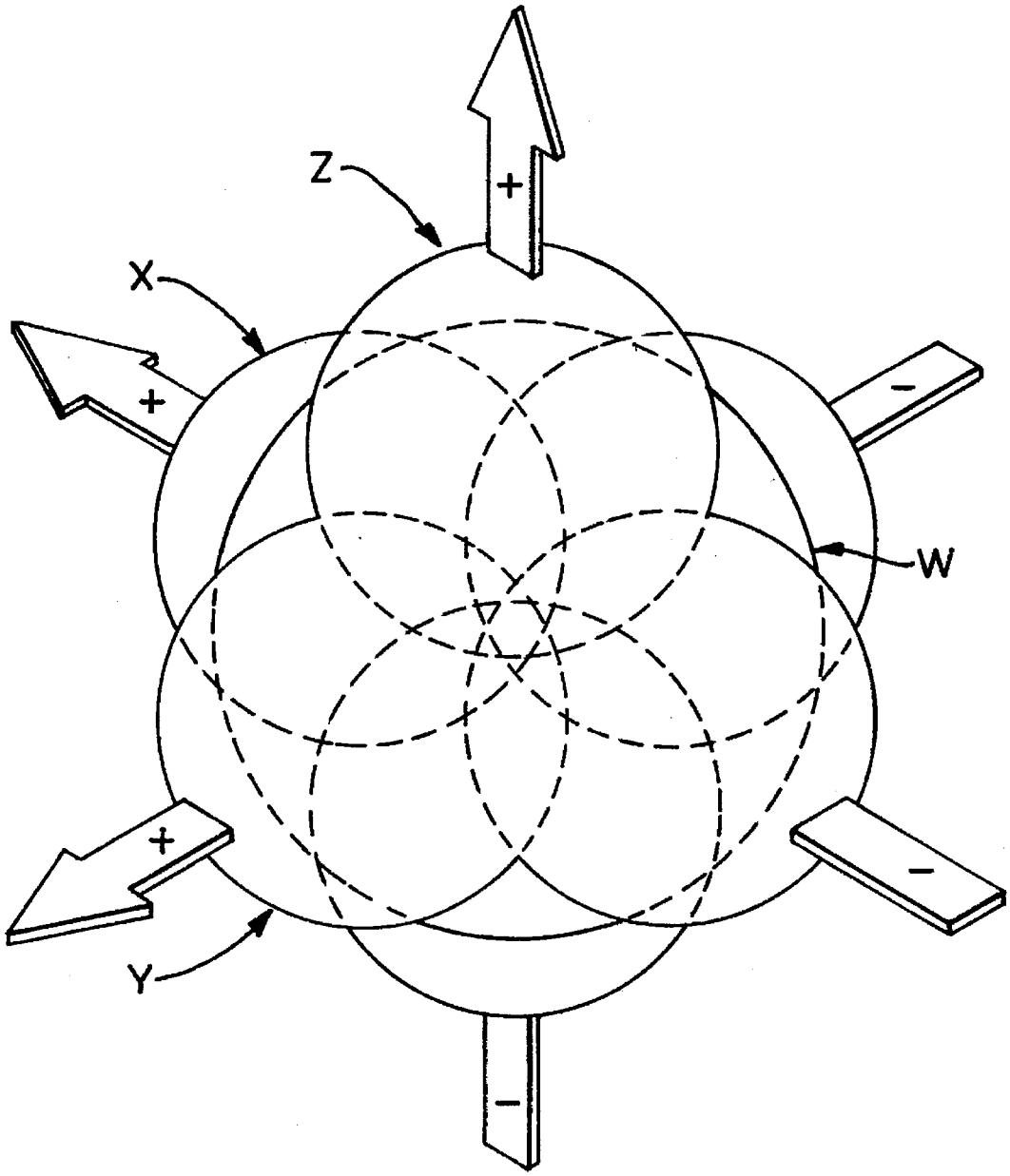
FIG. 12 shows the directional gain patterns for B-format directional encoding.

Rotation matrices occur naturally in many known directional encoding systems. The B-format encoding system, described in the cited 1985 Gerzon reference, encodes sounds from a direction with direction cosines (x,y,z) with respect to a forward-facing x-axis, a leftward-facing y-axis and an upward-facing z-axis into signals W, X, Y and Z with respective gains 1, $2^{1/2}x$, $2^{1/2}y$, and $2^{1/2}z$, as illustrated in the polar diagrams shown in FIG. 12. In the case of horizontal-only sound directions, only the W, X and Y signals are used.

Rotation of the horizontal stage anticlockwise by an angle θ' is effected by the rotation matrix $R'_{\theta'}$ given by $$\begin{pmatrix} W' \\ X' \\ Y' \\ Z' \end{pmatrix} = \begin{pmatrix} 1 & 0 & 0 & 0 \\ 0 & \cos\theta' & -\sin\theta' & 0 \\ 0 & \sin\theta' & \cos\theta' & 0 \\ 0 & 0 & 0 & 1 \end{pmatrix} \begin{pmatrix} W \\ X \\ Y \\ Z \end{pmatrix} \tag{39}$$

and a B-format pseudostereo effect with low phasiness implements a frequency-dependent matrix $$e^{i\phi'}R'_{\theta'}. \tag{40}$$

Figure 13:
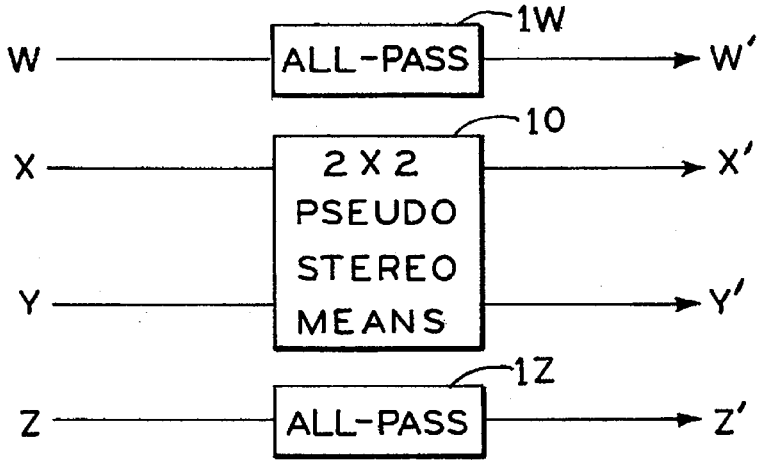
FIG. 13 shows a B-format in/B-format out pseudostereo means based on 2-channel stereo pseudostereo means.

This can be approximated as shown in FIG. 13 by using a 2-channel pseudostereo means 10 implementing a frequency-dependent 2×2 rotation $$e^{i\phi'}R_{\theta'} \tag{41}$$

such as already described in connection with FIGS. 4 to 10, which processes the X and Y signals, and passing the W and (where present) Z signals through respective all-pass means 1W and 1Z whose all-pass response $e^{i\phi''}$ approximately equals the all-pass response $e^{i\phi'}$ in equ. (41) of the 2-channel pseudostereo means 10.

In practice, provided that g or the gain magnitude of G is not too large, the all-pass means 1W and (where present) 1Z may be the same as the all-pass means $e^{i\phi}$ when the pseudostereo means 10 is equivalent to those of FIGS. 8*a* or 8*b*, or may be the same as the combined all-pass means $$\psi e^{i\phi} \tag{42}$$

when the 2-channel pseudostereomeans 10 in FIG. 13 is implemented by an algorithm equivalent to that of FIG. 10. The approximation involved in thus using $e^{i\phi}$ or $\psi e^{i\phi}$ for the phase-matching means 1W and 1Z for the W and Z signals instead of $e^{i\phi'}$ causes a small phase difference between the W, Z signal paths and the X,Y signal paths in FIG. 13, but according to equ. (21), this phase error does not exceed the bounds $$\pm\tan^{-1}(g^2) \tag{43}$$

where g is the feedback gain amplitude. Even for a 90° angular spread of the pseudostereo image, corresponding to $g=2^{1/2}-1=0.4142$, this phase error (43) is less than 10°, so that any resulting phasiness effects are typically small, and in any case are zero for 3 positions within the to-and-fro spread stage corresponding to $\phi=0°$, ±90° and 180° in equ. (21).

If the phase error between the W, Z signal paths and the X,Y signal paths is still too large, then a 2-channel pseudostereo algorithm 10 for the X and Y signal paths in FIG. 13 may be used based on the unitary networks of equs. (34) to (38) involving 2 or more copies of U, since for a given predetermined g or G, these have a phase shift $e^{i\phi'}$ that more accurately tracks the phase of $e^{Ni\phi}$, where N is the number of copies of the U of FIG. 6 used. In this case, the all-pass phase-matching networks 1W and 1Z used in the W and Z signal paths will be of the form $e^{Ni\phi}$, typically implemented as a cascade of N copies of the all-pass network $e^{i\phi}$.

Figure 14:
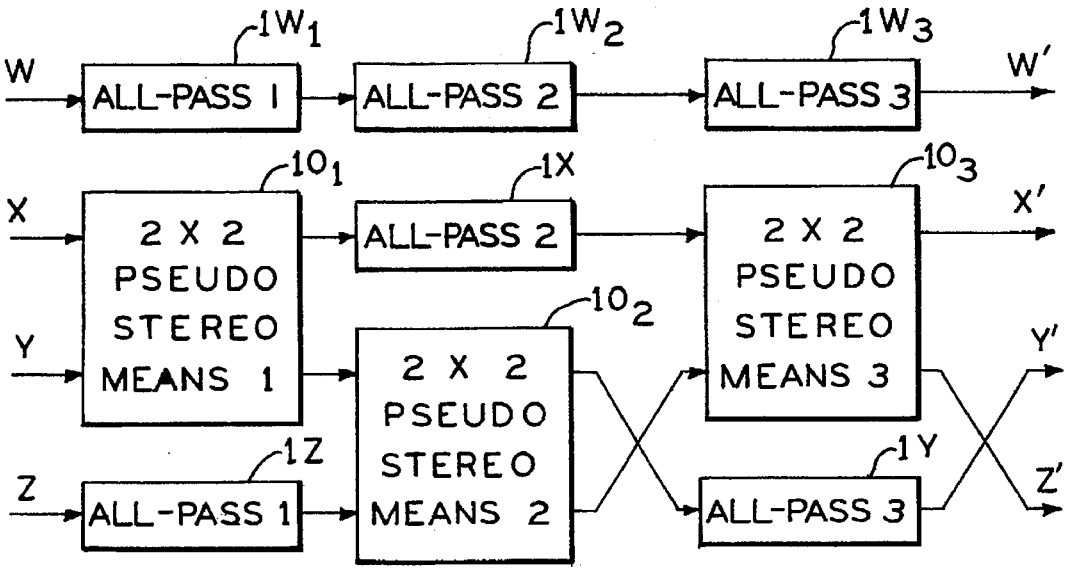
FIG. 14 shows the use of cascaded pseudostereo means in different planes to achieve full-sphere B-format pseudostereo with spread in a solid angle.

For with-height full-sphere B-format signals W, X, Y, Z, the pseudostereo method described above only produces horizontal image dispersion or spread. Spread or dispersion within a solid angle may be obtained by cascading 2, 3 or more such algorithms, with each algorithm based on a different all-pass $e^{i\phi}$ and implementing the frequency-dependent rotation within different planes in 3-dimensional space, such as the x,y plane (as described above), the y,z plane and the z,x plane, for example as illustrated in FIG. 14, where the 3 algorithms are based on 3 respective all-passes $\exp(i\phi_1)$ $\exp(i\phi_2)$ and $\exp(i\phi_3)$, with corresponding 2-channel pseudostereo algorithms $\mathbf{10}_1$, $\mathbf{10}_2$ and $\mathbf{10}_3$ handling respectively X and Y, Y and Z, and Z and X, and with the W signal passing through the cascade of 3 all-pass phase-matching means $\mathbf{1W}_1$, $\mathbf{1W}_2$, $\mathbf{1W}_3$ and each of the X, Y, Z signal paths passing through a similar all-pass phase-matching means as shown in FIG. 14. It is not necessary that the plane of rotations used be orthogonal to one of the x,y,z axes, and other planes may be used.

The invention may also be used with horizontal azimuthal directional sound encoding systems in which sounds from an azimuth θ (measured anticlockwise from due front) are encoded into 2M+1 channels with respective gains $$W_0=1,\ W_{kC}=2^{1/2}\cos(k\theta),\ W_{kS}=2^{1/2}\sin(k\theta), \tag{44}$$

for k=1 to M. The M=1 case has already been considered with the three horizontal B format signals $W=W_0$, $X=W_{1C}$, $Y=W_{1S}$. Such "azimuthal M'th harmonic" encoding systems as in equs. (44) may be given a pseudostereo effect by subjecting the 2M+1 signals to a frequency-dependent rotation matrix $$e^{i\phi'}R''_{\theta'} \tag{45}$$

approximating to the equations:

$$W_0'=e^{i\phi'}W_0 \tag{45a}$$

$$W_{kC}'=e^{i\phi'}[W_{kC}\cos k\theta'-W_{kS}\sin k\theta'] \tag{45kC}$$

$$W_{kS}'=e^{i\phi'}[W_{kC}\sin k\theta'+W_{kS}\cos k\theta'] \tag{45kS}$$

for k=1, . . . , M, which has the effect of increasing the encoded azimuth angle θ to θ+θ'.

Figure 15:
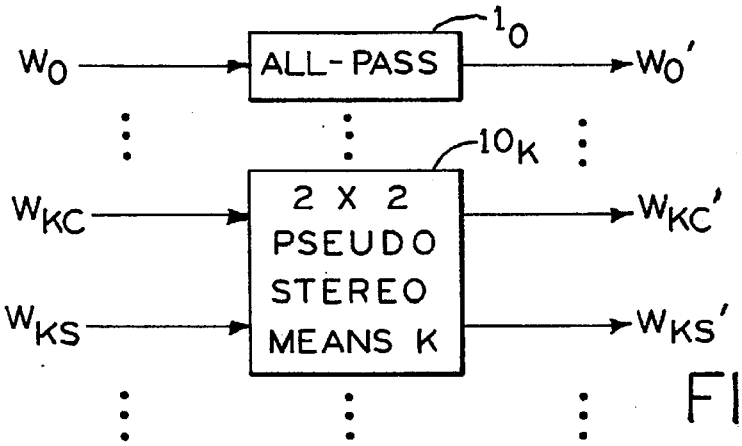
FIG. 15 shows pseudostereo means for M'th harmonic azimuthal encoding systems based on parallel 2-channel pseudostereo means.

Equs. (45) may be approximated with relatively low phasiness as shown in FIG. 15 by subjecting $W_0$ to a phase-matching all-pass $\mathbf{1}_0$ and the pairs $W_{kC}$, $W_{kS}$ of signals for each k=1, . . . , M to a 2-channel pseudostereo algorithm $\mathbf{10}_k$ as described earlier, where the algorithms for all k are similar, based on the same all-passes $e^{i\phi}$ in the same topology, and (where relevent) the same causalisation all-pass $\psi$, except that the gains $g_k$ or filter $G_k$ used is such that at each frequency the algorithm $\mathbf{10}_k$ for the k'th azimuthal harmonic signals $W_{kC}$ and $W_{kS}$ rotates by an angle approximately k times that of the first harmonic pseudostereo algorithm $\mathbf{10}_1$. This may be approximately achieved by putting $$g_k \cong k g_1, \text{ or} \tag{46a}$$

$$G_k \cong k G_1 \tag{46b}$$

provided that $g_1$ or the gain magnitude of $G_1$ is not too large.

If 2-channel pseudostereo algorithms $\mathbf{10}_k$ used for the azimuthal harmonic pairs of signals are as in FIGS. 8 or 10, and if the phase-matching all-pass is $e^{i\phi}$ or $\psi e^{i\phi}$, then there are phase discrepancies between the azimuthal harmonics of maximum magnitude $$\tan^{-1}(g_M^2) \tag{47}$$

from equ. (21), and the rotation angle of the k'th azimuthal harmonics is $$k[2k^{-1}\tan^{-1}(g_k \cos\phi)] \tag{47b}$$

which only approximates k times the first harmonic rotation angle (as required by equs. (45) in the case that $g_M$ is not too large.

A better approximation is obtained if 2-channel pseudostereo algorithms $\mathbf{10}_k$ based on the algorithms using 2 or more copies of the unitary U of FIG. 6 described in connection with equs. (34) to (38) are used. For N=2 or more, these algorithms have a phase response $e^{i\phi'}$ that much more accurately matches $e^{iN\phi}$ or $\psi^N e^{iN\phi}$ as $g_k$ or $G_k$ respectively is varied, and if equs. (46) hold for all k=1, . . . , M, then the rotation angle of the k'th harmonic much more accurately approximates to k times the rotation angle of the first harmonics than in the N=1 case. In this case, the phase-matching all-pass filter $\mathbf{1}_0$ of FIG. 15 is the cascade of N copies of the all-pass $e^{i\phi}$ (or $\psi e^{i\phi}$) used in the U of FIG. 6 in the pseudostereo algorithms $\mathbf{10}_k$. The larger the N used in equ. (38) for the algorithms, the better the approximation for a given maximum choice of $g_M$ or $G_M$.

The invention may also be applied to the class of azimuthal encoding systems termed UMX described in the cited Cooper and Shiga reference. For integer M, the 2M+1-channel UMX encoding system encodes sounds into the channels with respective complex gains $$E_k = e^{ik\theta} \tag{48}$$

for azimuth θ and k=−M, −M+1, . . . . M−1, M. The 2M-channel system uses the same encoding equations, but for k between −M+1 and M.

Figure 16:
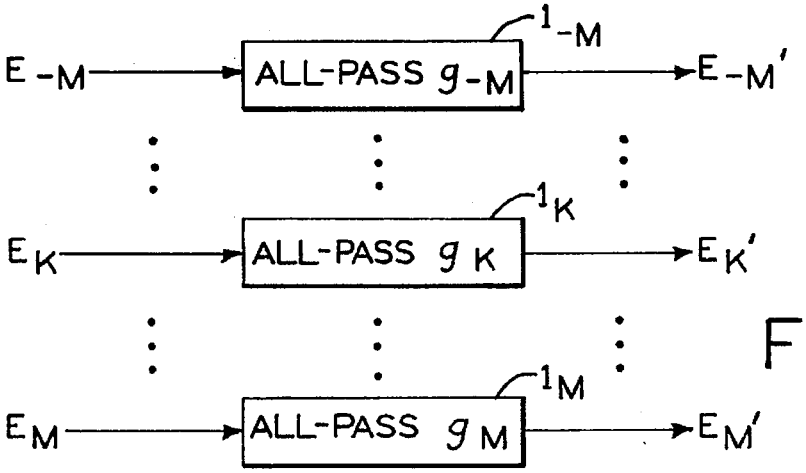
FIG. 16 shows pseudostereo means for UMX azimuthal encoding systems.

While the 2M+1—channel UMX system contains the same information as the M'th harmonic azimuthal encoding systems described previously, in the sense that the two can be converted into one another by a matrix means $$W_{kC} = 2^{-1/2}(E_k + E_{-k}) \tag{49a}$$

$$W_{kS} = 2^{-1/2} i(E_{-k} - E_k), \tag{49b}$$

it has a particularly simple implementation of pseudostereo as a frequency-dependent rotation means. For UMX encoded signals, such a means subjects the channel signals $E_k$ to a frequency-dependent phase shift approximating to $$e^{i\phi'} e^{ik\theta'} \tag{50}$$

for all k. Thus in the UMX case, the pseudostereo is achieved as shown in FIG. 16 by subjecting each channel to an all-pass network $\mathbf{1}_k$. These all-pass networks $\mathbf{1}_k$ may be of the forms shown in FIGS. 5 or 9 with a feedback gain $g_k$ or feedback filter $G_k$, where U is now simply a predetermined all-pass filter $e^{i\phi}$ and V is omitted for 2M+1-channel UMX, one may put for all k $$g_k \cong k g_1, \text{ or} \tag{51a}$$

$$G_k \cong k G_1, \tag{51b}$$

and for 2M-channel UMX one may put $$g_k \cong (k-\tfrac{1}{2}) g, \text{ or} \tag{51c}$$

$$G_k \cong (k-\tfrac{1}{2}) G, \tag{51d}$$

where g is a predetermined gain or G a predetermined filter. Providing that $g_M$ or $G_M$ thus determined is not too large (say with gain magnitudes less than say 0.3), then the deviations of relative phase between the channels from the ideal formula (50) are not very large.

As before, such deviations from the ideal formula can be reduced by using all-pass networks $\mathbf{1}_k$ satisfying equs. (51) but based now on equs. (34) to (38) with U made equal to the all-pass $e^{i\phi}$ and V omitted.

Contrary to what might be expected, the pseudostereo means just described for 2M+1—channel UMX and for M'th harmonic azimuthal encoding systems do not achieve equivalent results, but differ by 90° in the to-and-fro positioning within the spread stage. More precisely, the frequency-independent feedback case for the M'th azimuthal harmonic systems produces a rotation angle approximately equal to $$2g \cos\phi \tag{52a}$$

in radians, whereas the UMX systems have a rotation angle in radians approximating $$2g \sin\phi. \tag{52b}$$

Pseudostereo means for one of these two systems may be converted into pseudostereo means for the other by preceding and following the pseudostereo means with conversion matrices between the systems such as those of equs. (49) and their inverses.

There are numerous other systems to which similar methods can be applied to achieve frequency-dependent rotation matices for a low-phasiness pseudostereo effect, such as full-sphere directional encoding systems based on spherical harmonics of order up to M or on spin spherical harmonics, as described in the cited 1973 Gerzon reference. Full details for all these cases would be extremely lengthy, but the broad methods are similar to those given above. The features of the general case may be summarised as follows.

The invention may be applied to any directional encoding system in which there is a group representation of the group of rotations in 2 or 3 dimensions by matrix transformations. Such group representations are discussed mathematically in I. M. Gelfand, R. A. Minlos and Z. Ya Shapiro, "Representations of the Rotation and Lorentz Groups and their Applications", The Macmillan Company, New York, 1963.

In such encoding systems, a pseudostereo effect on the encoded signal channels may be achieved by using frequency-dependent linear matrix means to achieve a frequency-dependent matrixing $$e^{i\phi'}M_{R'}, \tag{53}$$

where $M_{R'}$, is the matrix representing a rotation R' in the rotation group, and where the phase angle $\phi'$ is a function of frequency and the rotation R' is a function of frequency within a predetermined range of rotations within the rotation group in 2 or 3 dimensions. Such frequency-dependent means satisfying equ. (53) may be achieved by combining all-pass and unitary means as previously described in parallel and series operation, ensuring that all parallel paths have substantially identical phase distortion.

Figure 17:
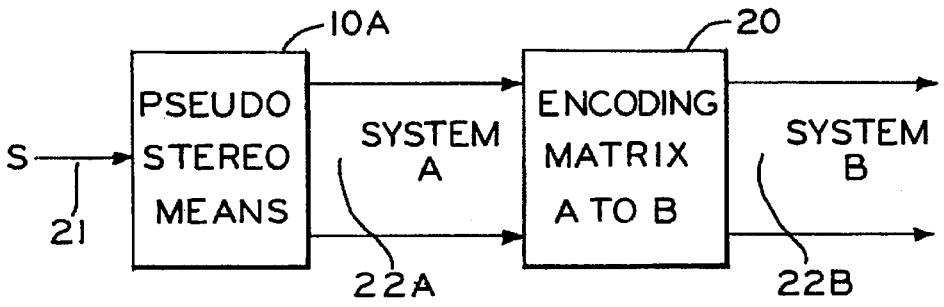
FIG. 17 shows pseudostereo means for a directional encoding system B based on pseudostereo means for a system A followed by an encoding or conversion matrix means.

The invention is not only applicable to encoding systems in which there is a group representation of the rotation group in 2 or 3 dimensions, but may be applied to achieve a pseudostereo effect in other cases. One such other case is when a known pseudostereo means $\mathbf{10}_A$ encodes a pseudostereo effect into a first directional encoding system A, as shown in FIG. 17, and a known matrix encoding scheme 20 converts signals from system A to a second directional encoding system B with substantially uniform energy gain. Then the effect of following the pseudostereo method $\mathbf{10}_A$ according to the invention by a matrix encoding means 20 converting system A to system B is another pseudostereo means 30 according to the invention. For example, the means 10A may be a known pseudostereo scheme for B-format encoding, such as described above, and the encoding matrix 20 may be the known matrix for producing signals according to the UMX or UHJ encoding systems using 2 or 3 channels, as described in the cited Cooper and Shiga reference and the cited 1985 Gerzon reference.

In another example according to FIG. 17, the known pseudostereo means may be one producing conventional 2-channel stereo signals as previously described, and the encoding matrix may be a UHJ transcoder for converting these signals into 2-channel UHJ, such as has been commercially available from the company Audio+Design.

In some cases, the encoding matrix 20 may be itself be frequency-dependent in nature. By way of example, suppose that the pseudostereo means 10A produces signals for M'th harmonic azimuthal encoding systems as described above. The transfer functions, as a function of azimuthal direction, of the left and right ear signals of a dummy head may be measured (or computed from a mathematical model of the head such as a solid sphere), and expressed as a sum of azimuthal harmonics of direction angle by means of Fourier series at each frequency. Such binaurally-encoded signals can be derived from signals for M'th harmonic azimuthal encoding by means of an encoding matrix 20 that is frequency-dependent that at each frequency adds up the azimuthal harmonic components with gain coefficients $a_k$, $b_k$ that are frequency-dependent forming a left and right binaural signal $$B_L=a_0W_0+a_1W_{1C}+b_1W_{1S}+\ldots+a_MW_{MC}+b_MW_{MC} \tag{54a}$$

$$B_R=a_0W_0+a_1W_{1C}-b_1W_{1S}+\ldots+a_MW_{MC}-b_MW_{MC}, \tag{54b}$$

where the coefficients $a_k$, $b_k$ are those determined by the Fourier analysis of encoding gain as a function of azimuthal direction described above.

Such a binaural encoding matrix 20 deriving binaural signals from M'th harmonic azimuthally encoded signals will only give accurate results at those frequencies for which the gain coefficients of azimuthal harmonics greater than M are negligibly small. Above such frequencies, the coefficients $a_k$ and $b_k$ must be chosen empirically for a reasonable subjective effect, for example to simulate desired left and right directional microphone characteristics.

A transaural encoding scheme aimed at producing via loudspeakers the correct binaural signals at the ears of a listener may be produced from the above binaural signals by an additional binaural-to-transaural conversion matrix stage, such as is described in D. H. Cooper and J. L. Bauck "Prospects for Transaural Recording", Journal of the Audio Engineering Society, vo. 37 no. 1/2 pp. 3 to (1989 January/February). Alternatively the conversion from azimuthal harmonic to transaural encoding can be done by a single combined matrix means.

Instead of encoding from horizontal-only azimuthally encoded signals, binaural or transaural signals can also be similarly encoded by matrix means 20 from pseudostereo signals encoded for an M'th order spherical harmonic encoding system for full-sphere directionality by means of frequency-dependent mixing coefficients for left and right signals based on the spherical harmonic series expansion of the transfer functions of left and right binaural or transaural signals as a function of direction in 3-dimensional space.

It is not necessary to implement the invention for directional encoding systems not having rotational symmetry by means of the method of FIG. 17. Alternatively, a pseudostereo effect for an arbitrary directional encoding system can be achieved directly by taking a source signals S and using a plurality of filter means, such as is shown in the 2-channel case in FIG. 1*a*, arranged such that for a predetermined overall phase response $e^{i\phi'}$ (which may be a function of direction) and a predetermined frequency dependent choice of directions P' within a predetermined sound stage P", the signal S is fed into the k'th channel of the M encoding channels with a gain $$e^{i\phi'}g_k(P') \tag{55}$$

where the directional encoding at that frequency for that position P' encodes signals into the k'th channel with gain $g_k(P')$. For example, with binaural or transaural encoding, the gains $g_L(P')$ and $g_R(P')$ for the respective left and right channels for each frequency and each direction P' in space may be determined by measurements on a dummy head or a theoretical model thereof by the methods of the cited Cooper and Bauck reference.

As before, it is preferred that the predetermined directions P' vary with frequency across a predetermined stage P" in a manner that the sweeps to and fro across the stage P" are more nearly uniform on a logarithmic than on a linear frequency scale, typically using between 3 and 30 or so to-and-fro sweeps within the audio band. It is also desirable to avoid significant pre-echo or post-echo components in such binaural or transaural pseudostereo algorithms involving discrete time delays exceeding 0.1 or 0.5 or 1 or 2 ms, in order to avoid splitting of the localisation of continuous and transient components.

Various aspects of the invention for various directional encoding systems may be combined in ways evident to those skilled in the art. For example, pseudostereo means that are frequency-dependent rotation matrices may be cascaded to form other pseudostereo means, and conversion matrices between encoding systems may be cascaded and/or combined with pseudostereo means. Matrices, gains, filters, summing and differencing means may also be split apart, combined and rearranged in ways known to those skilled in the art without affecting the functional performance of the invention.

The perceived phasiness of directional reproduction systems may be determined theoretically by means of the mathematical theory described in M. A. Gerzon, "General Metatheory of Auditory Localisation", preprint 3306 of the 92nd Audio Engineering Society Convention, Vienna Austria (1992 Mar. 24–27).

Mixing Methods

An important application of the invention is to use in mixing, for example using a mixing console, of multiple source signals into a single mixed stereo or directionally encoded signal. In such applications, signals may be mixed to one of several stereo subgroups, each of which can be fed to a stereo-in/stereo-out pseudostereo means to achieve a different degree of spread. However, a disadvantage of using such subgroups is that it is not possible to control individually the spread of each component source signal within the mix, but only the degree of spread given to each subgroup.

In applications of the invention to mixing a plurality of sound source signals, it is preferred to provide a mixing means such as a mixing console in which source signals S are individually provided with directional panpot control means for determining the direction of the centre of a sound image, and a spread control means for determining the degree of pseudostereo spread of that source about its centre position. Any means in this description and any directional panpot means known in the art may be used. It is here understood that the term "panpot" is used to describe any controllable means of positioning sounds in a directional encoding system, and is not confined to potentiometer means of implementation.

A problem with providing many source signals S with individually adjustable controllable spread means is that, as has been seen above, low-phasiness pseudostereo means with subjectively desirable properties can involve quite complicated filter means, and so can prove to be expensive to implement, especially when a large number of sound sources (e.g. 48 or 56) are being mixed together. For reasons of cost, it is therefore desirable to find methods of sharing as much as possible of the signal processing in a common means, preferably placed after the mixing busses.

Figure 18:
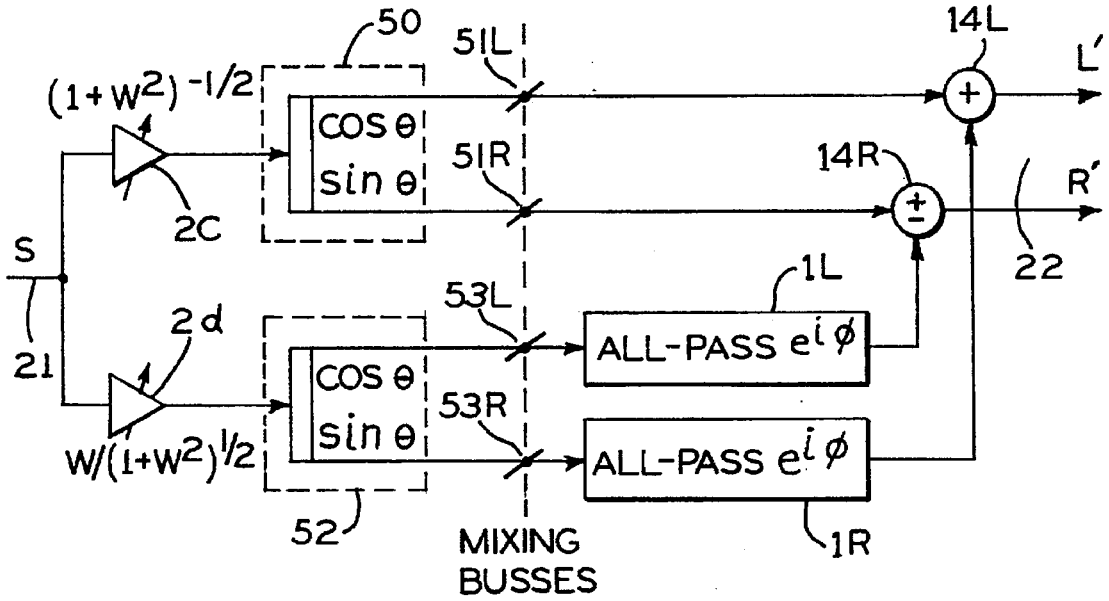
FIG. 18 shows an individually adjustable pseudostereo means for a plurality of sound sources in a mixing means, based on the Orban method.

In order to illustrate the principles of placing the most complicated parts of pseudostereo algorithms after the mixing busses, FIG. 18 shows an example based on the Orban method of FIG. 2. Each source signal S to be mixed is fed via two gain means 2*c* and 2*d* with respective gains $(1+w^2)^{-1/2}$ and $w/(1+w^2)^{1/2}$ to two ganged panpot means 50 and 52 to provide stereo positioning of the source signal S, typically according to a sine/cosine stereo panning law, and the four outputs are fed to four mixing busses 51L, 51R fed from the first panpot means 50 and 53L, 53R fed from the second panpot means 52, where L and R indicate respective left and right signals. Other source signals S' may similarly be fed by similar gain and panpot means to the same four mixing busses 51L, 51R, 53L, 53R. The outputs of the two mixing busses 51L and 51R from the first panpot means are fed directly, via output summing means 14L and 14R to provide output stereo signals 22 for the left L and right R stereo channels, whereas the outputs of the other two mixing busses 53L and 53R are passed through identical all-pass means 1L and 1R with complex gains $e^{i\phi}$ and then fed to the output summing means 14R and 14L of the opposite stereo channel, being added for the left channel output summing means 14L and subtracted for the right output summing means 14R.

Apart from overall gain factors $(1+w^2)^{-1/2}$ and $2^{-1/2}$, it is easily seen that the effect of this method on a source signal S panned to a centre stereo position by panpot means 50 and 52 is identical to the Orban method shown in FIG. 2, and that setting the panpot means 50 and 52 to other angle parameters θ according to the sine/cosine law is to rotate the spread output image similarly to the method shown in FIGS. 4*b* and 4*c*. The overall gain factors referred to ensure that the source signal S is incorporated into the output signals 22 with unity energy gain.

Figure 19:
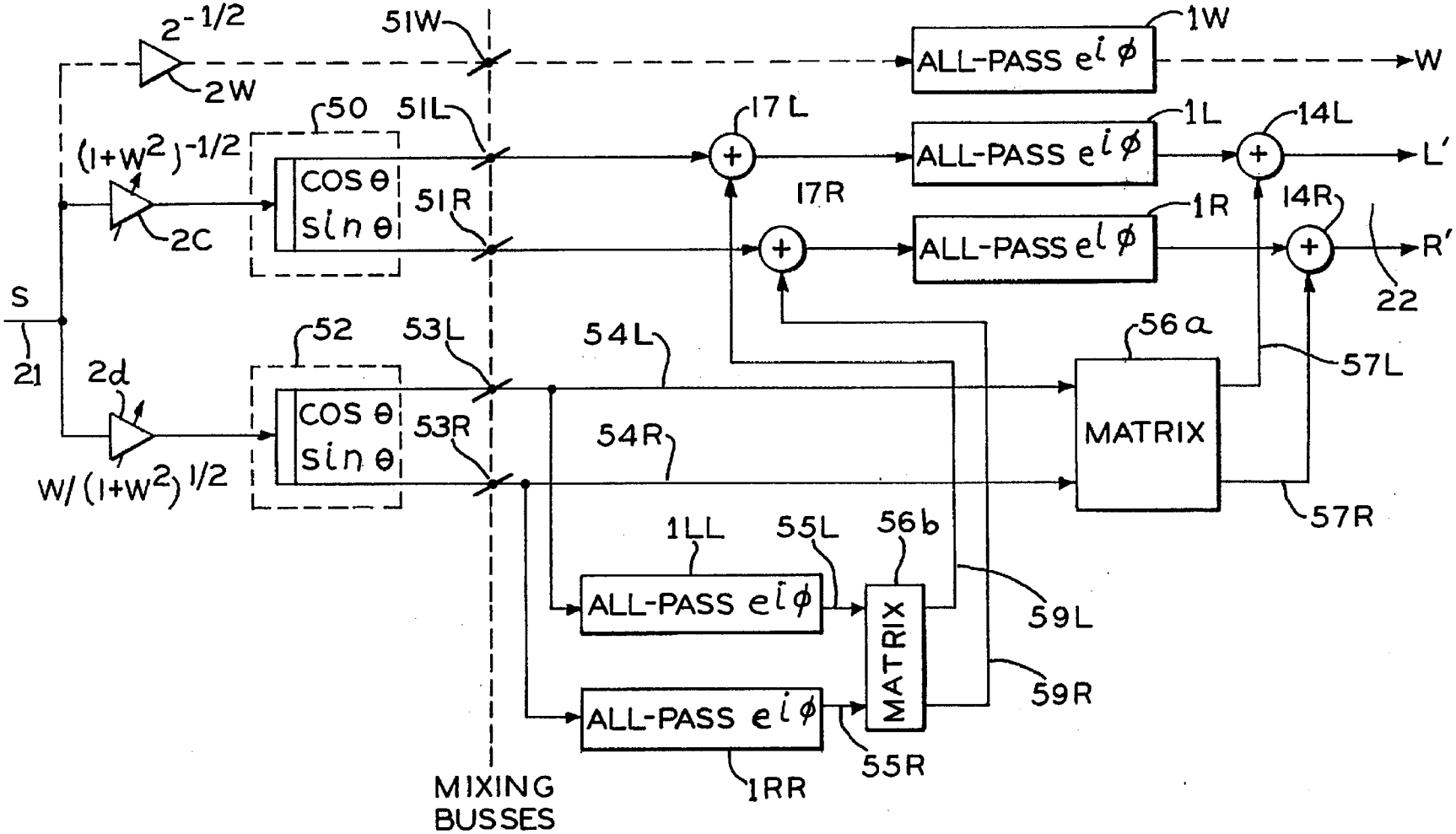
FIG. 19 shows a similar individually adjustable pseudostereo means for a plurality of sources based on the method shown in FIG. 3.

FIG. 19 shows the analogous method for the reduced phasiness algorithm of FIG. 3. Input source signals S are fed by gain means 2*c* and 2*d* to respective ganged panpot means 50 and 52 to mixing busses 51L, 51R, 53L and 53R as in the method of FIG. 18. The outputs of the first pair 51L, 51R of mixing busses are, in FIG. 19, fed via a pair 1L, 1R of identical all-pass means with complex gain $e^{i\phi}$ to output summing means 14L, 14R to provide respective left L' and right R' output stereo signals 22. The outputs of the second pair 53L, 53R of mixing busses are fed directly to a 2×2 matrix means 56*a* whose ouputs 57L, 57R are fed to the respective left and right output summing means 14L, 14R. The outputs of the second pair 53L, 53R of mixing busses are also fed via a second pair 1LL, 1RR of all-pass means identical to the above said pair 1L, 1R whose outputs are fed to a second 2×2 matrix means 56*b* whose outputs 59L, 59R are mixed via respective summing means 17L, 17R with the signals fed to the inputs of said first pair 1L, 1R of all-pass means.

The said 2×2 matrix means 56*a*, 56*b* satisfy the respective equations $$S_{57L}=\tfrac{1}{2}(S_{54L}+S_{54R}) \quad (56a1)$$

$$S_{57R}=\tfrac{1}{2}(-S_{54L}+S_{54R}) \quad (56a2)$$

$$S_{59L}=\tfrac{1}{2}(-S_{55L}+S_{55R}) \quad (56b1)$$

$$S_{59R}=\tfrac{1}{2}(-S_{55L}-S_{55R}), \quad (56b2)$$

where $S_{(subscript)}$ here indicates the signal present in the signal path represented in FIG. 19 by the indicated subscript.

It can be verified that, apart from gain factors $(1+w^2)^{-1/2}$ and $2^{-1/2}$, for a central setting of the panpot means 50, 52 in FIG. 19, its effect on a source signal is identical to the reduced-phasiness pseudostereo method of FIG. 3, and that the effect of changing the panpot position is simply to correspondingly rotate the spread pseudostereo image similarly to in FIGS. 4*b* or 4*c*.

It will be realised that various component means in FIGS. 18 or 19 may be rearranged without affecting their functional performance. In particular, the gain means 2*c* and 2*d* may be placed after the panpot means 50 rather than before it, in which case panpot means 52 may be omitted but four gain means must be used, two for each channel, to feed the four mixing busses 51L, 51R, 53L, 53R. Also, an overall gain may be incorporated, and the stereo panpot 50, 52 need not satisfy a sine/cosine law if another law is desired.

FIG. 19 also shows an additional optional signal path in which the source signal S is fed via a gain $2^{-1/2}$ to another mixing buss 51W, which is fed to another copy 1W of the all-pass $e^{i\phi}$, which provides another output signal W. The three output signals then provide B-format signals with a spread effect, provided that the panpot means accurately follow a sine/cosine law, preferably with a range of angles θ covering a 360° horizontal surround sound azimuthal stage. The spread B-format image produced by this version of FIG. 19 still has some phasiness except for the two edge and the centre positions in each spread source image.

Providing a version of the stereo-in/stereo-out pseudostereo means using feedback that shares most of the signal processing after a mixing buss is more complicated than the cases just described, since for the Orban and reduced-phasiness methods of FIGS. 2 and 3, variations in spread are simply provided by changed linear combinations of just two or three signals, whereas in the feedback algorithms, a change of width changes the character of the linear filtering used. For this reason, one can only ensure in a post-buss processing method using feedback pseudostereo that the pseudostereo is exactly implemented for a finite number of width settings, and for other settings, it is necessary to interpolate between these exactly-implemented cases. Such interpolation involves a degree of approximation, but can give adequately good results.

Figure 20:
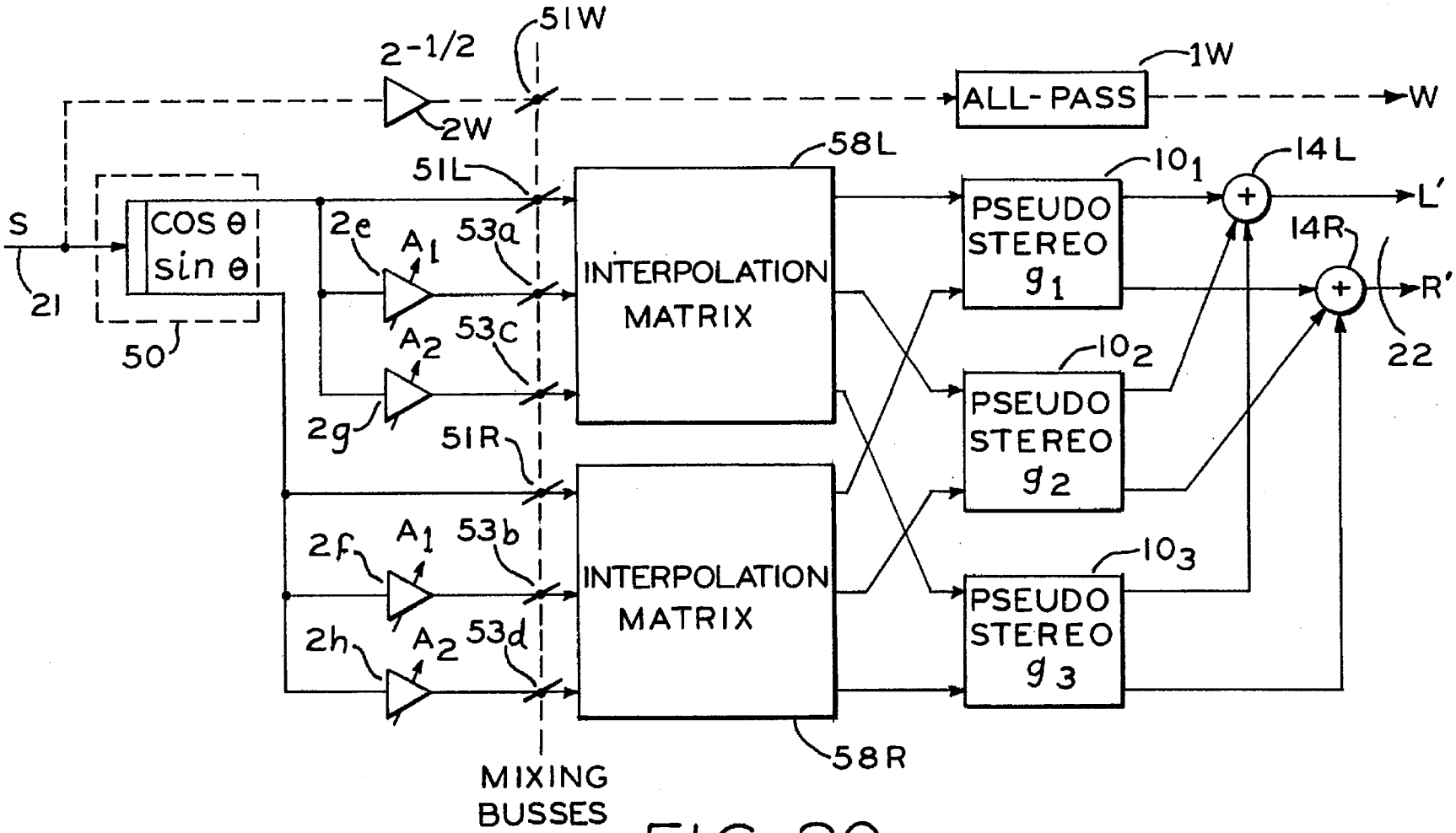
FIG. 20 shows a low-phasiness individually adjustable pseudostereo means for a plurality of sources using interpolation between pseudostereo algorithms having different amounts of spread.

FIG. 20 shows an example of a post-buss pseudostereo method using interpolation between, in this case, three exact stereo-in/stereo-out pseudostereo algorithms $\mathbf{10}_1$, $\mathbf{10}_2$ and $\mathbf{10}_3$ based on the same all-pass $e^{i\phi}$ and unitary U as previously described, but with three different respective feedback gain parameters $g_1$, $g_2$ and $g_3$ corresponding to three different degrees of spread between which it is desired to interpolate.

An input source signal S is fed to a panpot means 50 which may be a sine/cosine potentiometer, and the output stereo signal is fed to a first stereo mixing buss 51L and 51R directly, and via a ganged stereo gain means **2*e*, 2*f* with gain $A_1$ to a second stereo mixing buss 53*a*, 53*b* and also via a second ganged stereo gain means 2*g*, 2*h* with gain $A_2$ to a third stereo mixing buss 53*c*, 53*d*. The outputs of the three stereo mixing busses are fed into respective 3×3 "interpolation" matrix means 58L, 58R, one for each stereo channel, and their outputs feed respective input stereo channels of the three pseudostereo means $\mathbf{10}_1$, $\mathbf{10}_2$ and $\mathbf{10}_3$, whose stereo outputs are then mixed together by respective output summing means 14L, 14R to provide a stereo output signal 22**. Although the figure shows the case of two-channel stereo, this description also applies to M-channel directional encoding systems, and an extension to n=4 or more pseudostereo means is implemented similarly with n×n "interpolation" matrix means preceded by n−1 gains $A_1$ to $A_{n-1}$.

The gains $A_1$ and $A_2$ are adjusted in FIG. 20 according to the width setting, and the interpolation matrices are arranged such that at three predetermined settings of the width, two of the three outputs have gain zero and the remaining output has gain 1, so that at such width settings, only one of the pseudostereo means $\mathbf{10}_i$ is fed with a signal. We now describe a particular case by way of example.

Consider the case where the pseudostereo means $\mathbf{10}_1$, $\mathbf{10}_2$ and $\mathbf{10}_3$ are implemented as in FIGS. **8*a* or 8*b*** or by equivalent means, where the respective values of g are $g_1=-g$, $g_2=0$ and $g_3=+g$. In this case the means $\mathbf{10}_2$ is simply a parallel pair of all-pass means $e^{i\phi}$. Then for $\phi=0°$, $\pm 90°$ or 180°, all three means $\mathbf{10}_1$, $\mathbf{10}_2$ and $\mathbf{10}_3$ have identical input/output phase $\phi'=\phi$ by equ. (21), and for $\phi=\pm 90°$ all give output positions equal to the input positions with gain $\pm i$, and for $\phi=0°$ or 180°, the means $\mathbf{10}_1$, $\mathbf{10}_2$ and $\mathbf{10}_3$ all have the same gain ±1 and rotate input stereo position respectively by $\pm\theta_i$, where $$\theta_1=2\tan^{-1}g \tag{57a}$$

$$\theta_2=0 \tag{57b}$$

$$\theta_3=-2\tan^{-1}g \tag{57c}$$

To produce a pseudostereo means with other spread width, corresponding to rotations within a stage $\pm\theta''$, one thus wishes to produce a linear combination of the three pseudostereo means $\mathbf{10}_i$ equal to the sum from i=1 to 3 of $B_i$ times the result of the means $\mathbf{10}_i$, where:

$$B_1+B_2+B_3=1, \tag{58a}$$

$$\cos\theta''=(B_1+B_3)\cos\theta_1+B_2 \tag{58b}$$

$$\sin\theta''=(B_1-B_3)\sin\theta_1. \tag{58c}$$

The equation (58a) results from demanding that at $\phi=\pm 90°$, the ouput of the linear combination should also have 0° rotation, and equs. (58b) and (58c) result from demanding that the angle of rotation at $\phi=0°$ or 180° be changed from the values $\theta_1$, 0, $-\theta_1$ to $\theta''$. One may typically put $A_1=B_1+B_3-2B_2$ and $A_2=B_1-B_3$ in this case, and use the interpolation matrices 58L,58R to reconstruct the gains $B_1$, $B_2$, $B_3$ via the matrix equation $$B_1=\tfrac{1}{3}1+(\tfrac{1}{6})A_1+\tfrac{1}{2}A_2 \tag{59a}$$

$$B_2=\tfrac{1}{3}1-\tfrac{1}{3}A_1 \tag{59b}$$

$$B_3=\tfrac{1}{3}1+(\tfrac{1}{6})A_1-\tfrac{1}{2}A_2. \tag{59c}$$

The gain laws for the gains $A_1$ and $A_2$ as a function of the spread angle $\theta''$ may be determined from equs. (58), from which $$A_2=B_1-B_3=(\sin\theta'')/(\sin\theta_1) \tag{60a}$$

$$A_1=B_1+B_3-2B_2=3(1-\cos\theta'')/(1-\cos\theta_1)-2. \tag{60b}$$

Although the interpolation method described in relation to FIG. 20 works ideally for $\phi=0°$. ±90° and 180°, it works imperfectly for intermediate values of $\phi$, causing some phasiness and gain variation as the sound image sweeps to and fro. In practice, these deviations from the ideal remain small as long as (i) $\theta_1$ is not too large, say less than 55° and (ii) values of $\theta''$ less than (say) $1.15\theta_1$ and greater than $-1.15\theta_1$ are used. The smaller the value of $\theta_1$, the less the phasiness and gain variations.

More generally, the means $\mathbf{10}_i$ can have gains $g_i$ corresponding to extreme ($\phi=0°$) rotation angle $$\theta_i=2\tan^{-1}g_i \tag{61}$$

and then equs. (58) are replaced by:

$$B_1+B_2+B_3=1 \tag{62a}$$

$$B_1\cos\theta_1+B_2\cos\theta_2+B_3\cos\theta_3=\cos\theta'' \tag{62b}$$

$$B_1\sin\theta_1+B_2\sin\theta_2+B_3\sin\theta_3=\sin\theta'', \tag{62c}$$

from which the appropriate gain law for $A_1$ and $A_2$ as a function of the spread angle $\theta''$ can be derived. One suitable choice of the $g_i$'s may be such that $\theta_1=45°$, $\theta_2=22\tfrac{1}{2}°$ and $\theta_3=0°$, which allows the spread to be varied across a range of $\theta''$ between a little greater than 45° to a little less than 0° without too much gain variation or phasiness as the phase $\phi$ of the all-pass $e^{i\phi}$ varies.

The gains $A_1$ and $A_2$ may be chosen to be other linear combinations of $B_1$, $B_2$ and $B_3$ provided that the inverse interpolation matrices are designed accordingly. The method of FIG. 20 can also be used with other families of stereo-in/stereo-out pseudostereo algorithms $\mathbf{10}_i$ such as those based on equs. (34) to (38), and may be similarly be based on other numbers n other than 3 of pseudostereo algorithms $\mathbf{10}_i$ using similar interpolation techniques for n points within the spread stage.

FIG. 20 also shows an optional additional signal path taken from before the panpot means 50 with a gain means 2w with gain 2−½ feeding a mixing buss 51W which feeds an all-pass means 1W with complex gain $e^{Ni\phi}$ to provide an output W, as already described in connection with FIG. 19, to allow use with B-format, since the resulting outputs will be B-format signals, and the panpot means 50 will allow B-format positioning and the gain means **2*e*, 2*f*, 2*g*, 2*h* allow adjustment of the spread angle of the image within the B-format sound stage. Such B-format panning and spreading means in a mixer may be followed by an encoding matrix means, such as shown in connection with FIG. 17**, to allow the panning and spreading to be achieved in other directional encoding systems derivable by matrixing from B-format, such as UMX or UHJ or 3-speaker stereo feeds.

Such a B-format W signal path allows the same apparatus based on FIG. 20 to be used for mixing for many different directional encoding systems, allowing the position and spread of different source signals S to be independently adjusted, while placing all the filter signal processing means after the mixing busses. In the suggested realisation, a total of seven copies of the all-pass $e^{i\Phi}$ are used, as compared to the three that would be required for each source signal S if each had an independent B-format pseudostereo means.

More ideal realisations based on this interpolation method may require more copies of the all-pass $e^{i\Phi}$, but even for interpolation between 4 or 5 pseudostereo algorithms, represents a considerable saving over the use of individual algorithms for each source. Elaborations of the above for use with other encoding systems described earlier will be evident to those skilled in the art.

Use with Distance Simulation

Another important use of the invention is for use with distance simulation means. In the inventor's co-pending British patent application 9207362.6 and his paper "The Design of Distance Panpots", preprint 3308 of the 92nd Audio Engineering Society Convention, Vienna Austria (1992 Mar. 24–27), he suggested that a distance effect may be created for a reproduced sound source S by providing additional simulated delayed early reflections, and also suggested that additionally, the apparent spread of the apparent sound source may also be varied with simulated distance d to equal $$2\tan^{-1}(\tfrac{1}{2}w'/d), \qquad (63)$$

where w' is the acoustical width of the sound source. The improved spreading means of the present invention may be applied to this application.

Figure 21:
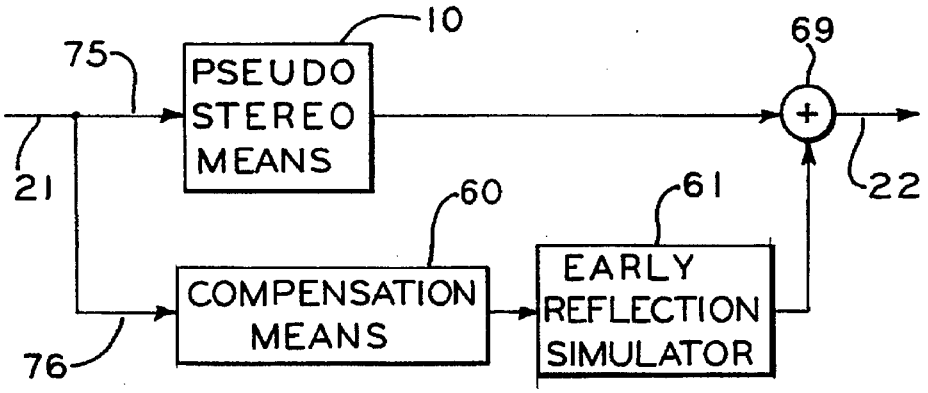
FIG. 21 shows an early reflection distance simulation means incorporating a pseudostereo means.

FIG. 21 shows an example of a distance simulation means according to the cited co-pending application which also incorporates a spreading means according to the present invention.

A sound source signal S is fed via a direct signal path 75 through a pseudostereo means 10 to an output summing means 69 that provides a stereo output signal 22. The source signal S is also fed via an indirect signal path 76 via optional compensation means 60 that match in an energy preserving fashion the phase distortion of the pseudostereo means 10, and whose output is then fed to early reflection simulation means 61 producing a multiplicity of delayed simulated echoes such as to produce a sense of a simulated distance d for the sound source, whose output is fed to the output summing means 69. The pseudostereo means 10 provides a desired reproduced angular size for the direct sound signal at the output 22 in order to simulate the reproduced angular width of equ. (63), and the phase compensation means 60 ensures that both direct and indirect signal paths are subject to similar phase distortions, thereby minimising any risk that the ears may not interprest the distance cues given by the early reflection simulation means 61 correctly.

The requirements on the early reflection simulation means 61 for producing a good sense of distance are described in detail in the inventor's cited co-pending patent application and preprint 3308, and the present invention allows the angular size of the direct sound to be simulated in a realistic manner, for example according to equ. (63), corresponding to the simulated distance d without the unpleasant side effects of prior-art methods of spreading, and without alteration of the overall gain magnitude of the direct signal path sound, provided only that the pseudostereo means 10 is unitary or otherwise preserves the energy of signals passing through it. As noted in the two just-cited references, the maintainance of appropriate gain magnitude ratios between the direct and indirect signal paths is important for the correct interpretation of early reflection distance cues.

Figure 22:
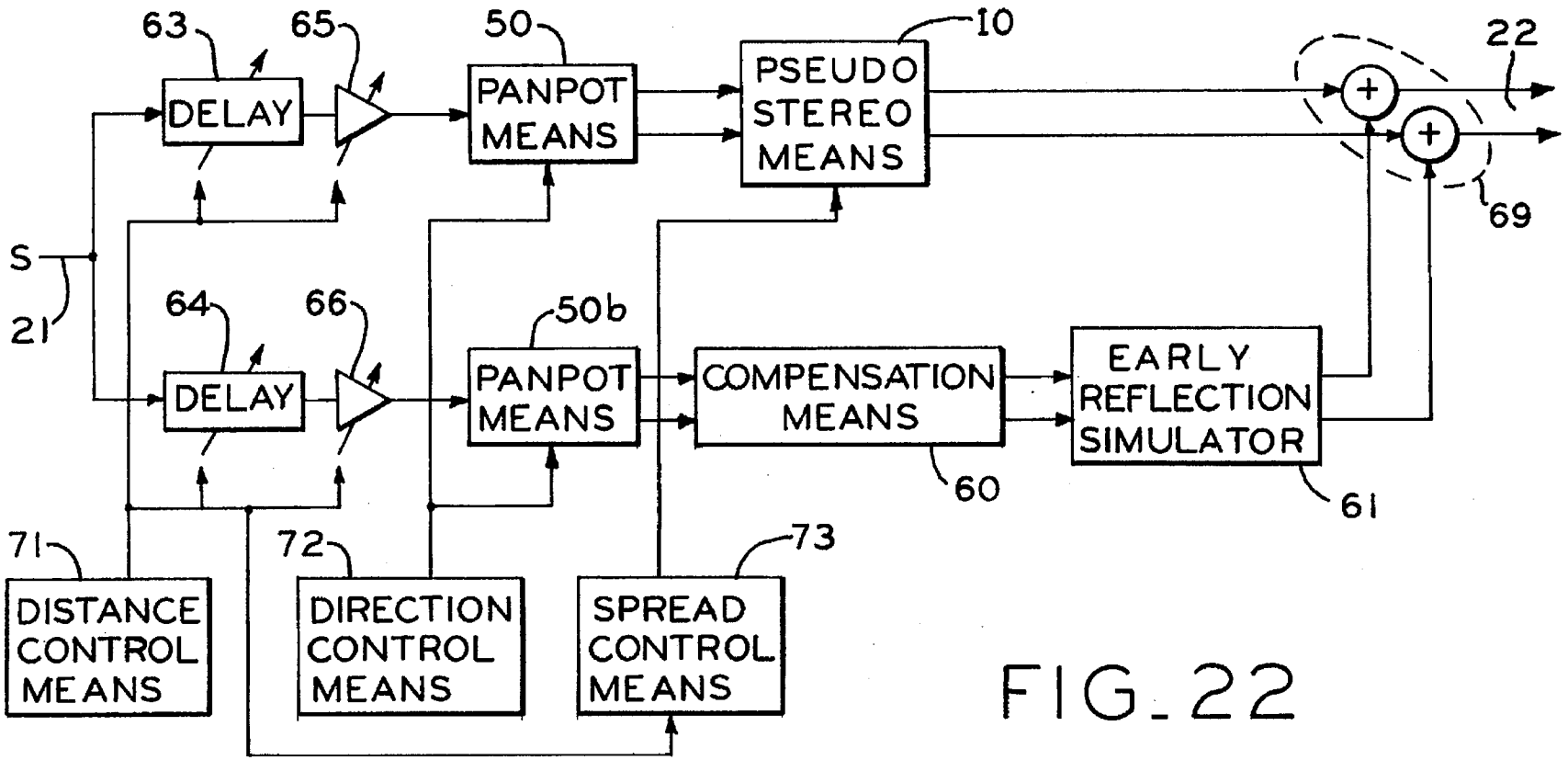
FIG. 22 shows a processing means for a source signal S permitting adjustment of simulated direction, image spread and distance.

FIG. 22 shows the application of the method of FIG. 21 in the case where it is desired to be able to adjust simultaneously the direction, distance and apparent acoustical size of a sound source signal S. The direct and indirect signal paths now incorporate respective delay means 63, 64 and gain means 65, 66 responsive to distance control means 71. This alters the apparent distance if the values of the gains 65, 66 and delays 63, 64 are adjusted appropriately, as described in the two just-cited references. One or two of the means 63, 64, 65, 66 may be "trivial", where a delay is trivial if it is omitted or has zero delay, and a gain is trivial if it is omitted or has unity gain. If desired, panpot means 50, **50*b* may be provided in the respective direct and indirect signal paths responsive to a sound source direction control means 72 in order to position (or for a stereo source, to reposition using rotation matrix means) the source signal S in direction. As in FIG. 21, a pseudostereo means 60 is also provided in the direct signal path, and may be responsive to a spread control means 73. It is preferred that the spread control means should control the apparent acoustic width w', and that the degree of spread of the pseudostereo means should be responsive both to the setting w' of the spread control means 73 and the distance setting d of the distance control means 71, for example to produce the reproduced angular spread of equ. (63). The indirect signal path, as in FIG. 21, also contains an optional all-pass phase compensation means 60 and an early reflection simulation means 61 handing a stereo signal path, and the outputs of the direct and indirect signal paths are combined using stereo summing means 69**.

Signal paths shown by a single line in FIGS. 21 or 22 may be mono or stereo (in its broad sense), and panpots 50, **50*b* may be energy-preserving rotation or encoding or conversion matrix means, and panpot means 50 may follow rather than precede the pseudostereo means 10, such as is shown in FIGS. 4*a* or 17**.

The method of FIG. 22 may be used with a plurality of source signals S sharing both common early reflection simulation means as described in the two just-cited references and common pseudostereo means for example as described with reference to FIGS. 19 and 20, where the spread control means 73 is used to adjust gain coefficients prior to the mixing busses. By this means, one can provide a mixing console or other mixing means for a plurality of sound source signals S wherein it is possible independently to adjust simulated direction, acoustical image size and distance for each source signal. It will be appreciated that this will allow the simulation or creation of a much more convincing illusion of a desired stereo "picture" of a sound stage than has usually hitherto been possible.

The description in connection with FIG. 22 is only one of many alternative ways of combining the features of the present invention and the cited co-pending British patent application, and other combinations will be evident to those skilled in the art. For example, while it may be preferred to use identical panpot means 50, **50*b* in the direct and indirect signal paths of FIG. 22** with identical settings, there is no need to make these means identical. One may also, if desired, provide the indirect signal path or individual simulated early reflection with other pseudostereo means to simulate an angular spread of individual simulated reflections, which may be of a smaller angular width than that of the direct signal path so as to simulate the greater apparent distance of the virtual sound source of a reflected sound.

Numerous other variations, combinations and rearrangements will be evident in this application to those skilled in the art.

The indirect signal path of FIGS. 21, and in particular the early reflection simulation means 61 and the compensation means 60 (if present) may be fed in the realisations of FIGS. 19 or 20 from the stereo mixing buss 51L, 51R, and in the case of FIG. 22, an additional stereo mixing buss may be provided for the indirect signal path.

Phase Correction

As has already been noted, pseudostereo means so far described according to the invention based around all-pass networks $e^{i\phi}$ produce a phase distortion on the signal being processed. In many applications, the effect of this phase distortion will be acceptable, but in some critical applications, it may be desired to reduce, eliminate or otherwise modify the phase response of such a pseudostereo process.

Figure 23A:
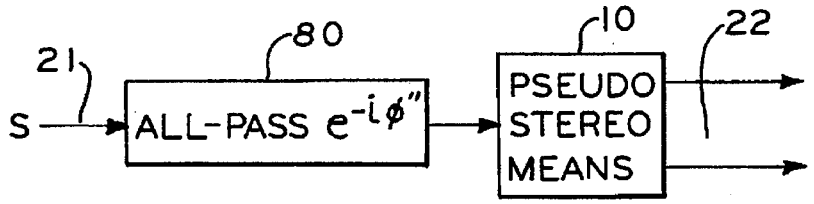
FIGS. 23*a* to 23*c* show phase-response correction means for pseudostereo algorithms.
Figure 23B:
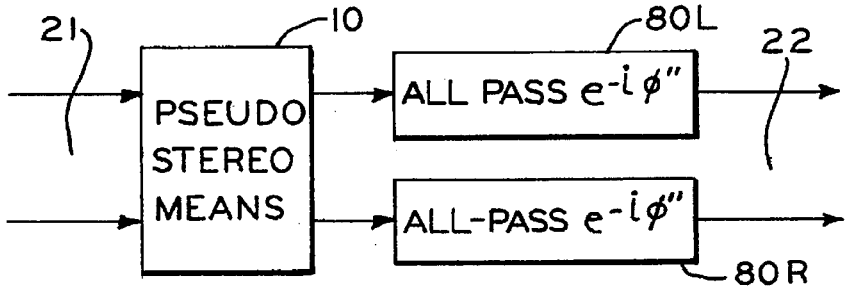

This may be done by preceding, as in FIG. 23*a*, or following, as in FIG. 23*b*, the pseudostereo network 10 by a phase compensating filter 80, 80L, 80R with complex gain $e^{-i\phi''}$ intended to combine with the phase response $e^{i\phi'}$ of the pseudostereo means 10 so as to form either a pure time delay, or else an all-pass response that is of a more acceptable form.

The phase-correction all-pass means 80, 80L, 80R will generally be implemented by finite impulse response filter (FIR) means. While such FIR means are quite complicated, in the 2-channel stereo case, only one or two such means are required to correct the phase response (in the respective cases of a mono or stereo input), which is half the number of FIR filter means required for a direct FIR realisation of the pseudostereo algorithm.

Also, a fixed approximate phase correction means 80, 80L, 80R may be used as the feedback gain g or filter G of a pseudostereo algorithm is varied, since the phase response $e^{i\phi'}$ is approximately of the form $e^{Ni\phi}$ or $\psi e^{Ni\phi}$ for integer N as described earlier. For small spreads, according to equ. (21), a fixed phase correction works reasonably accurately even for the pseudostereo algorithms of FIGS. 8*a*, 8*b* or 10, and for larger N in the algorithms described in connection with equs. (34) to (38), there is little change in the phase response as g or G is varied.

However, phase corresction all-pass filters generally have a large latency, i.e. overall input/output time delay, which may exceed 20 ms. It is found in many applications where a signal is being monitored, such as in recording or broadcasting, that it is desired to minimise the latency, generally to be smaller than about 8 ms and often preferably to be smaller than 4 ms or 1 ms.

In such applications, it may be that for this reason, it is preferred not to use phase correction, since the latency of the all-pass filter $e^{i\phi}$ is generally very low, particularly if as preferred it has a pure time delay component of less than 2 or 1 or ½ or 0.1 ms.

However, there are two methods of reducing the latency with phase correction. The first is only to use a partial phase correction, say only of the middle-frequency pole-zeros of the all-pass networks, which generally gives a smaller latency than a correction of low-frequency pole-zeros. The second is to use a phase correction the early part of whose impulse response is windowed or truncated so as minimise latency. The early part of the impulse response of an accurate phase correction filter will often be at a very low level, perhaps 40 or 60 or 100 dB down in level, and removal of such low-level initial parts will reduce latency while having only a small effect on the results.

However, there is always the possibility that the effect of such windowing or truncation may sometimes be audible, and it is preferred to minimise such effects. In the correction methods of FIGS. 23*a* or 23*b*, the whole signal passing through the network is subject to any windowing or truncation errors. Yet the main signal passing through the network is subjected both to an approximate phase correction $e^{-i\phi''}$ and to an all-pass response $e^{Ni\phi}$ or $\psi e^{Ni\phi}$ intended to be complementary to one another, so that the main signal should approximate a simple time delay without any truncation error, which is easy to implement in digital form.

Figure 23C:
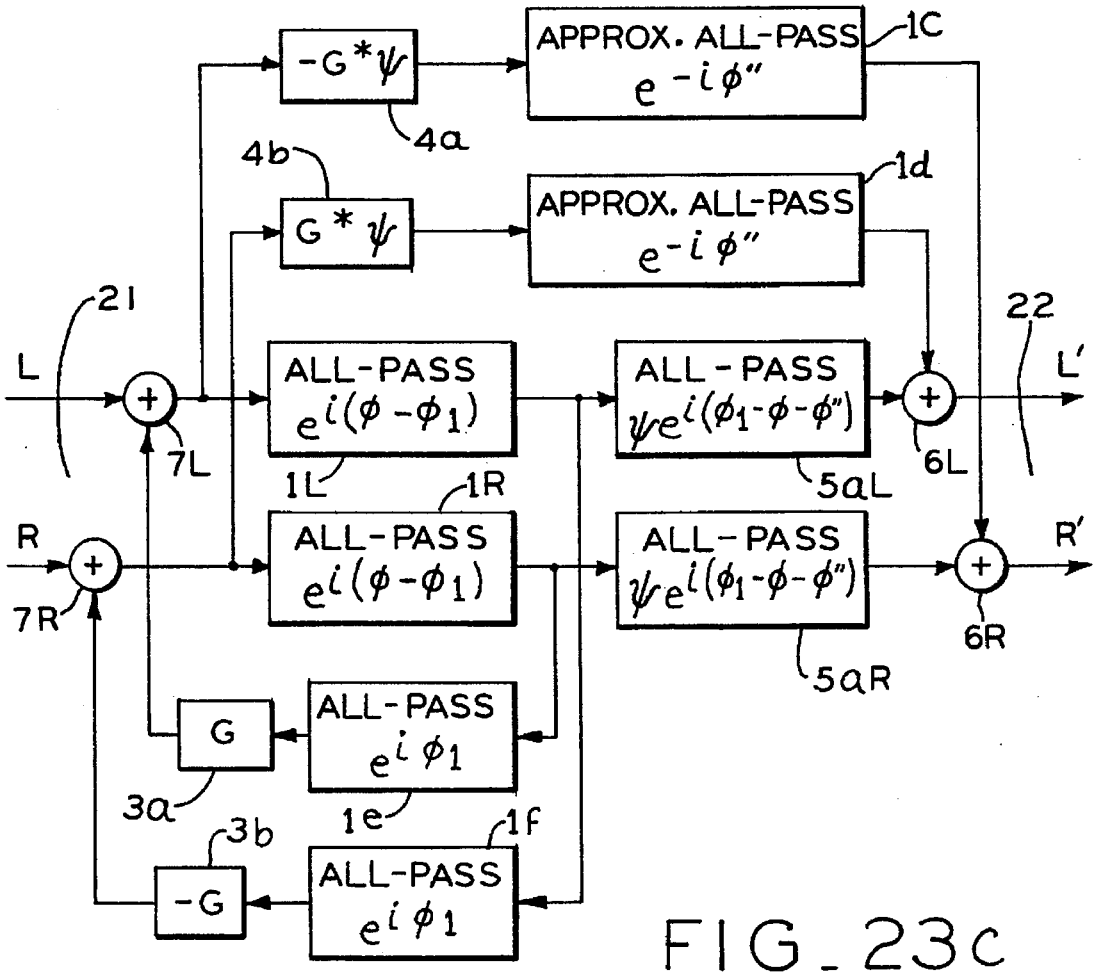

For this reason, it is generally preferred to implement phase correction by incorporating it within the pseudostereo algorithm, for example as in FIG. 23*c*, rather than before or after it as in FIGS. 23*a* or 23*b*. The example of FIG. 23*c* is based on phase correction of the algorithm of FIG. 10, although similar methods can be devised for other pseudostereo algorithms, such as for those of FIGS. 8*a* or 8*b* or those described in connection with equs. (34) to (38) or FIG. 3.

In FIG. 23*c*, the desired all-pass phase correction $e^{-i\phi''}$ is implemented as a truncated or windowed approximation 1*c*, 1*d* in the feedforward signal path, and is expressed as a product of two factors $\exp(-i\phi_1)$ and $\exp(-i[\phi''-\phi_1])=\psi''$ such that $\exp(i\phi_1)$ is a factor of the all-pass $e^{i\phi}$ used in the algorithm of FIG. 10, e.g. the cascade of some or all poles of $e^{i\phi}$, and such that $\psi\psi''$ is an easy-to-implement all-pass filter such as a time delay in cascade with zero, one or more all-pass pole-zeros. For example, one may choose $e^{i\phi''}$ equals $\psi e^{i\phi}$ times a time advance, with $\theta_1=\phi$ and $\psi''=\psi^{-1}$ times a time delay.

The effect of the phase compensation $e^{-i\phi''}$ is thus to remove some or all poles from the direct-path all-pass filters 1L, 1R with gain $\exp(i[\phi-\phi_1])$, and to transfer them into all-pass networks 1*e*, 1*f* with gain $\exp i\phi_1$ in the feedback path, and to convert the causalisation all-pass 5*a*L, 5*a*R from $\psi$ into $\psi\psi''$, which may simply be a time delay. In this realisation, every all-pass filter is implemented exactly with the exception of those 1*c*, 1*d* in the feedforward path, which are subject to the attenuation of the feedforward filters 4*a*, 4*b*, which in general will mean that any windowing or truncation errors will be corespondingly attenuated.

Applications

There are numerous applications of the invention other than those described above. One application is to the provision of special audio effects. For example, one popular effect is a delayed echo effect obtained by adding the original sound to the output of a delay line with recirculation of its output into its input. If a stereo delay line is used, and if a stereo-in/stereo-out pseudostereo algorithm is placed in the feedback recirculation loop, then the degree of stereo spread of the recirculated echo will become progressively wider with each passage round the loop, providing a pleasing directionally diffuse effect with the later echoes. This application depends on the fact that the preferred pseudostereo algorithms are frequency-dependent rotation matrices, so that the rotations progressively add up with repeated passage through the algorith.

Stereo-in/stereo-out pseudostereo algorithms may be used to diffuse the spacial effect of other special effects such as artificial reverberation, where they may be used to affect the overall algorithm or within a stereo feedback loop within the algorithm as already described in the case of echo, and also to diffuse the spacial effect of other added modified sounds such as artificial harmonics produced by pitch shifters or enhancers, or delayed or autopanned sounds.

Also, since the spread of a pseudostereo algorithm is easily modified simply by adjusting a few feedforward and feedback gains, the spread itself may be adjusted responsive to measured characteristics of the signal being processed, such as its level. For example, sounds can be given a pleasantly spacial quality by passing them through a pseudostereo algorithm where g is small for high signal levels, but is increased as the signal level becomes small. This retains sharp images for high-level transients, but allows resonant decays of a sound to spread out and fill larger parts of the stereo image. If desired, by using an algorithm such as that of FIG. 10, the way in which the spread is responsive to different signal characteristics can be varied in different frequency ranges.

Besides use for providing special effects in musical and dramatic applications, the invention may be used to provide an artificial stereo effect from a source where only mono is available, such as is the case with historical mono recordings, the mono "surround" soundtrack of many films, or a mono "effects" or "atmosphere" track such as may be available on location recordings when the number of tracks or microphones is limited. The invention may be used to simulate a desired wide spread such as is desirable for the sense of atmosphere without the unpleasant side-effects of the prior art. In such applications, it may often be found preferable to use a higher degree of spread at bass frequencies below around 600 Hz than at treble frequencies above 1 kHz, since it is found that the bass frequencies are especially important in conveying a sense of space, whereas the higher frequencies may sound artificial if spread extremely wide.

In remastering applications, where it may be desired to simulate a stereo effect from a mono original mix, it is desirable not just to be able to control the degree of spread at different frequencies, but also to be able to position small bands of frequencies at particular stereo positions. This may be done by using a first or second order pseudostereo algorithm with the frequency of the pole-zero and the 'Q' of the all-pass $e^{i\Phi}$ being adjustable, with adjustable g and rotation matrix means so as to position the selected frequency bands as desired. Such a "parametric" pseudostereo algorithm may be cascaded with others, or with a high-order algorithm for general spreading effects. In this remastering application, it may also be useful to make the degree of spread dynamic, i.e. to be responsive to signal level as already described, so that the degree of spaciousness during the decay of reverberation is adjustable independently of the spread of higher-level transients or direct sounds.

A similar application is to signal processing of signals for broadcasting applications. Here a mixture of monophonic and stereophonic signals is likely to occur, and it is often desired to provide an artificial stereo effect on mono sources without degrading stereo sources. In this application, the presence of a mono source must be sensed, and if it is present, the mono source must be moved to the centre of the stage and given a large degree of spread. This must be done in a manner that errors in the mono sensing do not have a serious effect.

It may be desired to provide one smaller degree of spread, associated with a feedback gain $g_1$ or filter $G_1$ for stereo sources and a larger degree of spread, assciated with a larger feedback gain $g_2$ or filter $G_2$ for mono sources. THe adjustment of the algorithm then consists of adjusting the gain g or filter G used.

Figure 24:
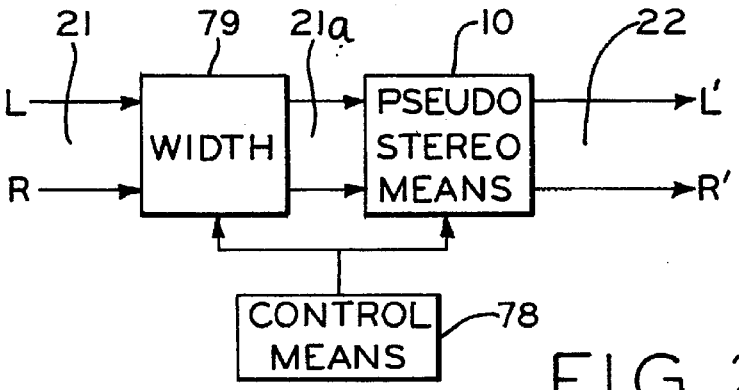
FIG. 24 shows a preferred simultaneous adjustment of stereo width and image spread for premixed stereo inputs.

It is preferred if the pseudostereo algorithm 10 is preceded by a stereo width adjustment 79 as shown in FIG. 24, both adjusted by the same control means 78. The width means 79 takes input stereo signals 21L and R and produces output stereo signals 21*a* L" and R" given by $$L''=\tfrac{1}{2}(1+w'')L+\tfrac{1}{2}(1-w'')R \tag{64a}$$

$$R''=\tfrac{1}{2}(1-w'')L+\tfrac{1}{2}(1+w'')R, \tag{64b}$$

where the width parameter w" lies between 1 for full stereo and 0 for mono. In order that the stereo stage be filled for every setting of the control means 78 from mono to stereo, one may use values of g and w" related by $$\tan^{-1}w''+2\tan^{-1}g=45°. \tag{65}$$

If, by error, a stereo input is thought possibly to be mono by the control means 78, it may adopt an intermediate value of w", say 0.414 and of g, say 0.199 according to equ. (65), to give a reduced width and increased spread that still retains a partial stereo effect if the signal is indeed stereo, and a partially spread effect with the signal closer to the centre if the signal is indeed mono.

One method of deciding whether an input signal is stereo or mono, where the mono signal may be equal on both channels or present only on the left or the right channel, is to measure the correlation matrix of the stereo signal, and to compute the ratio of the smaller to the larger eigenvalue of this matrix. If this ratio is small, say less than 1/100, the signal is likely to be mono, whereas if it is large, say greater than 0.1, it is likely to be stereo. The values of w" and g in the method of FIG. 24 may then be adjusted in response to this measured ratio of eigenvalues, or any other suitable measure of stereoism.

In broadcast applications where a processor must be left to provide automatic pseudostereo effect, it is also desirable to provide a means of recognising the typical characteristics of speech and music signals, so that the amount of stereo spread applied is varied accordingly, so as typically to be narrower for speech-type signals and wider for music-type signals. As in remastering applications, a larger stereo spread may be used for bass than for treble frequencies.

Unlike the Orban method, low-phasiness pseudostereo algorithms with flat total energy response can be shown not to be fully mono compatible, in the sense that the mono frequency response cannot also be flat. However, for small spread, say less than g=0.2, the frequency response ripple is small, say less than 0.7 dB, In addition, if the order of the pseudostereo algorithm is reasonably large, say N=15 or more, then there are N frequency response ripples across the audio band for a spread central sound in mono, so that the ripples generally fall within the ear's critical bands, and as a result are less audible than more widely spaced ripples.

This will generally mean that mono compatibility is reasonable for mono sounds. In theory, the mono compatibility for spread stereo sounds away from the centre of the stereo stage is poor, since the ripple amplitude is larger and the number of ripples across the audio band is reduced to ½N. However, it is found in practice that mono compatibility is excellent, largely because frequency response troughs for sounds on one side of the stereo stage are compensated by frequency response peaks on the opposite side, which subjectively seems to give the overall effect of a flat response, despite different sources being present at the two sides of the stereo stage.

The method shown in FIG. 24 for adjusting spread and width simultaneously can also be used with user control means 78 to provide a pleasantly directionally diffuse effect for reproduction in consumer stereo systems with stereo source material. It is found that many listeners do not like a sharp directional effect, and the invention allows a more dispersed directional effect to be obtained if desired via ordinary loudspeakers. Hitherto, special loudspeakers such as omnidirectional types have had to be used to achieve a diffused effect, but the use of the present invention with loudspeakers allowing sharp reproduction allows the user to adjust the degree of diffusion or spread to taste.

This aspect of the invention is also useful for the diffuse reproduction of monophonic "surround" channels such as are commonly used for films. Such channels are desirably delocalised to provide an ambient effect. The invention allows the wide diffusion and decorrelation of the outputs from two or more loudspeakers without unwanted phasiness side effects.

The outputs for more than two loudspeakers may be obtained from the invention in a variety of ways. In one method, based on that of FIG. 17, a 2-channel pseudostereo signal may be converted for reproduction via three or more loudspeakers as described in the inventor's paper "Optimal Reproduction Matrices for Multispeaker Stereo", preprint 3180 of the 91st Audio Engineering Society Convention, New York (1991 Oct. 4 to 8). In another method, B-format pseudostereo signals may be produced and decoded via 3 or more loudspeakers such as is described in the inventor's paper "Hierarchical System of Surround Sound Transmission for HDTV", preprint 3339 of the 92nd Audio Engineering Society Convention, Vienna Austria (1992 Mar. 24–27), or an arrangement used to pan a mono signal to-and-fro in direction across a stage according to a desired 3- or 4-speaker panning law known to be good psychoacoustically, in a frequency-dependent way, may be used. Such optimal panpot laws were described in the earlier cited Gerzon preprint 3309.

For pseudostereo according to the invention, variations with frequency of total energy response caused by variations in position should be preferably within a 1½ dB range, more preferably within a 1 dB range and even more preferably within a half dB range, and ideally within a 0.2 dB range. Variations should preferably be within a smaller range as the angle of spread is made smaller.

In this description, it will be understood that terms such as "network", "algorithm" and "circuit" may generally be used interchangeably, and that electrical analogue and digital signal processing means of substantially equivalent functionality may be substituted for one another. Filter, gain, summing and matrixing means may be split apart, rearranged and recombined in ways known to those skilled in the art without changing functionality.

Other Reduced-Phasiness Algorithms

There are numerous other reduced-phasiness pseudostereo algorithms according to the invention that have flat total energy response and are based on all-pass networks with gain $e^{i\phi}$. Here we give further examples not based on the examples of FIGS. 3, 7, 9, 10 or 25.

A mono-in/stereo-out example based on three copies of the all-pass $e^{i\phi}$ is the network with respective left and right gains L' and R' given by $$\tfrac{1}{2}(L'+R')=e^{i\phi}[1-\tfrac{1}{4}w^2e^{2i\phi}] \tag{66a}$$

$$\tfrac{1}{2}(L'-R')=e^{i\phi}[w\cos\phi]=\tfrac{1}{2}w[1+e^{2i\phi}] \tag{66b}$$

for a real width parameter w. This algorithm has position and phasiness parameters $$P=[w\cos\phi](1-\tfrac{1}{4}w^2\cos 2\phi)/(1+w^4/16-\tfrac{1}{2}w^2\cos 2\phi) \tag{67a}$$

$$Q=[\tfrac{1}{4}w^3\cos\phi\sin 2\phi]/(1+w^4/16-\tfrac{1}{2}w^2\cos 2\phi), \tag{67b}$$

which has zero phasiness Q for the 3 positions for which $\phi=0°$, $\pm 90°$ and 180°. This algorithm has lower phasiness than that of FIG. 3; for example, $w=8^{1/2}-2=0.8284$ gives a full-width left-to-right-spread and has maximum phasiness magnitude Q=0.1244 at $\phi=29.07°$.

A mono-in/stereo-out example based on 4 copies of the all-pass $e^{i\phi}$ is the network with output gains L', R' with $$\tfrac{1}{2}(L'+R')=e^{2i\phi}[1+w_2 i\sin\phi-w_3\cos 2\phi] \tag{68a}$$

$$\tfrac{1}{2}(L'-R')=e^{2i\phi}[w\cos\phi+w_3 i\sin 2\phi], \tag{68b}$$

where w, $w_2$, $w_3$ are real width parameters such that $$w_3=\tfrac{1}{4}(w^2-w_2^2) \tag{68c}$$

in order to ensure flat total energy gain. This algorithm has phasiness Q equal to zero for the 3 positions for which $\phi=0°$, $\pm 90°$ and 180°, and the phasiness can be made zero for the additional 2 positions for which $\phi=\pm 45°$ and $\pm 135°$ by putting $$w_2=(2^{1/2}-1)w=0.4142w \tag{69a}$$

and $$w_3=\tfrac{1}{2}w_2w=\tfrac{1}{2}(2^{1/2}-1)w^2=0.2071w^2. \tag{69b}$$

As before, these algorithms can be subjected to rotation matrixing as in FIGS. 4*a* to 4*c* in order to achieve an image spread around a noncentral stereo position.

The 3 all-pass algorithm of equs. (66) can also be used as the basis of 3-channel pseudostereo algorithms for other directional encoding systems.

For example, a related B-format pseudostereo algorithm using 3 all-passes with gains $e^{i\phi}$ has respective gains $$W=e^{i\phi} \tag{70a}$$

$$X=2^{1/2}e^{i\phi}(1-\tfrac{1}{4}w^2e^{2i\phi})/(1+\tfrac{1}{4}w^2) \tag{70b}$$

$$Y=2^{1/2}e^{i\phi}(w\cos\phi)/(1+\tfrac{1}{4}w^2) \tag{70c}$$

for a mono input spread across a stage $\pm\theta''$ from front centre, where $$\theta''=2\tan^{-1}(\tfrac{1}{2}w). \tag{71}$$

This algorithm can be extended to provide frequency-dependent rotation of a B-format sound field, using 7 copies of the all-pass $e^{i\phi}$ via $$W'=e^{i\phi}W \tag{72a}$$

$$X'=[e^{i\phi}/(1+\tfrac{1}{4}w^2)][(1-\tfrac{1}{4}w^2e^{2i\phi})X-(w\cos\phi)Y] \tag{72b}$$

$$Y'=[e^{i\phi}/(1+\tfrac{1}{4}w^2)][(w\cos\phi)X+(1-\tfrac{1}{4}w^2e^{2i\phi})Y] \tag{72c}$$

where W, X, Y is the input B-format and W', X', Y' is the output B-format. An additional all-pass $e^{i\phi}$ is needed if a Z height signal is also present.

Since the output signals of equs. (72) are all linear combinations of the seven signals $e^{i\phi}W$, $(1+e^{2i\phi})X$, $e^{i\phi}X$, $e^{3i\phi}X$, $(1+e^{2i\phi})Y$, $e^{i\phi}Y$, $e^{3i\phi}Y$, whatever the value of the width parameter w, it can be implemented using 7 copies of the all-pass $e^{i\phi}$ after 7 mixing busses similar to the arrangements of FIGS. 19 and 20, with individual gains 1, $2^{1/2}w/(1+\tfrac{1}{4}w^2)$, $-8^{-1/4}w^2/(1+\tfrac{1}{4}w^2)$ for each source signal in the X and Y signal paths each feeding a separate mixing buss. This allows an arbitrary number of sources (each equipped with their own B-format panpot) or B-format sound fields to be mixed and each given their own width parameter w giving angular spread 2θ" by gains in the X and Y paths before the mixing busses while sharing the 7 all-passes after the mixing busses.

The complexity of this approach based on equs. (72) is about the same as the interpolation approach of FIG. 20, and has broadly similar levels of phasiness, although the algorithm based on equs. (72) results in less audible phasiness for the important centre-front direction according to the methods of analysing phasiness of the above-cited 1992 Gerzon preprint 3306.

It is also possible to devise mono-in/3-speaker stereo out pseudostereo algorithms similar to those of equs. (66) using three copies of the all-pass $e^{i\phi}$. Suppose that the respective left, centre and right speaker feed signals for a 3-speaker stereo arrangement are $L_3$, $C_3$ and $R_3$, and define the signals $$M_3=\tfrac{1}{2}L_3+2^{-1/2}C_3+\tfrac{1}{2}R_3 \quad (73a)$$

$$S_3=2^{-1/2}(L_3-R_3) \quad (73b)$$

$$T_3=\tfrac{1}{2}L_3-2^{-1/2}C_3+\tfrac{1}{2}R_3 \quad (73c)$$

as described in M. A. Gerzon, "Hierarchical Transmission System for Multispeaker Stereo", preprint 3199 of the 91st Audio Engineering Society Convention, New York (1991 Oct. 4–8). The matrixing (73) is orthogonal, and hence energy preserving, with inverse matrixing $$L_3=\tfrac{1}{2}M_3+2^{-1/2}S_3+\tfrac{1}{2}T_3 \quad (74a)$$

$$C_3=2^{-1/2}(M_3-T_3) \quad (74b)$$

$$R_3=\tfrac{1}{2}M_3-2^{-1/2}S_3+\tfrac{1}{2}T_3. \quad (74c)$$

Then a mono-in/3-speaker out algorithm using 3 all-passes $e^{i\phi}$ may have gains of the form $$M_3=e^{i\phi}(a-be^{2i\phi}) \quad (75a)$$

$$S_3=e^{i\phi}(w\cos\phi) \quad (75b)$$

$$T_3=e^{i\phi}(-c+de^{2i\phi}), \quad (75c)$$

where the parameters w, a, b, c, d are real, and chosen such that $$w^2=4(ab+cd) \quad (76)$$

to ensure a flat energy response as the phase angle $\phi$ is varied. The values of these 5 parameters can be chosen to ensure that for $\phi=0°$, $\pm 90°$ and 180°, the panning is at respective leftward, central and symmetrically rightward 3-speaker positions according to a predetermined panning law, having respectively $$M_3=a+b,\ S=\pm w,\ T_3=-c+d \quad (77a)$$

at leftward and rightward positions and $$M_3=a-b,\ S_3=0 \text{ and } T_3=-c-d \quad (77b)$$

at the centre position. In the cited Gerzon preprint 3309, it is shown that for a 90°-wide 3-speaker layout that a psychoacoustically optimised panpot law has $$M_3=0.9611,\ S_3=0,\ T_3=-0.2760 \quad (78)$$

for a central image, and $$M_3=0.8536,\ S_3=0.5,\ T_3=-0.1464 \quad (79a)$$

$$M_3=0.5804,\ S_3=0.7588,\ T_3=0.2955 \quad (79b)$$

for sounds panned respectively to 0.5 and 0.95 of the full stage width. In these two cases, one has for pseudostereo with the corresponding 0.5 and 0.95 stage widths that in equs. (75):

$$w=0.5,\ a=0.9074,\ b=0.0538,\ c=0.2112,\ d=0.0648, \text{ and} \quad (80a)$$

$$w=0.7588,\ a=0.7708,\ b=0.1904,\ c=-0.0097,\ d=0.2857. \quad (80b)$$

Equ. (76) is automatically satisfied from equs. (77) provided that the energy gain of the panpot law is constant as position is varied.

Pseudostereo for a 4-speaker stereo arrangement with respective outer left, inner left, inner right and outer right speaker feed signals $L_4$, $L_5$, $R_5$, $R_4$ can be obtained from a 3-speaker algorithm via the 4×3 conversion matrix $$L_4=0.3998M_3+0.6206S_3+0.5832T_3$$

$$L_5=0.5832M_3+0.3389S_3-0.3998T_3$$

$$R_5=0.5832M_3-0.3389S_3-0.3998T_3$$

$$R_4=0.3998M_3-0.6206S_3+0.5832T_3, \quad (81)$$

while preserving energy and substantially preserving the 3-speaker localisation quality, as shown in the cited Gerzon preprints 3309, 3199 and 3180.

Figure 26:
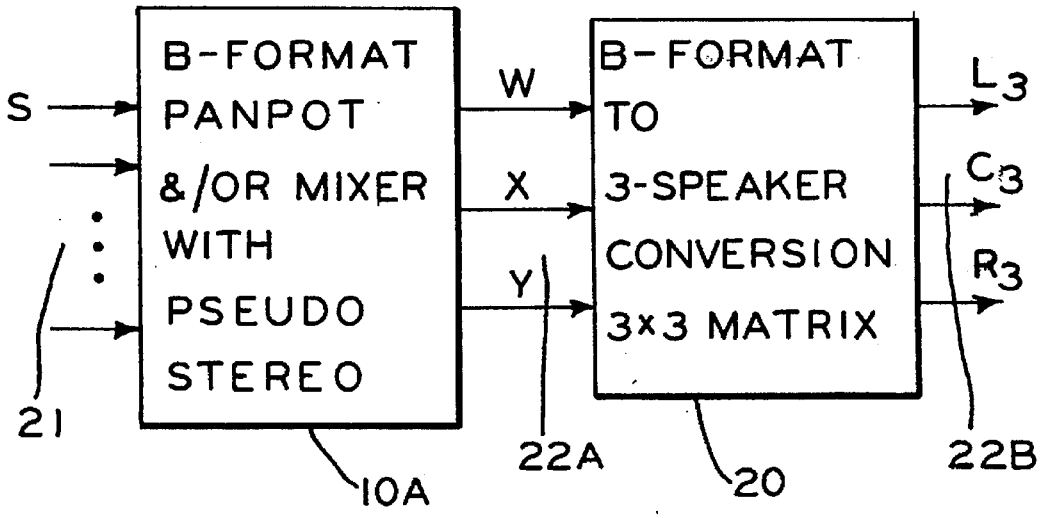
FIG. 26 shows the production of pseudo stereo for 3-loudspeaker stereo systems using matrix conversion from a B-format pseudo stereo signal.

A particularly advantageous method of producing spread images or pseudostereo for 3-channel frontal-stage 3-loudspeaker stereo, shown in FIG. 26, is to convert a source signal S or signals 21 into spread B-format signals 22A using the spreading, panning and/or mixing techniques for B-format described above using a psudostereo means 10A with a B-format output, and then to convert the B-format signals 22A into 3-channel stereo signals 22B by using a 3×3 conversion matrix 20. The advantage of doing this rather than directly producing 3-channel stereo signals is that besides spreading central mono inputs, it is also possible to spead all images within a mix or submix at any stereo position, and all the convenient production tools possible with B-format signals may be used prior to spreading. In particular, B-format panning and rotation matrixing, as described with reference to equation (39) above and in M. A. Gerzon & G. J. Barton, "Ambisonic Surround-Sound Mixing for Multitrack Studios", Conference Paper C1009 of the 2nd Audio Engineering Society International Conference, Anaheim (1984 May 11–14), can be applied to complete mixes incorporating several source positions.

By this means, using a B-format mixer incorporating both B-format panning and spreading, for example as described above with reference to FIG. 19 or 20, as the block marked 10A in FIG. 26, along with a 3×3 conversion matrix 20, one may implement a mixing system for 3-louspeaker stereo which incorporates both psychoacoustically optimised panning, but also spreading and control of size of individual images.

Although in the prior art, a 3×3 conversion matrix from B-format signals W, X, and Y to the 3-loudspeaker signals $L_3$, $C_3$ and $R_3$ was disclosed in the above cited inventor's 1993 preprint number 3339 and in the copending British Patent application number 9204485.8 entitled "Surround Sound Reproduction" by M. A. Gerzon and G. J. Barton, this matrix does not very closely approximate the psychoacoustically ideal 3-loudspeaker stereo panning law described in the above cited Gerzon preprint 3309. A better conversion may be effected by the following 3×3 matrix $$\begin{pmatrix} L_3 \\ C_3 \\ R_3 \end{pmatrix} = \begin{pmatrix} 0.4986 & -0.1174 & 0.3933 \\ -0.1058 & 0.6988 & 0 \\ 0.4986 & -0.1174 & -0.3933 \end{pmatrix} \begin{pmatrix} W \\ X \\ Y \end{pmatrix} \quad (82)$$

or by similar matrices. This matrix causes B-format signals W, X, and Y encoded at the three azimuths −72°, 0° and +72° to be converted respectively into signals optimally panned for 3-loudspeaker stereo according to the above cited preprint 3309 at positions k=−0.95, 0 and +0.95 of the way from centre to the left side of the 3-loudspeaker stereo image.

The 3×3 matrix described does not give a uniform gain in 3 louspeaker reproduction for all B-format azimuths, but the gain is uniform to within −0 dB +0.22 dB over the B-format azimuth range −72° to +72°, which essentially covers the 3-loudspeaker stereo stage after conversion by the 3×3 matrix 20 of equation (82), and is uniform to within ±0.22 dB over the B-format azimuth range −80° to +80°. Therefore, providing that the B-format spread images feeding the conversion matrix 20 of FIG. 26 are confined to the azimuth range −80° to +80°, the energy gain of the spread images will be flat to within ±0.22 dB.

An alternative 3×3 conversion matrix to psychoacoustically panned 3-loudspeaker stereo signals, operative for B-format signals panned over the azimuths −60° to +60°, is $$\begin{pmatrix} L_3 \\ C_3 \\ R_3 \end{pmatrix} = \begin{pmatrix} 0.5620 & -0.1622 & 0.4319 \\ -0.4833 & 0.9657 & 0 \\ 0.5620 & -0.1622 & -0.4319 \end{pmatrix} \begin{pmatrix} W \\ X \\ Y \end{pmatrix}. \quad (83)$$

In general, directional encoding systems, including 2-channel amplitude stereophony, B-format, UHJ, UMX and three-channel optimally panned 3-loudspeaker stereo, all specify how sounds in each direction or position P are encoded into the transmission, recording or storage channels used by assigning to each position P a set of gains and relative phases, one gain and phase for each channel, with which a sound assigned to that position or direction P is mixed into the channels. The law defining the amplitude gains and relative phases of these channels as a function of encoded direction P is termed the "encoding law" or directional "panpot law" of the directional encoding system.

The relative phase between channels of some encoding laws, such as that of equations (8) for conventional 2-channel amplitude stereophony, or that with gains 1, $2^{1/2}\cos\theta$, and $2^{1/2}\sin\theta$ for the W, X and Y channels of horizontal B-format at azimuth θ, may be zero degrees at many or all positions P, whereas in other systems such as UMX, the phase differences may be a varying function of encoded direction.

For many systems, the encoding law is frequency independent, but it may be frequency-dependent for binaural or transaurally encoded sound.

Directional encoding systems are generally designed such that the perceived sound level is generally unchanged as the direction of a sound encoded into a position has its position P' varied across a stage P". Therefore, to minimise coloration, it is generally preferred that any pseudo-stereo panning of the frequency components to and fro should not cause significant variations in the gain magnitude with position relative to that specified by the encoding law. Such variations should preferably be kept to within 1.5 dB or less.

Time-Variant Pseudostereo

The invention may also be applied in the case where the stereo positioning is time-variant at each frequency, by making the all-pass networks $e^{i\phi}$ have a time-variant phase shift. This may be done by cascading $e^{i\phi}$ with a phase shift network with phase shift ξ+θ, where ξ is a fixed frequency-dependent phase shift and θ is a time variant frequency-independent phase shift.

It is well known in the prior art that a pair of all-pass networks having a relative 90° phase difference across a wide predetermined audio frequency range can be produced, having respective phase responses ξ and ξ+90°, by using two cascades of first order all-pass networks, here termed respectively the "lag" and "lead" networks. A phase shift of ξ+θ for arbitrary phase angle θ within said predetermined frequency range may then be obtained by adding cosθ times the output of a lag network to sinθ times the output of a lead network. By this means, a phase shift ξ+θ may be obtained with time-varying θ by simply having two time-varying gains cosθ and sinθ in series with said lag and lead networks.

If the angle θ increases uniformly with time, then the effect of such a time-variant phase shift is to increase the frequency of all incoming frequency components by the frequency of rotation of θ, i.e. by the number of rotations of θ through 360° per second. Similarly, a uniform decrease of θ causes a lowering of incoming frequency components. In the prior art, it is known that small increases or decreases of frequency produced by this method are not unpleasant in effect, and one studio effect comprises presenting a sound in two stereo channels with an increase of frequency in one and a corresponding decrease in the other to produce an effect of the two channels being spatially decorrelated.

Such time-variant phase shifts may be used in the present invention to obtain an improved time-variant decorrelation effect by cascading every one of the all-pass networks $e^{i\phi}$ in the above descriptions with a phase shift ξ+θ where θ is time-variant, such as described above. This has two effects. First, the stereo position of each incoming frequency component is now made time variant, since it is now a function of the time variant phase shift ϕ+ξ+θ through the combined all-pass network, so that each frequency component swings to-and-fro across the predetermined spread stage as time varies. Second, the output signals contain pitch shifted components.

The second effect may be found less desirable than the first, and it is possible to ensure that the predominant signals passing through a time-variant pseudo-stereo algorithm are not frequency shifted as described by way of example in the following, with reference to the example of FIG. 23*c*.

In this example, the all-passes 1L and 1R are made time-invariant as previously, and the all-passes 5*a*L and 5*a*R are made to incorporate a time-invariant all-pass factor with phase shift ξ as in the lag network described above. This ensures that the main signal path through the network of FIG. 23*c* is time-invariant, and suffers no frequency shifts. The feedback-path all-pass networks 1*e* and 1*f* are made to incorporate a time-variant phase shift ξ+θ as above described, and the feedforward all-passes 1*c* and 1*d* are made to incorporate a time variant phase shift ξ−θ. These time-variant phase shift factors, in addition to the all-pass factors normally present, ensure that the algorithm produces no-phasiness pseudostereo, but which is now time variant, but with the main signal components no longer being subjected to pitch shifts, except in the feedback and feedforward signal paths.

It is known that the ears are sluggish in their ability to follow rapid changes of stereo position, so that for suitable rotation frequencies of the angle θ of a few cycles per second, the variations of stereo position with time are simply heard as a pleasant spreading of the stereo effect, or as a decorrelation of the signal channels. Unlike the prior art in time-variant decorrelation, this method of time-variant decorrelation of stereo signals is not subject to phasiness effects, and avoids frequency shifts on the predominant signal components being processed.

For these reasons, such time-variant pseudostereo is particularly appropriate for use where spatial dispersion effects are required, such as applications to reproduction of a spatially diffuse "surround" signal in cinema and TV sound applications.

The invention may be implemented either using analogue electronic circuitry or digital signal processing (DSP) chips, such as those of the Motorola DSP 56000 or DSP 96000 family or those of the Texas Instrument TMS320 family.

Figure 27A:
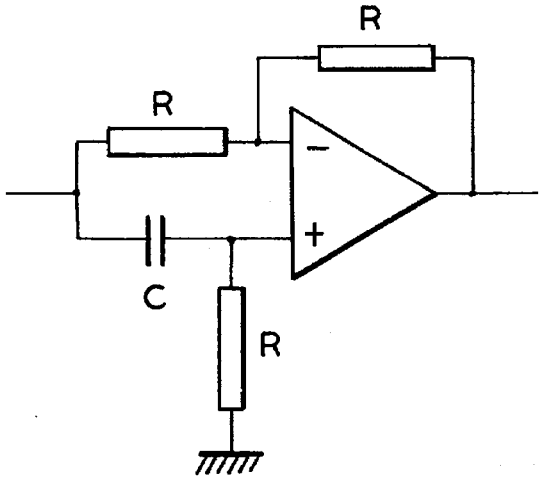
FIGS. 27*a* to 27*c* show schematics of circuits and digital signal processing algorithms for implementing all-pass networks.

In analogue implementations, the all-pass networks $e^{i\phi}$ used in implementations such as those of FIGS. 3, 7, 8, 10, 19 and 23 and those described with reference to equations (66) to (81) using feedback and/or feedforward around all-pass networks may be implemented as a cascade of first-order all-pass networks, such as are described in the cited Orban reference. FIG. 27*a* shows one unity gain first order all-pass network, well-known in the prior art, implemented using an operational amplifier and a few resistors having identical values R kΩ of resistance and a capacitor having capacitance C μF, which has a pole frequency in Hz equal to $$F=10^3/(2\pi RC).$$

Figure 27B:
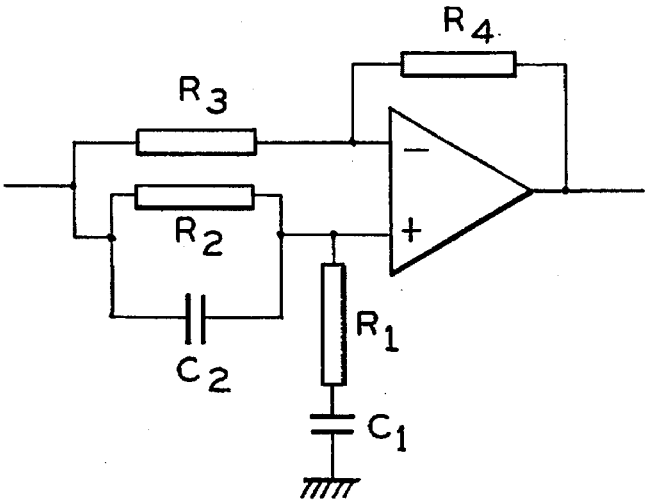

There are also many known analogue implementations in which a cascaded pair of first order all-pass poles may be implemented using a single operational amplifier. By way of example, FIG. 27*b* shows an operational amplifier circuit which implements a cascaded pair of first order all-pass pole-zeros at frequencies $F_1$ and $F_2$ Hz if the values of the resistors $R_1$ to $R_4$ in kΩ and of the capacitors $C_1$ and $C_2$ in μF are chosen in accordance with the following design formulas:

Compute the time constants $$t_1=10^3/(2\pi F_1) \text{ and } t_2=10^3/(2\pi F_2),$$

and choose $C_1$ and $C_2$ according to design convenience such that $$k=C_1/C_2 \leqq \frac{1}{4}\left(\frac{t_2}{t_1}+\frac{t_1}{t_2}-2\right).$$

Then compute $$\tau_2=\frac{t_1+t_2+\sqrt{t_1^2+t_2^2-(4k+2)t_1t_2}}{2(k+1)}$$

$$\tau_1=t_1t_2/\tau_2.$$

Then $$R_1=\tau_1/C_1, R_2=\tau_2/C_2,$$

and $$R_4/R_3=1+\frac{2}{k}\left(1+\frac{\tau_1}{\tau_2}\right),$$

where $R_3$ is chosen according to design convenience.

In analogue implementations, summing and differencing nodes and gains may be implemented using any of the operational amplifier networks well known to those skilled in the art commonly used for this purpose, such as virtual earth mixing networks. By this means, analogue implementations of the invention may easily be designed and constructed.

In digital signal processing implementations, if the audio signal is not already available in digital form, the analogue signal may be converted into digital form by an analogue-to-digital converter. The digital signal may then be fed into a digital signal processing chip, in which the operations acting on signals of addition or subtraction, delay by one or more samples, and multiplication by predetermined gains stored as coefficients in RAM or ROM may be programmed using the programming tools available for use with DSP chips. Any signal processing algorithm built out of these operations, within the limitations of memory and speed of computation of the chip and associated memory, may be programmed by methods well known to those skilled in the art. All the FIR and recursive algorithms in this description are of this form. The programs for the signal processing algorithm may be downloaded from external memory or stored in internal memory in the chip.

Figure 27C:
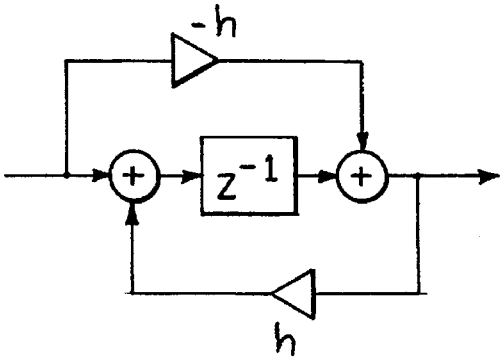

In digital implementations, the all-pass algorithms $e^{i\phi}$ used in implementations such as those of FIGS. 3, 7, 8, 10, 19 and 23 and those described with reference to equations (66) to (81) using feedback and/or feedforward around all-pass algorithms may be implemented as a cascade of unity-gain first-order all-pass algorithms $$(-h+z^{-1})/(1-hz^{-1})$$

shown schematically in FIG. 27*c*, where the gain h, whose magnitude is less than one, is related to the pole frequency F by the formula $$h=\tan\{\pi/4-(\pi F)/F_s\}$$

where $F_s$ is the sampling frequency (44.1 kHz for a signal from compact disc). If feedback is applied around such a cascaded set of all-pass algorithms, at least one of the all-pass pole/zeros must have h=0, i.e. be of the form $z^{-1}$, in order that the algorithm be recursive, unless the algorithm is rearranged as described above with reference to FIG. 11.

We have found subjectively that the results of a digitally-implemented algorithm at the compact disc sampling rate of 44.1 kHz are particularly satisfactory if the all-pass network $e^{i\phi}$ is the cascade of 21 all-pass poles/zeros with the following values of pole zero frequency F:

2 pole/zeros with F=152 Hz
4 pole/zeros with F=300 Hz
2 pole/zeros with F=437 Hz
2 pole/zeros with F=614 Hz
2 pole/zeros with F=1718 Hz
2 pole/zeros with F=2856 Hz
2 pole/zeros with F=3683 Hz
2 pole/zeros with F=4804 Hz
2 pole/zeros with F=6018 Hz One pole/zero with F=11.25 kHz and h=0 The same pole/zero frequencies may be used at other sampling rates such as 48 kHz, with the exception of the $z^{-1}$ pole/zero which must be at $F=\frac{1}{4}F_s$ in order to be of the form $z^{-1}$. These pole/zero frequencies are not exactly uniformly distributed with log frequency, but nevertheless do cause sweeps to-and-fro of position with frequency that are roughly uniform with logarithm of frequency.

Figure 28A:
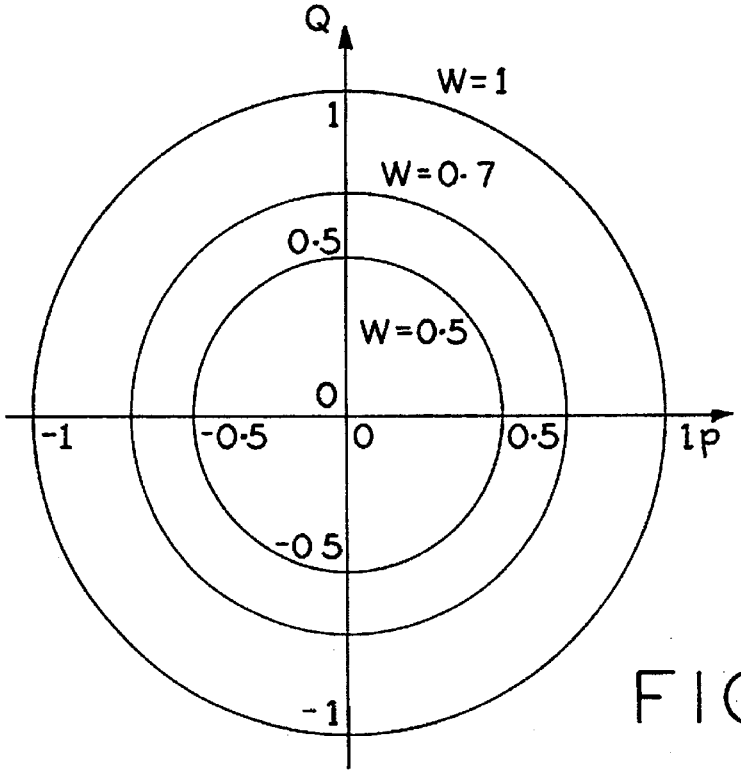
FIGS. 28*a* to 28*c* show plots of phasiness Q against position P for various implementations of pseudo stereo.
Figure 28B:
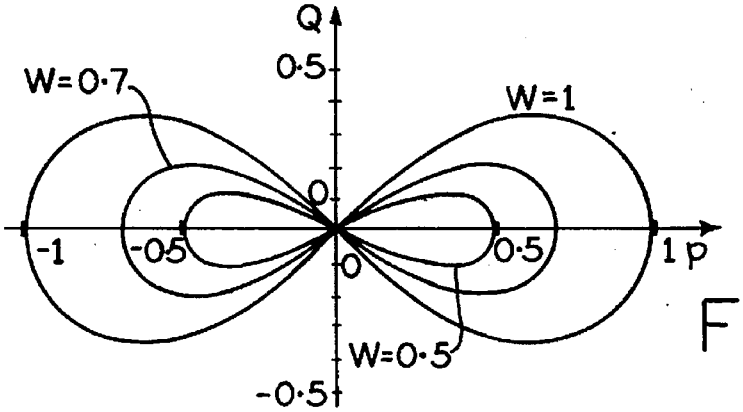
Figure 28C:
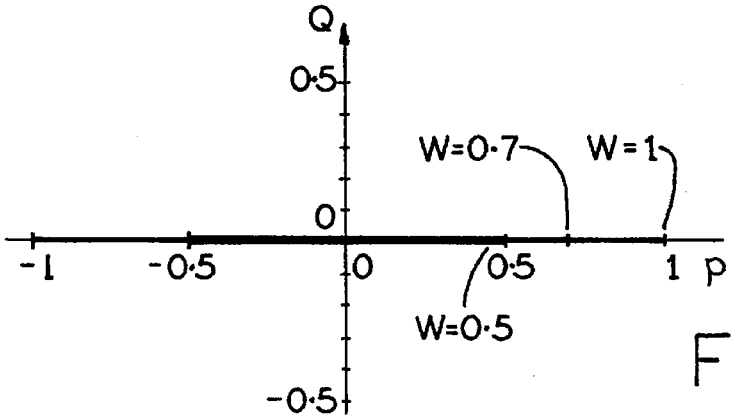

The graphs of FIGS. 28*a* to 28*c* show the phasiness of various pseudostereo techniques. The graphs show how phasiness Q varies with position P by plotting the values of P and Q as frequency is varied for various pseudostereo techniques.

FIG. 28*a*, a version of which was published as FIG. 20 of M. A. Gerzon, "Pictures of 2-Channel Directional Reproduction Systems", preprint 1569 of the 65th Audio Engineering Society Convention, London, 25 to 28 Feb. 1980, shows the phasiness Q of the prior art Orban technique for various different positions P and width settings W=0.5, 0.7 and 1. It will be seen that in all cases, the phasiness is large for the central position P=0. FIG. 28*a* is computed from equations (4).

By contrast, FIG. 28*b* shows the values of phasiness Q plotted against P for the reduced phasiness method of FIGS. 3 or 19 for various width settings w=0.5, 0.7 and 1. It will be seen that at three positions, the two edges and centre of the stage across which spreading is done, the phasiness Q equals zero, and that elsewhere, the phasiness is reduced compared to the Orban case. FIG. 28*b* is computed from equations (6).

FIG. 28*c* shows the phasiness Q for the implementations such as those of FIGS. 7, 8 and 10 for which Q=0. In this case, the graph is simply a line along the P axis between the two extreme width positions.

Although it is found that for best results and to avoid unpleasant splitting of transients from steady state sound components, the all-pass networks $e^{i\phi}$ used in the invention should not have excessive time delays, the subjective results may often be found acceptable with delays a little over the preferred maximum of 2 msec. For example, a delay of up to 4 or 5 msec may sometimes be found acceptable. This is especially the case when pseudo stereo algorithms are used to spread the images of delayed sounds accompanying a direct sound, when a low-phasiness pseudostereo algorithm may be used to spread delayed sounds. In such applications, longer time delays than 2 msec in the pseudostereo algorithms used for delayed accompanying sounds may be found subjectively acceptable, due to the presence of the undelayed signal.

The invention may be applied as a separate processor placed between signal sources and feeds, or may be incorporated within a signal processor as a component part of other signal processing devices or algorithms. For example, as described above, it may be incorporated within a stereo feedback loop around a delay line in a delay effects unit or in the direct or indirect signal paths within a distance simulation processor, or it may be incorporated within a mixing device, for example as described with reference to FIG. 20. It will be appreciated that such uses of the invention within signal processing devices or apparatus are within the scope of the invention, although the inputs and outputs of the pseudo-stereo algorithms may not be externally accessible.

I claim:

1. An audio signal processor (10) responsive to an input sound source signal S (21) and arranged to produce a pseudo stereo effect in a plurality of output signals (22) directionally encoded for reproduction via a predetermined directional encoding system, the audio signal processor including filtering means (1*a*,1*b*,2L,2R,11L,11R) arranged to vary the encoded direction across a directional sound stage of an output signal as the frequency of the input sound source signal varies, the reproduced energy gain characteristic of the filtering means being substantially constant with frequency:

characterised in that the phasiness Q of the filtering means (1*a*,1*b*,2L,2R,11L,11R) is substantially zero for at least three positions in space within the directional sound stage.

2. An audio signal processor (10) responsive to an input sound source signal S (21) and arranged to produce a pseudo stereo effect in a plurality of output signals (22) directionally encoded for reproduction via a predetermined directional encoding system, the audio signal processor including filtering means (1*a*,1*b*,2L,2R,11L,11R) arranged to vary the encoded direction across a directional sound stage of an output signal as the frequency of the input sound source signal varies:

characterised in that the filtering means (1*a*,1*b*,2L,2R,11L,11R) have a gain magnitude characteristic relative to the encoding law of the encoding system which is substantially independent of frequency and an amplitude/phase characteristic as a function of frequency which follows the encoding law of the encoding system for substantially all audio frequencies within the operational bandwidth of the system and encodes the output signal according to the encoding law for reproduction from a direction P' across a directional sound stage P", the direction P' varying with the frequency of the source signal S.

3. An audio signal processor according to claim 2, responsive to a plurality of input signal channels conveying source signals directionally encoded for reproduction from a direction P via a second predetermined sound encoding system, in which the filtering means are arranged to vary the direction P' and sound stage P" of each output signal depending upon the direction of encoding P of the corresponding input signal.

4. An audio signal processor according to claim 1, wherein said filtering means comprise a frequency-dependent rotation matrix means whose angle of rotation varies with frequency within a predetermined range of angles.

5. An audio signal processor according to claim 4, wherein said audio signal processor is unitary.

6. An audio signal processor according to claim 5, in which the filtering means comprise parallel all-pass filtering means and series rotation matrix means within a feedback path and a feedforward path bypassing said all-pass means.

7. An audio signal processor according to claim 1, wherein said predetermined directional encoding systems are 2-channel stereo encoded with a sine/cosine directional panning law.

8. An audio signal processor according to claim 1, wherein said predetermined directional encoding systems are ambisonic B-format encoding systems.

9. An audio signal processor according to claim 1, wherein said predetermined encoding systems encode channels with gains proportional to azimuthal or spherical harmonics of direction.

10. An audio signal processor according to claim 1 for a predetermined direction encoding system A further comprising a matrix conversion means, which may be frequency-dependent, following the filtering means, for converting signals encoded for system A for directional encoding or reproduction via another predetermined directional encoding system B.

11. An audio signal processor according to claim 1, wherein said predetermined directional encoding system is binaural encoding for a measured or theoretically modelled head.

12. An audio signal processor according to claim 1, in which said predetermined directional encoding system is transaural stereo.

13. An audio signal processor according to claim 1, in which said predetermined directional encoding system is UHJ.

14. An audio signal processor according to claim 1, in which said predetermined directional encoding system is arranged for reproduction via an arrangement of three or more loudspeakers covering a stereophonic stage.

15. An audio signal processor according to claim 14, wherein the signal channels are intended to feed different loudspeakers.

16. An audio signal processor according to claim 1 responsive to source signals S encoded in all directions within a plurality of input signal channels conveying signals encoded for a second predetermined directional sound encoding system, wherein the filtering means are arranged so that a rotation of source direction in said input signals has the effect of a related rotation of the encoded directions in said predetermined encoding system in said plurality of output signals.

17. An audio signal processor according to claim 1, wherein the encoded direction of an output signal sweeps to and fro across said predetermined directional sound stage as the frequency of a corresponding source signal S varies.

18. An audio signal processor according to claim 17, in which the number of swings to and fro within the audio band is not less than 3.

19. An audio signal processor according to claim 18, in which within the audio band from 200 Hz to 6 kHz the frequencies at which said source is reproduced from a predetermined position within said predetermined directional sound stage are spaced apart more nearly uniformly on a logarithmic or Bark frequency scale than on a linear frequency scale.

20. An audio signal processor according to claim 1, in which the width of said predetermined directional sound stage varies with frequency.

21. An audio signal processor according to claim 1, wherein said filtering means are linear filtering means.

22. An audio signal processor according to claim 21, wherein all time delay factors in component filters of the filtering means, other than those responsible for the overall time delay through said audio signal processor, are less than 2 milliseconds.

23. An audio signal processor according to claim 22, wherein said time delay factors are less than one millisecond.

24. An audio signal processor according to claim 23, wherein all said time delay factors are less than one half millisecond.

25. An audio signal processor according to claim 1, further comprising means connected to said filtering means for mixing a plurality of source signals and control means connected to said filtering means for independently adjusting the mean output direction and the angular spread of each said source in said output signals.

26. An audio signal processor according to claim 25, wherein frequency-dependent filtering means used in achieving said pseudo stereo effect are shared in common among said source signals S.

27. An audio signal processor according to claim 1, further comprising a distance effect simulator arranged to generate signals corresponding to simulated early reflections with gains and time delays characteristic of a distance d, wherein the direct sound output of each source signal is given an angular spread characteristic of a desired acoustical width w' of said sound source S at said distance d.

28. An audio signal processor according to claim 27, wherein control means are also provided for individual sound sources for adjusting simulated distance d, said distance control means adjusting the relative time delays and gains of simulated early reflections relative to direct sound signal outputs, said distance control means also adjusting the angular width of spread of the direct sound responsive to the distance d.

29. An audio signal processor according to claim 28, wherein the plurality of source signals S share a common early reflection simulation means.

30. An audio signal processor according to comprising the series connection of any number of audio signal processors according to any preceding claim, of which at most one is not according to claim 16.

31. An audio signal processor according to claim 2, wherein the total reproduced energy gain of the filtering means is substantially constant with frequency, the phasiness Q of the filtering means being substantially zero at at least three predetermined positions within said predetermined directional sound stage.

32. An audio signal processor according to claim 10, wherein the predetermined directional encoding system A comprises linear combinations of B format signals W, X, Y having respective directional gains that are constant, proportional to the cosine of encoded azimuthal angle and the sine of encoded azimuthal angle, the predetermined directional encoding system B provides for loudspeaker feed signals $L_3$, $C_3$ and $R_3$ for three-loudspeaker stereo, and the matrix conversion means (20) is a 3×3 conversion matrix.

33. An audio signal processor according to claim 32, further comprising means for mixing and directionally panning a plurality of independent source signals encoded according to the predetermined encoding system A, prior to the conversion of said signals by the matrix conversion means.

34. A method of processing an audio signal S (21) to produce a pseudo stereo effect in a plurality of output signals (22) directionally encoded for reproduction via a predetermined directional encoding system, comprising filtering the input sound source signal S (21) thereby varying the encoded direction across a directional sound stage of a corresponding output signal as the frequency of the input sound source signal S (21) varies, the reproduced energy gain of the output signal being substantially constant with frequency:

characterised in that the phasiness Q introduced by the step of filtering is substantially zero for at least three positions in space within the directional sound stage.

35. A method of processing an audio sound source signal S (21) to produce a pseudo stereo effect in a plurality of output signals (22) directionally encoded for reproduction via a predetermined directional encoding system, including the step of filtering the input audio signal S (21) thereby varying the encoded direction across a directional sound stage of an output signal as the frequency of the input sound source signal (21) varies:

characterised in that the output signals are directionally encoded with a gain magnitude substantially independent of frequency and with an amplitude/phase characteristic which follows the encoding law of the encoding system for substantially all audio frequencies within the operational bandwidth of the system thereby encoding the output signal according to the encoding law for reproduction from a direction P' across a directional sound stage P", the direction P' varying with the frequency of the source signal S.

36. A method according to claim 35, in which the plurality of input sound source signals (21) are directionally encoded for reproduction from a direction P via a second predetermined sound encoding system, and in which the direction P' and sound stage P" of each output signal vary depending upon the direction of encoding P of the corresponding input signal.

37. An method according to claim 34, in which the output signals produced by the step of filtering the input sound source signal S (21) are encoded according to a directional encoding system A comprising linear combinations of B format signals W, X, Y having respective directional gains that are constant, proportional to the cosine of encoded azimuthal angle and the sine of azimuthal angle, and the method further comprises converting the signal to a second directional encoding system B providing loudspeaker feed signals $L_3$, $C_3$ and $R_3$ for three-loudspeaker stereo.

38. A method according to claim 37, further comprising mixing and directionally panning a plurality of independent source signals encoded according to the predetermined encoding system A, prior to the conversion of said signals.

39. An audio signal processing system for processing a source signal S and producing an output signal comprising a plurality of channels encoded for reproduction via a directional encoding system, said output signal when reproduced producing a pseudo stereo effect, said audio signal processing system comprising:

an input for receiving said source signal S;

an output for outputting said plurality of channels;

signal paths connecting said input to said output; and means for filtering having predetermined gain and phasiness characteristics connected in said signal paths and arranged to modify signals in said signal paths in a frequency-dependent manner producing modified signals in said plurality of signals at said output encoded for reproduction from a direction in a directional sound stage, said direction varying with frequency of said source signal, said means for filtering thereby producing said pseudo stereo effect;

wherein said gain characteristic of said means for filtering is substantially constant with frequency and said phasiness of said means for filtering is substantially zero for at least three positions within said sound stage.

40. An audio signal processing system for processing a source signal S and producing an output signal comprising a plurality of channels encoded for reproduction via a directional encoding system, said output signal when reproduced producing a pseudo stereo effect, said audio signal processing system comprising:

an input for receiving said source signal;

an output for outputting said plurality of channels;

signal paths connecting said input to said output; and means for filtering having predetermined gain and gain/phase characteristics connected in said signal paths and arranged to modify signals in said signal paths in a frequency-dependent manner producing modified signals in said plurality of channels at said output encoded for reproduction from a direction in a directional sound stage, said direction varying with frequency of said source signal, said means for filtering thereby producing said pseudo stereo effect;

wherein said gain characteristic of said means for filtering relative to an encoding law of said encoding system is substantially independent of frequency and said gain/phase characteristic as a function of frequency follows said encoding law of said encoding system for substantially all audio frequencies within an operational bandwidth of said system thereby encoding said output signal according to said encoding law for reproduction from a direction P' across a directional sound stage P", said direction P' varying with frequency of said source signal S.

41. An audio signal processor according to claim 5, wherein the unitary audio signal processor is time-variant.

42. An audio signal processor according to claim 1, wherein said filtering means comprises a first filter having an input and an output and a second filter having an input and an output, said input source input signal is associated with a source input, said first filter input is connected to said source input, said first filter output is connected to said second filter input, said second filter output coupled to an output of said audio signal processor, wherein a signal associated with said audio signal processor output depends on a second filter output signal associated with said second filter output.

43. An audio signal processor according to claim 42, further comprising a left output and a right output, each associated with a left and a right output signal, respectively, wherein said filtering means further comprises an adding means having a plurality of inputs and an output, a subtracting means having a plurality of inputs and an output, and first and second gain means, each of said first and second gain means having an input and output, respectively, said source input connected to said first gain means input, said first gain means output connect to one of said adding means inputs, said first filter output connected to another of said adding means inputs, said adding means output connected to said left output, said first filter output connected to one of said subtraction means inputs, said second filter output connected to said second gain means input, said second gain means output connected to another of said subtraction means inputs, said subtraction means output connected to said right output.

44. An audio signal processor according to claim 42, wherein said first filter and said second filter comprise identical first and second all-pass means with a complex gain $e^{i\phi}$.

45. A method of processing an audio signal according to claim 34, wherein said step of filtering the input sound source signal S comprises:

providing a first and second filtering means;

passing the input sound source signal through the first filter to form a first filter output signal;

passing the first filter output signal through the second filter to form a second filter output signal; and forming a processed output signal which depends on the second filter output signal.

46. A method of processing an audio signal according to claim 45, wherein said step of filtering the input sound source signal S further comprises the steps of:

providing an adding means, a subtracting means, a first gain means, and a second gain means;

passing the input source signal through the first gain means to form a first gain means output signal;

combining the first gain means output signal and the first filter output signal using the adding means to form a left output signal;

passing the second filter output signal through the second gain means to form a second gain means output signal; and combining the first filter output signal and the second gain means output signal using the subtraction means to form a right output signal.

47. A method of processing an audio signal according to claim 45, wherein said step of providing first and second filters comprises providing identical first and second all-pass means with a complex gain $e^{i\phi}$.

* * * * *